US007208254B2

(12) United States Patent
Yuasa et al.

(10) Patent No.: US 7,208,254 B2
(45) **Date of Patent: *Apr. 24, 2007**

(54) BINDING RESIN FOR TONER, TONER AND ELECTROPHOTOGRAPHIC APPARATUS

(75) Inventors: Yasuhito Yuasa, Katano (JP); Noriaki Hirota, Suita (JP); Masahisa Maeda, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/352,269

(22) Filed: Feb. 13, 2006

(65) Prior Publication Data

US 2006/0127789 A1 Jun. 15, 2006

Related U.S. Application Data

(62) Division of application No. 10/421,849, filed on Apr. 24, 2003, now Pat. No. 7,063,929, which is a division of application No. 09/914,614, filed as application No. PCT/JP00/01219 on Mar. 2, 2000, now Pat. No. 6,579,653.

(30) Foreign Application Priority Data

| | | |
|---|---|---|
| Mar. 3, 1999 | (JP) | 1999/055007 |
| Mar. 3, 1999 | (JP) | 1999/055008 |
| Mar. 3, 1999 | (JP) | 1999/055009 |
| Mar. 3, 1999 | (JP) | 1999/055010 |
| Dec. 2, 1999 | (JP) | 1999/343061 |
| Dec. 3, 1999 | (JP) | 1999/344478 |

(51) Int. Cl.
*G03G 9/087* (2006.01)

(52) U.S. Cl. ..... 430/108.2; 430/109.3; 430/111.4

(58) Field of Classification Search ..... 430/108.2, 430/109.3, 111.4
See application file for complete search history.

(56) References Cited

U.S. PATENT DOCUMENTS

| | | | | |
|---|---|---|---|---|
| 5,837,415 | A | 11/1998 | Uchida | |
| 5,863,697 | A | 1/1999 | Uchiyama et al. | |
| 5,914,380 | A | 6/1999 | Ito et al. | |
| 5,985,502 | A | 11/1999 | Ataki et al. | |
| 6,432,599 | B1 | 8/2002 | Yuasa et al. | |
| 6,458,499 | B1 | 10/2002 | Onuma et al. | |
| 6,489,074 | B1 | 12/2002 | Takehara et al. | |
| 6,579,653 | B1 * | 6/2003 | Yuasa et al. | 430/108.2 |
| 6,733,945 | B2 | 5/2004 | Hirota et al. | |

FOREIGN PATENT DOCUMENTS

| | | |
|---|---|---|
| JP | 4-190240 | 7/1992 |
| JP | 7-28275 | 1/1995 |
| JP | 7-114204 | 5/1995 |
| JP | 9-288379 | 11/1997 |
| JP | 9-319139 | 12/1997 |
| JP | 10-115951 | 5/1998 |
| JP | 10-186722 | 7/1998 |
| JP | 11-38678 | 2/1999 |

* cited by examiner

*Primary Examiner*—John L Goodrow
(74) *Attorney, Agent, or Firm*—Wenderoth, Lind & Ponack, L.L.P.

(57) ABSTRACT

In an electrophotographic apparatus, which forms a color image by transferring a plurality of toner images having different colors onto an image-receiving sheet so as to be stacked and fixed thereon, even in the case of carrying out an oil-less fixing process and allowing the process speed to vary within wide range, the present invention provides a binder resin, toner and an electrophotographic apparatus which make it possible to achieve both superior fixing property and anti-offset property, and consequently to form a color image with high color reproducibility and high quality. In the present invention, a toner comprising a molecular weight maximum peak in a range of molecular weights from $2\times10^3$ to $3\times10^4$ in molecular weight distribution of GPC chromatogram, and a molecular weight maximum peak or shoulder in a range from $3\times10^4$ to $1\times10^6$, wherein said molecular weight maximum peak or shoulder located on a range of molecular weights from $3\times10^4$ to $1\times10^6$ is obtained by kneading a toner composition containing a specific binder resin containing a high molecular weight component at not less than a specific amount so that the high molecular weight component of the binder is converted into a low molecular weight component by thermal or mechanical energy exerted at the time of kneading, is provided.

11 Claims, 14 Drawing Sheets

BINDING RESIN FOR TONER, TONER AND ELECTROPHOTOGRAPHIC APPARATUS

This is a divisional of 10/421,849, filed Apr. 24, 2003 now U.S. Pat. No. 7,063,929, which is a divisional of Ser. No. 09/914,614, filed Sep. 14, 2001, now U.S. Pat. No. 6,579,653, which is a 371 of PCT/JP00/01219, filed Mar. 2, 2000.

TECHNICAL FIELD

The present invention relates to a toner used for copying machines, laser printers, plain paper facsimiles, color PPCs, color laser printers and color facsimiles, and also to an electrophotographic apparatus.

BACKGROUND OF THE INVENTION

In recent years, the objective of electrophotographic apparatuses has been changing from office-use to personal-use, and there have been increasing demands for techniques for achieving small-size and maintenance-free apparatuses. For this reason, conditions, such as a superior maintenance property for recycling a waste toner and reduced ozone generation, need to be satisfied.

The following description will discuss a printing process carried out by a copying machine and a printer of an electrophotographic system. First, an image-bearing member (hereinafter, referred to as a photosensitive member) is charged so as to form an image. As to the charging method for evenly charging a surface of a photosensitive member, a corona charger may be used as has been conventionally used, or in recent years, a contact-type charging method in which a conductive roller is directly pressed onto a photosensitive member has been adopted in an attempt to cut generation of ozone. In the case of a copying machine, after a photosensitive member has been charged, light is directed to an original material to be copied and the reflected light is directed to a photosensitive member through a lens system. Alternatively, in the case of a printer, an image signal is sent to a light-emitting diode or a laser diode serving as an exposing light source so that a latent image is formed on a photosensitive member based on ON-OFF operations of light. When the latent image (resulting from high and low portions of the surface potential) has been formed, the latent image on a photosensitive member is converted into a visible image by toner that is preliminarily charged color powder (having a diameter of approximately 5 μm to 15 μm). The toner is allowed to adhere to a surface of a photosensitive member in accordance with the high and low portions of the surface electric potential of a photosensitive member, and electrically transferred onto a sheet of transfer paper. In other words, the toner, which has been preliminarily charged positively or negatively, is electrically absorbed by applying a charge having an opposite polarity to the toner polarity from behind the transfer paper. As to a transferring method, the conventional method using a corona charger may be used, or a recently-developed contact-type transfer method in which a conductive roller is directly pressed onto a photosensitive member has been put to practical use in an attempt to cut generation of ozone. At the time of the transferring process, all the toner on a photosensitive member is not necessarily transferred onto a sheet of transfer paper, and one portion thereof remains on a photosensitive member. This residual toner is scraped by a cleaning blade, etc., in a cleaning section to form a waste toner. Then, the toner that has been transferred onto the transfer paper is fixed onto a sheet of paper by heat and pressure applied in a fixing process.

As to the fixing method, there are proposed a pressure fixing system in which a sheet of paper is allowed to pass through not less than two metal rolls, an oven fixing system in which the paper is allowed to pass through an atmosphere heated by an electric heater and a heat roll fixing system in which the paper is allowed to pass through heated rollers. In the case of the heat roll fixing system, a preferable thermal efficiency is obtained at the time when the toner image is fused onto the sheet of transfer paper because the surface of the heating roller and the toner surface on the sheet of transfer paper are made in press-contact with each other, thereby making it possible to carry out the fixing process quickly. However, in the case of the heat roll fixing system, the toner in a heated and melted state is made in press-contact with the surface of the heating roller, with the result that one portion of the toner tends to adhere to the roller surface to again adhere to the sheet of transfer paper, resulting in a stained image, which phenomenon is referred to as an offset phenomenon. As to a method for preventing the offset phenomenon, a method has been proposed in which the surface of the heating roller is formed by fluorine resin or silicone rubber that has a heat resisting property and a superior mold-releasing property to toner, and an anti-offset liquid such as silicone oil is supplied onto the surface so as to coat the roller surface with a thin-film of the liquid. In this method, however, when the liquid such as silicone oil is heated, an offensive odor is generated, and additional devices are required so as to supply the liquid, making the mechanism of the copying machine complex. Moreover, in order to prevent the offset in a stable manner, it is necessary to control the supply of the liquid with high precision, and this causes high costs of the copying machine. Therefore, there have been demands for a toner which provides a superior fixed image and is free from an offset, without the necessity of supplying such a liquid.

As has been generally known, an electrostatic charge developing toner, used for an electrophotographic method, is generally composed of a resin component, a coloring component formed by a pigment or dye, a plasticizer, a charge control agent and an additive component such as a mold-releasing agent to be added, if necessary. As to the resin component, a natural or synthetic resin is used alone or in combination as the resin component.

Then, the additive agents are preliminarily mixed at an appropriate ratio, and heated and kneaded in a thermally molten state, and this is finely ground through an air-flow collision plate system, and then finely classified to form a toner base material. Then, an external additive agent is externally added to this toner base material, thereby forming a toner.

In mono-component developing system, only the toner is used, and in the case of a two-component developing agent, the toner and a carrier composed of magnetic particles are mixed.

In a color copying machine, a photosensitive member is charged by a corona discharge using a static charger, and latent images of respective colors are applied to a photosensitive member as light signals to form electrostatic latent images, and this is developed by, for example, a yellow toner serving as a first color, so as to visualize the latent image. Thereafter, a transfer member, which has been charged to a polarity opposite to the charge of the yellow toner, is made in contact with a photosensitive member so that the yellow toner image, formed on a photosensitive member, is transferred thereon. After residual toner from the transferring process has been cleaned therefrom, a photosensitive member is subjected to a static charge eliminating process, thereby completing the developing and transferring processes of the first color toner.

Thereafter, the same processes as the yellow toner are repeated as to toners of magenta and cyan so that the toner images of the respective colors are superimposed on a transfer member to form a color image. These superimposed toner images are transferred onto a sheet of transfer paper that has been charged to a polarity opposite to the toner, and then fixed, thereby completing the copying process.

As to the color-image forming method, generally-used systems are: a transfer drum system in which toner images of the respective colors are successively formed on a single photosensitive member, and a transfer member wrapped on the transferring drum is rotated and allowed to face a photosensitive member repeatedly so as to successively superimpose the toner images of respective colors thereon, and a continuous superimposing system in which a plurality of image-forming units are placed side by side, and a transfer member, transported by a belt, is allowed to pass through the respective image-forming units so as to successively transfer toner images of respective colors thereon, thereby superposing the color images.

Here, for example, Japanese Patent Kokai Publication No. 250970/1989 (H1-250970) discloses a color image-forming apparatus using a continuous transferring system. In this conventional apparatus, four image-forming stations, each containing a photosensitive member, an optical scanning means, etc. for forming an image having each of four colors, are placed side by side, and a sheet of paper, transported by a belt, is allowed to pass below the respective photosensitive members so that color toner images are superimposed thereon.

Moreover, based on another method for forming a color image by superimposing toner images of different colors on a transfer member, Japanese Patent Kokai Publication No. 212867/1990 (H2-212867) has disclosed a method in which toner images of respective colors, which have been successively formed on a photosensitive member, are once superimposed on an intermediate transfer member, and the toner images on this intermediate transfer member are lastly transferred on a sheet of transfer paper in one batch.

Here, from the viewpoint of the recent earth environmental protection, there have been demands for reduction in generation of ozone, recycling a waste toner that has been disposed without being recycled, so as to regulate limitless dumping of industrial wastes, and a low-temperature fixing method for reducing the power consumption of the fixing process. The toner materials have also been improved so as to meet the roller transfer method that is less likely to produce generation of ozone, a waste-toner recycling system and a low-temperature fixing process. Thus, from the viewpoint of the environmental protection, it has been an important subject to develop a high performance toner that satisfies not only one of these objectives, but all these objectives simultaneously.

Moreover, in copying machines, printers and facsimiles, different kinds of toners are used for respective model types having different processing speeds. For example, in a low-speed machine, a binding resin material having high viscoelasticity and high softening point is used so as to improve anti-offset property. In a high speed machine which has difficulty in obtaining an amount of heat required for the fixing process, another binding resin having different property such as reduced softening point is used so as to increase fixing property. The processing speed relates to a copying process capability per unit of time of a machine, and represents a peripheral velocity of a photosensitive member. Depending on the peripheral velocity of a photosensitive member, the transporting velocity of sheets of transfer paper is determined. If these different toners are unified and commonly used, it is possible to increase the production efficiency, and also to reduce the costs of toner.

In a fixing process, fixing strength represented by adhesive strength of a toner to paper and anti-offset property for preventing adhesion to a heat roller form controlling factors.

A toner is melted and allowed to permeate into fibers of paper by heat or pressure from the fixing roller so that fixing strength is obtained. Conventionally, in order to improve fixing property, the binding resin is improved and a mold-releasing agent is added so that the fixing strength for sticking to paper is improved, and it is possible to prevent the offset phenomenon in which toner adheres to the fixing roller.

Japanese Patent Kokai Publication No. 148067/1984 (S59-148067) has disclosed a toner which uses as a resin an unsaturated ethylene polymer having a low molecular weight portion and a high molecular weight portion in which the peak value of the low molecular weight portion and the ratio Mw/Mn are limited and which also contains polyolefin whose softening point is specified. This application suggests that this composition ensures proper fixing property and anti-offset property. Further, Japanese Patent Kokai Publication No. 158340/1981 (S56-158340) has disclosed a toner mainly composed of a resin constituted by a specific low molecular weight polymer component and high molecular weight polymer component. The objective of this disclosure is to ensure a proper fixing property by using a low molecular weight component, while ensuring anti-offset property by using a high molecular weight component. Moreover, Japanese Patent Kokai Publication No. 223155/1983 (S58-223155) has disclosed a toner which contains a resin made from an unsaturated ethylene polymer having maximum values in respective molecular weight ranges of 1,000 to 10,000 and 200,000 to 1000,000 and a ratio of Mw/Mn of 10 to 40, and polyolefin having a specific softening point. The objective of this composition is to ensure a proper fixing property by using a low molecular weight component, while ensuring a proper anti-offset property by using a high molecular weight component and the polyolefin.

However, in the case when, in order to increase fixing strength in a high-speed apparatus, melt viscosity of a binding resin is reduced or a resin having a lowered molecular weight is used, the toner tends to have a so-called spent phenomenon in which the toner sets to the carrier, when used for a long time in the case of a two-component developing process. In the case of a mono-component developing process, a toner tends to set to a doctor blade and a developing sleeve, resulting in reduction in resistance to stress in the toner. Moreover, when this is applied to a low-speed apparatus, an offset in which a toner adheres to a heat roller, tends to occur at the time of fixing. Furthermore, blocking in which toner particles are melted to adhere to each other, tends to occur after long-term storage.

In these compositions in which a high molecular weight component and a low molecular weight component are blended, although it is possible to satisfy both the fixing strength and anti-offset property based on process speeds of narrow range, it is difficult to satisfy these based on process speeds of wide range. In order to deal with process speeds within wide range, it is possible to obtain certain effect by using a higher high molecular weight component and a lower low molecular weight component. However, in the case of a high-speed apparatus, fixing strength may be improved by increasing a low molecular weight component, but results in degradation in anti-offset property. In the case of a low-speed apparatus, anti-offset property is improved by increasing a high molecular weight component, but causes reduction in toner grindability, results in reduction of productivity.

For this reason, to a composition in which a high molecular weight component and a low molecular weight component are blended or copolymerized is added a mold-releasing agent having low melting point, such as polyethylene or polypropylene wax, in order to improve mold-releasing property from a heat roller at the time of fixing and to enhance anti-offset property.

However, these mold releasing agents hardly disperse in a binder resin, and toners having reversed polarity tends to appear due to insufficient dispersion, results in fog at a non-image portion. Moreover, an image loss, which looks as if it were rubbed by a brush, tends to occur at the rear end of a solid black image portion, resulting in degradation in image quality. Another problem is filming contamination that tends to occur in a carrier, a photosensitive member and a developing sleeve.

In a method for heating and kneading an internal additive agent such as a mold-releasing agent and dye so as to disperse it in a binder resin through a thermal melting process, devices, such as a roll mill, a kneader and an extruder, have been conventionally used in kneading process that forms an important position in the toner manufacturing process.

This extruder with twin screws is a twin-screw extruder with shallow grooves of a meshed type in which kneading screws are rotated at high speed, and as to the kneading screws, a selection is made between a same-direction rotary mode of a completely meshed type and a different direction rotary mode of a partially meshed type depending on materials. The cylinder and the kneading screws employ a divided segment system. As to a plurality of divided segments, a heating cylinder is installed in each segment so as to set a specific kneading temperature, and cooling water is allowed to flow through it. The kneading screw which passes through the cylinder, is constituted by a feeding portion that mainly has a feeding function for feeding a kneading matter forward with melting it by heating, and a kneading portion that mainly has a kneading function. The feeding portion has spiral shaped structure and has comparatively low kneading force exerted by shearing action, while the kneading portion carries out a kneading process by strong shearing force.

In order to increase dispersing property in these kneading processes, Japanese Patent Kokai Publication No. 194878/1994 (H6-194878) discloses that temperature of a cylinder in a kneader is set within 20 K based on lowest temperature of a kneaded matter extruded from the kneader. This application suggests that this arrangement allows the resin to be sufficiently melted while a kneaded matter of toner materials is transported through the cylinder during the kneading process, that no reduction in viscosity occurs due to an unmelted matter since the kneaded matter is sufficiently melted, and that the kneaded matter is extruded from an outlet with a certain degree of stress being applied thereto.

Moreover, Japanese Patent Kokai Publication No. 161153/1994 (H6-161153) has disclosed that temperature of a kneading process is set within 20 K based on melting temperature of a resin and output temperature of the resin is not more than 35 K from melt temperature of the resin. Thus, this application suggests that wax is evenly dispersed with a small particle size so that the filming and the subsequent black spots and the fog are prevented.

Furthermore, Japanese Patent Kokai Publication No. 266159/1994 (H6-266159) has disclosed that barrel temperatures at a front step and a rear step of a kneader, softening point of a toner, and output temperature are set so as to maintain a certain relationship. This application suggests that this arrangement makes it possible to further improve dispersion of an additive agent in a binder resin, to provide a uniform state, and also to improve charging property.

However, in recent demands for high picture quality and for recycling a waste toner, higher dispersing property for achieving highly uniform dispersion is required. Moreover, in color images in which high light-transmittance and anti-offset property need to be satisfied without using any oil, while a binder resin having low softening property with sharp melting characteristic should be used, dye and a charge control agent have to be finely dispersed in the binder resin; however, since a binder resin of low softening property is used, the above-mentioned twine-screw extruder fails to apply a sufficient shearing force, resulting in limited improvement of dispersing property of the dye, etc. In contrast, in the case when a binder resin having high softening property that has made to high molecular weight is used, light-transmittance of image decreases, and color reproducibility becomes poor in picture quality due to the high molecular weight component.

Moreover, in a mono-component developing system of a contact type which uses a developing roller made from a silicone resin, etc., and an elastic blade for regulating a toner layer and is provided with a supply roller for supplying toner to a developing roller, made from an urethane resin, etc., aggregation tends to occur in many places due to melt-adhesion to the blade and due to friction between a supply roller and a developing roller, resulting in poor image quality.

Moreover, as described above, from the viewpoint of recent earth environmental protection, it is preferable to recycle a waste toner that was left on a photosensitive member after a transferring process and has been collected by cleaning means, and again to use in a developing process. However, upon recycling a waste toner, the toner has been damaged due to stress, etc., applied thereto in a cleaner section, a developing section or a transporting tube through which the waste toner is returned to a developing unit.

Moreover, in the case when a waste toner that has been scraped from a photosensitive member during a cleaning process is again recycled in a developing process, if an internal additive agent and colorant are insufficiently dispersed, those particles insufficient in dispersion tend to form a waste toner, and when those particles are mixed with a new toner in a developing device, distribution of charge quantity becomes uneven, as a result, toner particles having reversed polarity increases and copied images becomes poor in quality.

Furthermore, in the case of a toner to which a low melting point component, such as wax, has been added, filming of the wax to a photosensitive member is promoted, resulting in a shorter service life. Here, in the case of a sheet of short paper, such as post cards, the paper is transported by frictional force up to a photosensitive drum, however a photosensitive member having filming is poor in transporting force, resulting in transportation failure of such a sheet of paper.

In the aforementioned transferring system using a conductive elastic roller, transfer paper is allowed to pass between an image bearing member and the conductive elastic roller, and by applying transfer bias voltage to the conductive elastic roller, toner on a surface of the image bearing member is transferred onto the transfer paper; however, the transferring system using the conductive elastic roller of this type has a problem in which the transfer paper is susceptible to stain on a rear face. The reason for this is explained as follows: In the case when a transferring process is carried out by a transferring toner on a image bearing member to transfer paper by using a transfer roller, the transfer roller is made in contact with the image bearing member with predetermined pressure when no transfer paper is applied, and when there is much fog during a developing process, the fog contaminates the transfer roller, and the transfer roller contaminated by the toner comes into contact with the rear face of transfer paper sent thereto. In toner particles in which the internal additive agent is insufficiently dispersed, there is reduction in fluidity, and toner aggregates partially; thus, a void image tends to appear during a transferring process. These phenomena become more frequently when waste toner is recycled.

An intermediate transfer system does not need any complex optical system, and is applied to sheets of paper that is not so flexible, such as post cards and card board, and it also provides flexible structure when the intermediate transfer belt is used; therefore, in comparison with a transfer drum system and a continuous transfer system, the system is more advantageous in that an apparatus may be miniaturized.

It is ideal that all the toner be transferred during a transferring process; however, toner partially remains after a transferring process. That is, so-called transferring efficiency is not 100%, and in general, it is approximately of 75 to 90%. A residual toner after a transferring process is collected by a cleaning blade, etc., in a photosensitive member cleaning process to form a waste toner.

However, in structure using an intermediate transfer member, a toner is subjected to at least two transferring processes, that is, the transferring processes from a photosensitive member to the intermediate transfer member and that from the intermediate transfer member to a sheet of image receiving paper; therefore, even when the transferring efficiency is, for example, 85% in a normal copying machine having one transferring process, the transferring efficiency is reduced to 72% after two times of the transferring processes. Moreover, in the case of the transferring efficiency of 75% in one transferring process, this is reduced to 56%, in which approximately half a toner becomes a waste toner; this results in high costs of a toner, and larger capacity of a waste toner box impede to miniaturize the apparatus. It is considered that the reduction in transferring efficiency is caused by fogging resulting from reversed polarity and void image during a transferring process, due to insufficient dispersion.

Moreover, in the case of a color developing process, a toner layer becomes thicker because toner images of four colors are superimposed on an intermediate transfer member; thus, pressure variation tends to occur between thicker toner portions and thinner toner portions or no toner portions. For this reason, so-called a "void" phenomenon, in which one portion of an image is not transferred due to aggregation effect of toner to form a hole, tends to occur. Moreover, in the case when a material having high toner mold-releasing effect is used as an intermediate transfer member so as to ensure a cleaning process in the event of an image-receiving sheet jam, the void phenomenon occurs more frequently, resulting in serious degradation in image quality. Furthermore, characters, lines, etc., are subjected to the edge developing process to have more toner, with the result that aggregation between toner particles occurs due to pressure application, making the void phenomenon more conspicuous. In particular, this becomes more conspicuous in high-temperature and high-humidity environments.

Moreover, in an electrophotographic apparatus which will be described later, a group of image-forming units in which a plurality of movable image-forming units, which form toner images of different colors, are arranged in ring shape are provided, and the entire image-forming units are allowed to rotate. Here, in the respective image-forming units and intermediate transferring units, those units are exchangeable so that maintenance processes are easily carried out by exchanging the units when an occasion for exchange is due after service life; thus, it is possible to provide an easy maintenance process in the same manner as a monochrome printing process even in the case of an electrophotographic color printer. However, since the image-forming unit itself is revolved, waste toner after having been cleaned temporarily adheres to a photosensitive member repeatedly, and since it repeats adhesion and separation to and from a developing roller, a photosensitive member is susceptible to damage and filming, and in the case of poor rising property of charge during an initial stage of the developing process, background fogging tends to occur.

Moreover, in a fixing process of the four-color toner image, it is necessary to mix color toners. In this case, when the toners are insufficiently melted, light scattering occurs on a surface of the toner image or inside thereof, with the result that color tone of inherent toner pigment is impaired and light is not made incident on a lower layer at overlapped portions, causing degradation in color reproducibility. Therefore, a toner needs to have complete melting property and also to have light-transmittance so as not to impair color tone, as essential requirements. In particular, along with increase of opportunities in which presentations are made by using color images through OHP, transparency of color images becomes more important.

However, in the above-mentioned resin composition, when an attempt is made to improve melting property, anti-offset property becomes poor, causing toner to adhere to a surface of a fixing roller without being all fixed on a sheet of paper, and resulting in offset; therefore, a great amount of oil, etc., needs to be applied onto the fixing roller, resulting in complex handling processes and device structures. Here, another method in which anti-offset property is improved by applying a mold-releasing agent such as polypropylene and polyethylene may be proposed; however, a great amount of addition thereof is required, causing reduction in dispersing property in the above-mentioned binding resin having sharp melting property and resulting in unclearness in color and subsequent degradation in color reproducibility.

Here, in Japanese Patent Kokai Publication No. 119509/1993 (H5-119509) and Japanese Patent Kokai Publication No. 220808/1996 (H8-220808) have disclosed that a great amount of addition of carnauba wax makes it possible to reduce color unclearness and to provide a superior fixing property and anti-offset property.

However, as described above, simple addition of carnauba wax still tends to cause background fogging, filming to a photosensitive member, a developing roller and an intermediate transfer member, an insufficient transferring process, and these phenomena becomes more conspicuous in a recycling process of a waste toner.

Here, toners need to generally satisfy the above-mentioned subjects.

SUMMARY OF THE INVENTION

The present invention has been devised to solve the above-mentioned problems, and its objective is to provide a binder resin, a toner and an electrophotographic apparatus, which, in an electrophotographic method including processes for transferring and stacking a plurality of toner images having different colors on an image-receiving sheet and for fixing them so as to form a color image, even in the case of carrying out an oil-less fixing process and allowing the process speed to vary within wide range, makes it possible to achieve both superior fixing property and anti-offset property, and consequently to form a color image with high color reproducibility and high quality.

The present invention, which relates to a binder resin used for preparing a toner, provides a binder resin, which is used for preparing a toner for use in an electrophotographic method comprising: a molecular weight maximum peak in a range of molecular weights from $2\times10^3$ to $3\times10^4$ in molecular weight distribution of GPC chromatogram, and a component having a molecular weight of not less than $3\times10^4$, as a component located in high molecular weight range, in an amount of not less than 5% based on the entire binder resin.

The present invention provides a toner comprising a molecular weight maximum peak in a range of molecular weights from $2\times10^3$ to $3\times10^4$ in molecular weight distribution of GPC chromatogram, and a molecular weight maximum peak or shoulder in a range from $3\times10^4$ to $1\times10^6$, wherein said molecular weight maximum peak or shoulder located on a range of molecular weights from $3\times10^4$ to $1\times10^6$ is obtained by kneading a toner composition containing said binder resin so that a high molecular weight component of the binder is converted into a low molecular weight component by energy exerted at the time of kneading.

The present invention, which relates to a method for manufacturing a toner, provides a method including the steps of: preparing a toner composition containing said binder resin; and kneading the toner composition containing said binder resin so that a high molecular weight component of the binder is converted into a low molecular weight component by energy exerted at the time of kneading.

Moreover, the present invention provides an electrophotographic apparatus which carries out processes for transferring and stacking a plurality of toner images having different colors on an image-receiving sheet and for fixing them so as to form a color image, wherein the toner employed is the above described composition.

In accordance with the present invention which has an arrangement for using the binder resin having certain molecular weight distribution, the toner molecular weight characteristic after having been subjected to a shearing and kneading process is set at an appropriate range and a preparation process is carried out under conditions in which the kneading process method is conformed to the thermal characteristic of the binder resin; thus, even in the case of carrying out an oil-less fixing process and allowing the process speed to vary within wide range, it becomes possible to achieve both of high light-transmittance and anti-offset property.

A toner of the present invention makes it possible to improve dispersing property of an internal additive agent such as colorant and consequently to provide uniform charging distribution.

In a toner and an electrophotographic apparatus of the present invention, even when applied to a mono-component developing method of contact type, they are free from thermal adhesion and aggregation of toner, and even when a highly functional binder resin is used, they improve dispersing property of an additive agent without causing degradation in resin characteristics, thereby maintaining a stable developing property. Moreover, even in the case of an electrophotographic method using transfer process with a conductive elastic roller and an intermediate transfer member, it is possible to prevent void images and scattering at the time of transferring, and consequently to provide high transferring efficiency, and it is also possible to prevent filming on a photosensitive member and an intermediate transfer member, even after a long service period in high humidity. Furthermore, even in the case when a waste toner is recycled, it is possible to prevent reduction of a developing agent in charge quantity and fluidity, to prevent generation of aggregated matter, to provide a long service life and to achieve a recycling developing process; thus, it becomes possible to prevent the earth environmental pollution and to achieve the reuse of resources.

Figure 1:
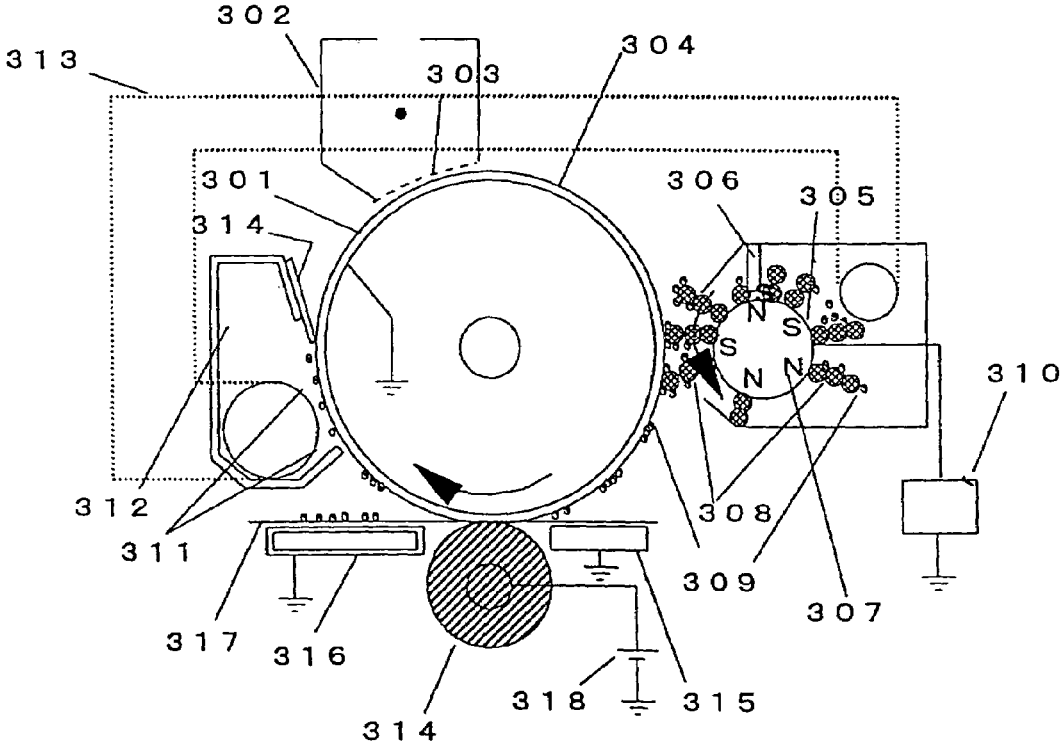
FIG. 1 is a cross-sectional view that shows structure of an electrophotographic apparatus used in an example of the present invention.

In the Figures, reference numeral 2 is an intermediate transfer belt unit, reference numeral 3 is an intermediate transfer belt, reference numeral 4 is a first transfer roller, reference numeral 5 is a second transfer roller, reference numeral 6 is a tension roller, reference numeral 11 is a photosensitive member, reference numeral 12 is a third transfer roller, reference numerals 17Bk, 17C, 17M and 17Y are image-forming units, reference numeral 18 is a group of image-forming units, reference number 21 is an image-forming position, reference numeral 22 is a laser signal light, reference numeral 35 is a laser beam scanner section, reference numeral 38 is a mirror, reference numeral 308 is a carrier, reference numeral 305 is a developing sleeve, reference numeral 306 is a doctor blade, reference numeral 307 is a magnet roll, reference numeral 314 is a cleaning blade, reference numeral 312 is a cleaning box, reference numeral 311 is waste toner, reference number 313 is a waste toner transporting pipe, reference numeral 602 is a roll (RL1), reference numeral 603 is a roll (RL2), reference numeral 604 is a toner melted film wound around the roll (RL1), reference numeral 605 is a flowing inlet of a heating medium, and reference numeral 606 is a flowing outlet of the heating medium.

DETAILED DESCRIPTION OF THE INVENTION

In the present invention, a binder resin, colorant, a fixing adjuvant and an internal additive agent such as a charge control agent that is optionally added, which are constituent materials of a toner, are evenly pre-mixed in a dry state, and this is melt-kneaded by applying heat so as to disperse the internal additive agent such as colorant in a binder resin; then, after having been cooled, this is ground and classified so as to have a predetermined particle size distribution to form a toner base material that is colored fine particles, and to this is externally added an external additive agent to provide a toner.

Conventionally, as to a toner used in an electrophotographic method containing processes for transferring and stacking a plurality of toner images having different colors on an image-receiving sheet and for fixing them so as to form a color image, a binder resin which has sharp melting property having narrow molecular weight distribution with less high molecular weight component is used so as to ensure proper light-transmittance.

In this structure, however, although light-transmittance of a color image is maintained, an offset tends to occur. For this reason, it is necessary to apply oil onto a surface of a fixing roller so as to easily separate toner from the fixing roller. Moreover, a mold-releasing agent such as polypropylene and polyethylene is added to toner so as to improve mold-releasing property. However, even when a mold-releasing agent is simply added, it is very difficult to provide proper dispersion in a binder resin having sharp melting property, in particular, in a polyester resin; and the resulting problems are: fogging, filming to a photosensitive member and a developing roller, degradation in rising property in charge and reduction in image density caused by reduced quantity of charge when repeatedly used.

There have been demands for a toner which can achieve high digital image quality, high saturation color reproducibility and both of high light-transmittance and anti-offset property without applying any oil to a fixing roller, and which also provide a waste toner recycling process, high transferring property in a transfer process using an intermediate transfer member and long stable uses of a developing roller and a supply roller in a mono-component developing process of contact type.

In the present invention, to a specific binder resin containing a high molecular weight component at not less than a specific amount are added colorant and an internal additive agent such as a fixing adjuvant, and this is kneaded under strong shearing force so that a high molecular weight component of the binder resin is converted into a low molecular weight component; thus, the toner after the kneading process provides a specific molecular weight component, thereby making it possible to exert superior characteristics.

It is considered that the function in which the high molecular weight component of the binder resin is converted into the low molecular weight component is caused by cuts that occur in molecular chains in a high molecular weight component of the binder resin at the time of kneading. The cuts are considered to occur in the bonded portions of ester; however, the specific reasons have not been confirmed yet. It is assumed that the function in which the high molecular weight component of the binder resin is converted into a low molecular weight component, is caused by the molecular cuts.

Therefore, it is possible to achieve uniform dispersing property of an internal additive agent at the time of kneading, and consequently to improve light-transmittance in color images. In particular, it is possible to improve smoothness of a surface of a fixed image and consequently to provide a color image with high image quality. Moreover, it is possible to prevent transfer paper from winding around a fixing roller at the time of a fixing process, to achieve both of high light-transmittance and anti-offset property, and also to prevent void images at the time of a transferring process.

It is possible to prevent an offset without need of applying any oil to a fixing roller, and also to make dispersing property uniform of internal additive agent in a resin, and consequently to prevent filming to a photosensitive member. Moreover, even after a continuous long time use, it is possible to prevent filming to an intermediate transfer member, a developing roller and a regulating blade.

Binder Resin

The binder resin is composed of a resin which has a molecular weight maximum peak in a range of molecular weights from $2\times10^3$ to $3\times10^4$ in molecular weight distribution of GPC chromatogram, and contains a component having a molecular weight of not less than $3\times10^4$ as a component located in high molecular weight range, in an amount of not less than 5% based on the entire binder resin.

With this structure, based upon kneading conditions described below, a high molecular weight component is converted into a low molecular weight component by shearing force at the time of kneading so that the toner molecular weight after the kneading process is allowed to have an optimal distribution; thus, it becomes possible to convert a high molecular weight component interrupting high light-transmittance, into a low molecular weight component, thereby ensuring high light-transmittance of a color image to be formed and preventing offset by the low molecular weight component derived from the high molecular weight component.

Moreover, it is possible to improve dispersing property of an internal additive agent such as colorant, a charge control agent or a fixing adjuvant.

As to the component located at high molecular weight range, if a component having a molecular weight of not less than $3\times10^4$ is not contained in not less than 5% based on the entire binder resin, an appropriate kneading process is not carried out, a fixing adjuvant becomes poor in dispersing property, stability in preservation becomes poor and anti-offset effect is reduced.

When the molecular weight maximum peak of the binder resin is smaller than $2\times10^3$, the resin becomes too soft, resulting in reduction in durability, and shearing force is reduced at the time of kneading, as a result dispersion of fixing adjuvant becomes poor. If the molecular weight maximum peak is greater than $3\times10^4$, light-transmittance of a color image to be formed is lowered.

Moreover, a molecular weight maximum peak of the binder resin is preferably set in a range from $3\times10^3$ to $2\times10^4$ in molecular weight distribution of GPC chromatogram. More preferably, this is set in a range from $4\times10^3$ to $2\times10^4$.

Furthermore, as to the component located in the high molecular weight range, it is preferable to contain a component having a molecular weight of not less than $1\times10^5$ in an amount of not less than 3% based on the entire binder resin. Moreover, as to the component located in the high molecular weight range, it is preferable to contain a component having a molecular weight of not less than $3\times10^5$ in an amount of not less than 0.5% based on the entire binder resin.

More preferably, as to the component located in the high molecular weight range, it is preferable to contain a component having a molecular weight of $8\times10^4$ to $1\times10^7$ in amount of not less than 3% based on the entire binder resin, without substantially containing a component having a molecular weight of not less than $1\times10^7$.

As to the component located in the high molecular weight range, it is more preferable to contain a component having a molecular weight of $3\times10^5$ to $9\times10^6$ at not less than 1% based on the entire binder resin, without containing a component having a molecular weight of not less than $9\times10^6$.

As to the component located in the high molecular weight range, it is most preferable to contain a component having a molecular weight of $7\times10^5$ to $6\times10^6$ at not less than 1% based on the entire binder resin, without substantially containing a component having a molecular weight of not less than $6\times10^6$.

If the high molecular weight component is too much, the molecular weight is too great, a macromolecule component remains at the time of kneading, and a color image becomes poor in light-transmittance. Further, it also causes reduction in the production efficiency of the resin itself. Moreover, it causes unintended scratches on a developing roller and a supply roller, resulting in longitudinal lines in a resulting image.

In order to achieve high digital image quality, high saturation color reproducibility and long stable uses of a developing roller and a supply roller in a mono-component developing process of contact type, to provide both of high light-transmittance and anti-offset property without applying any anti-offset-use oil to a fixing roller, and also to achieve a waste toner recycling process and high transferring property in a transfer process using a intermediate transfer member, it is preferable to employ a binder resin having a ultra-high molecular weight component.

As to such a binder resin, it is preferable to use a polyester resin which has a weight average molecular weight Mwf of 10,000 to 400,000, a Wmf of 3 to 100 wherein the Wmf represents a ratio Mwf/Mnf of the weight average molecular weight Mwf and the number average molecular weight Mnf, a Wzf of 10 to 2,000 wherein the Wzf represents a ratio Mzf/Mnf of the Z average molecular weight Mzf and the number average molecular weight Mnf, a melting point (hereinafter, also referred to as a softening point) of 80 to 150° C. measured by the ½ method using a Koka-type flow tester, a flowing start temperature of 80 to 120° C., and a glass transition point of resin of 45 to 65° C.

The Z average molecular weight most desirably expresses the size and amount of the molecular weight at a tailing portion on a high molecular weight side, and gives great influences to dispersing property, fixing property and anti-offset property of the internal additive agent at the time of kneading. As the value of Mzf becomes greater, resin strength increases and viscosity increases at the time of a melt-kneading process under heat, thereby dispersing property is greatly improved. Thus, it becomes possible to suppress fogging and toner scattering, and also to reduce variations due to environments under high-temperature, low-humidity and high humidity. The increased value of Mzf/Mnf represents a widened range up to an ultra-high molecular weight range.

As to a preferable polyester resin, Mwf is from 11,000 to 400,000, more preferably, 15,000 to 400,000, and more preferably Mwf is from 10,000 to 200,000, Wmf is from 3 to 30, Wzf is from 10 to 500, the softening point is from 90 to 150° C., the flowing start temperature is from 85 to 115° C. and the glass transition point is from 52 to 59° C.

As to the polyester resin, most preferably Mwf is from 10,000 to 100,000, Wmf is from 3 to 10, Wzf is from 10 to 100, the softening point is from 90 to 140° C., the flowing start temperature is from 85 to 110° C. and the glass transition point is from 53 to 59° C.

In the case when the binder resin has Mwf smaller than 10,000, Wmf smaller than 3, Wzf smaller than 10, a softening point smaller than 80° C., a flowing start temperature smaller than 80° C., or a glass transition point smaller than 45° C., dispersing property of an internal additive agent such as colorant or a fixing adjuvant is lowered at the time of kneading, with the result that fogging increases, and durability at the time of waste-toner recycling becomes poor. Moreover, kneading stress at the time of kneading becomes insufficient, failing to properly maintain the molecular weight at an appropriate value. Furthermore, anti-offset property and high-temperature storage stability deteriorate, and filming occurs onto a cleaning blade and a photosensitive member in high-temperature, high-humidity environments, in particular, at the time of waste-toner recycling.

In the case when the binder resin has Mwf greater than 400,000, Wmf greater than 100, Wzf greater than 2,000, a softening point greater than 150° C., a flowing start time greater than 120° C., or a glass transition point greater than 65° C., an excessive load is imposed on the machine during the kneading processes. This causes a serious decrease in productivity, reduction in light-transmittance in color images and reduction in fixing strength.

The binder resin is kneaded by using strong compressive shearing force in a melt-kneading process as described above, so that it becomes possible to provide characteristics that have not been achieved conventionally. Thus, it is possible to achieve both of high light-transmittance and anti-offset property in color toners even by a fixing process without using any oil. In other words, an ultra-high molecular weight component, which has not been used conventionally, is added to the binder resin, and is treated by stronger compressive shearing force than the conventional system, so that the ultra-high molecular weight component is converted into a low molecular weight component, thereby achieving high light-transmittance. Moreover, existence of the low molecular weight component derived from the ultra-high molecular weight component, and the evenly dispersed fixing adjuvant, proper anti-offset property may be satisfied. Thus, generation of fogging is reduced at the time of developing, thereby making it possible to provide high image quality.

Moreover, since the ultra-high molecular weight component is contained, high shearing force is exerted at the time of kneading, and colorant is dispersed more evenly; thus, it is possible to improve light-transmittance, and to provide high image quality and high saturation color reproducibility.

The binder resin preferably used in the present invention includes a polyester resin, which is obtained by polycondensation between an alcohol component and a carboxylic acid component such as carboxylic acid, carboxylic acid ester and carboxylic anhydride.

As to the divalent carboxylic acids or low alkyl esters, examples thereof include: aliphatic dibasic acid such as malonic acid, succinic acid, glutaric acid, adipic acid and hexahydrophthalic anhydride, aliphatic unsaturated dibasic acid such as maleic acid, maleic anhydride, fumaric acid, itaconic acid and citraconic acid, aromatic dibasic acid such as phthalic anhydride, phthalic acid, terephthalic acid and isophthalic acid and methyl esters and ethyl esters thereof. Among these, aromatic dibasic acid, such as phthalic acid, terephthalic acid and isophthalic acid and low alkyl esters of these are preferably used.

As to not less than trivalent carboxylic acid components, example thereof include: 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, pyromellitic acid, a trimmer of embole acid and anhydrides and low alkyl (carbon atoms of 1 to 12) esters thereof.

As to the divalent alcohol components include: diols such as ethylene glycol, 1,2-propylene glycol, 1,3-propylene glycol, 1,3-butylene glycol, 1,4-butylene glycol, 1,6-hexanediol, neopentyl glycol, diethylene glycol, dipropylene glycol, ethylene oxide adducts of bisphenol A, propylene oxide adducts of bisphenol A, and triols such as glycerin, trimethylolpropane and trimethylolethane, and mixtures thereof. Among these, neopentyl glycol, trimethylolpropane, ethylene oxide adducts of bisphenol A, and propylene oxide adducts of bisphenol A are preferably used.

As to the trivalent alcohol components include: sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylol ethane, trimethylol propane, and 1,3,5-trihydroxymethyl benzene.

Moreover, a polyester resin is allowed to react with an isocyanate compound so as to contain a urethane-modified polyester; thus, it is possible to provide higher characteristics. The urethane-modified polyester resin is a material with high viscoelasticity that provides anti-offset property efficiently. However, in the case when this is used as a color toner, the high viscoelasticity causes degradation in smoothness of a fixed image, making it difficult to obtain high light-transmittance. If, in order to obtain proper light-transmittance, the molar equivalent of the isocyanate compound is reduced, anti-offset property decreases. For this reason, by using this in combination with the kneading process of the present construction, it becomes possible to achieve both high light-transmittance and anti-offset property.

As to the isocyanate compound to be used, examples thereof include: hexamethylenediisocyanate, isophoronediisocyanate, tolylenediisocyanate, diphenylmethanediisocyanate, xylylenediisocyanate and tetramethylxylylenediisocyanate.

The urethane-modified polyester resin is obtained as follows: polyisocyanate is added to a polyester resin alone or to a solution containing the polyester resin, in one bach or in a divided manner at a temperature of 50 to 150° C., and this is allowed to react at the same temperature for several hours.

The amount of the isocyanate compound to be used, is preferably from 0.3 to 0.99 mol equivalent per one mol equivalent of the hydroxyl group of the polyester resin before urethane modification. More preferably, this is from 0.5 to 0.95 mol equivalent. If the amount is less than 0.3, anti-offset property becomes poor, and when the amount is more than 0.99, viscosity increases greatly, sometimes resulting in difficulty in stirring.

The polymerization is carried out by using known polycondensation, solution polycondensation, etc. Thus, it is possible to obtain a superior toner without impairing vinylchloride-mat resistance and the color of colorant in a color toner.

As to an addition ratio of the polyvalent carboxylic acid and the polyhydric alcohol, it is normally from 0.8 to 1.4 in a ratio (OH/COOH) of the hydroxyl group number based on the carboxyl group number.

Moreover, the acid value of the polyester resin is preferably from 1 to 100. More preferably, this is from 1 to 30. The value smaller than 1 causes reduction in dispersing property of an internal additive agent such as wax, a charge control agent and a pigment. The value exceeding 100 causes reduction in humidity-resisting property.

The molecular weight of the resin is given as a value measured by the gel permeation chromatography (GPC) method using several kinds of single-dispersion polystyrene as standard samples.

This device is a HPLC8120 series made by Tosoh Corporation, the column is a TSK gel super HM-H H4000/H3000/H2000 (7.8 in diameter, 150 mm×3), an eluant is THF (tetrahydrofran), the flowing rate is 0.6 ml/min, the sample concentration is 0.1%, the amount of injection is 20 μL, the detector is RI, and the measuring temperature is 40° C. In a process prior to the measurements, a sample is dissolved in THF, and this is then filtrated by a filter of 0.45 μm so that additive agents, such as silica, are removed therefrom; then the resulting resin component is measured. The measuring conditions are set so that molecular weight distribution of the subject sample is included within a range in which, the logarithm and the count value of the molecular weight forms a straight line, in calibration curves obtained by the standard samples of the several kinds of single dispersion polystyrenes.

Moreover, the softening point of the binder resin is measured by a flow tester (CFT 500) made by Shimadzu Corporation as follows: the sample of 1 $cm^3$ is subjected to a load of $1.96\times10^6$ $N/m^2$ applied by a plunger while being heated at a temperature-rising rate of 6° C./min, and extruded through a die that is 1 mm in diameter and 1 mm in length; thus, based upon the relationship between piston stroke of the plunger and temperature in association with the rising temperature characteristic, the flowing start temperature (Tfb) at which the piston stroke starts to rise is determined, and a ½ of a difference between the lowest value of the curve and the flowing end point is found; thus, the temperature at a position obtained by adding the lowest value of the curve to the resulting value is defined as a melting temperature (softening point Tm) in the ½ method.

Moreover, the glass transition point of the resin is measured by a differential scanning calorimeter in which: the resin is heated to 100° C. at which this is left for three minutes, and this is then cooled to room temperature at a temperature-lowering rate of 10 K/min; then, the resulting sample is heated at a temperature-raising rate of 10 K/min so as to measure the heating history; thus, a crossing point between the extended line of the base line not more than the glass transition point and a tangential line showing the greatest slant in a range from the rising portion of the peak to the apex of the peak is found, and the temperature at this point is defined as the glass transition point.

The melting point of the heat absorbing peak by DSC is measured by using a differential calorie analyzer DSC-50 made by Shimadzu Corporation. The sample is heated to 200° C. at 5 K/min, and after having been maintained for 5 minutes, this is then rapidly cooled to 10° C., and after having been maintained for 15 minutes, again heated at 5 K/min; thus, the melting point is found from heat absorbing (melting) peaks. The amount of the sample loaded to the cell is set to 10 mg±2 mg.

Fixing Adjuvant

The fixing adjuvant makes it possible to strengthen adhesiveness of a color image to an image-receiving sheet, to reduce frictional resistance on an image surface on an image-receiving sheet, and also to improve fixing property by reducing separation of a toner from an image-receiving sheet due to friction. Moreover, this exerts mold-releasing function to a thermal fixing roller, making it possible to effectively improve anti-offset property.

Here, when a toner composition is loaded between two rolls so as to be kneaded, constituent components thereof, in particular, a charge control agent and pigments, tend to be scattered and suspended. For this reason, the composition varies, and the apparatus and the peripheral area are contaminated. However, by blending a fixing adjuvant with a toner composition, it is possible to reduce scattering and suspension of the components greatly. It is considered that the fixing adjuvant encloses the charge control agent and the dye electrically or physically to prevent them from scattering.

As to preferable materials as the fixing adjuvant, examples thereof include: paraffin wax, microcrystalline wax, montan wax and the derivatives thereof, hydrocarbon-based waxes obtained through the Fischer-Tropsch method and the derivatives thereof, polyolefin waxes such as polyethylene and polypropylene, carnauba wax, candelilla wax, lanolin, haze wax, bees wax, ozokerite, ceresin, rice wax, plant-based waxes such as derivatives of meadow-foam oil or jojoba derivatives, higher fatty acids such as aliphatic amide, fatty acid esters, stearic acid, palmitic acid, lauric acid, aluminum stearate, barium stearate, zinc stearate, zinc palmitate acid, or metal compounds thereof, derivatives of esters, and polymers containing fluorine. These may be used alone, or two or more kinds of these may be used in combination.

Among these, the hydrocarbon-based waxes obtained through the Fischer-Tropsch method, polymers containing fluorine, aliphatic amides, fatty acid esters, derivatives of meadow-foam oil or jojoba derivatives are preferably used.

As to the fixing adjuvant of aliphatic amides, examples thereof include: saturated or monovalent unsaturated aliphatic amides having carbon atoms of 16 to 24, such as palmitic acid amide, palmitoleic acid amide, stearic acid amide, oleic acid amide, arachidic acid amide, eicosanic acid amide, behenic acid amide, erucic acid amide, and lignoceric acid amide.

The following fixing assistant agents of alkylene bis fatty acid amides of saturated or monovalent or divalent unsaturated fatty acids are preferably used: methylene-bis-stearic acid amide, ethylene-bis-stearic acid amide, propylene-bis-stearic acid amide, butylene-bis-stearic acid amide, methylene-bis-oleic acid amide, ethylene-bis-oleic acid amid, propylene-bis-oleic acid amide, butylene-bis-oleic acid amide, methylene-bis-lauric acid amide, ethylene-bis-lauric acid amide, propylene-bis-lauric acid amide, butylene-bis-lauric acid amide, methylene-bis-myristic acid amide, ethylene-bis-myristic acid amide, propylene-bis-myristic acid amide, butylene-bis-myristic acid amide, methylene-bis-palmitic acid amide, ethylene-bis-palmitic acid amide, propylene-bis-palmitic acid amide, butylene-bis-palmitic acid amide, methylene-bis-palmitoleic acid amide, ethylene-bis-palmitoleic acid amide, propylene-bis-palmitoleic acid amide, butylene-bis-palmitoleic acid amide, methylene-bis-arachidic acid amide, ethylene-bis-arachidic acid amide, propylene-bis-arachidic acid amide, butylene-bis-arachidic acid amide, methylene-bis-eicosanic acid amide, ethylene-bis-eicosanic acid amide, propylene-bis-eicosanic acid amide, butylene-bis-eicosanic acid amide, methylene-bis-behenic acid amide, ethylene-bis-behenic acid amide, propylene-bis-behenic acid amide, butylene-bis-behenic acid amide, methylene-bis-erucic acid amide, ethylene-bis-erucic acid amide, propylene-bis-erucic acid amide and butylene-bis-erucic acid amide.

Moreover, the fixing adjuvant may be formed by blending the aliphatic amide and the alkylene bis fatty acid amide at a ratio of 3:7 to 7:3; thus, it becomes possible to improve surface smoothness of a fixed image.

Furthermore, this also makes it possible to more effectively achieve both high light-transmittance of a color image and anti-offset property. In this case, it is necessary to set the melting point of the alkylene bis fatty acid amide higher than that of the aliphatic amide. If the melting point of the alkylene bis fatty acid amide is lower, not only anti-offset property is lowered, but also the resin itself becomes less softened, resulting in excessive crush at the time of a grinding process, and the subsequent increase of fine powder and degradation in productivity.

In particularly, the aliphatic amid is a low-melting point material; therefore, as the compatibility to the resin progresses, the resin itself is plasticized, with the result that anti-offset property and storage stability are lowered, and void images often occur during a transferring process after a long time use. For this reason, the alkylene bis fatty acid amide having higher melting point than the aliphatic amide is used in combination so that the plasticity of the resin itself is reduced, the void images are prevented even after a long time use without losing the effects of the aliphatic amide for high light-transmittance and surface smoothness, and anti-offset property and storage stability are maintained.

As to aliphatic esters, they are synthesized by an esterification reaction between linear aliphatic acid and linear alcohol. Examples thereof include: dodecyl palmitate, tetradecyl palmitate, pentadecyl palmitate, dodecyl stearate, tetradecyl stearate, hexadecyl stearate, octadecyl stearate, dodecyl behenate, butyl behenate, and hexyl behenate.

The melting point is preferably from 70 to 145° C. More preferably, it is from 70 to 110° C., most preferably, 75 to 95° C. The addition amount is preferably from 0.5 to 10 parts by weight based on 100 parts by weight of the binder resin. The melting point less than 70° C. causes reduction of dispersing property in the resin, with the result that filming tends to occur onto a photosensitive member. The melting point exceeding 145° C. causes reduction in smoothness on a surface of a fixed image, resulting in degradation in light-transmittance. Further, this also causes degradation of dispersing property in a resin, resulting in an increase in fogging. Moreover, the addition amount greater than 10 parts by weight causes degradation in storage stability. The addition amount less than 0.5 parts by weight fails to exert its functions. Thus, it becomes possible to improve light-transmittance in a color image, and also to improve anti-offset property of rollers.

Moreover, as to the meadow-foam oil derivatives or jojoba derivatives to be used as a fixing adjuvant, the meadow-foam oil (original name: Limnanthes alba, which is triglyceride obtained by picking up and squeezing seeds of meadow foam that is a plant belonging to Limnanthes family). The oil contains much eicosanic acid, and includes fatty acids with long chains of not less than C20, and the fatty acids of 22:1 comprises erucic acid and its isomers. Most of unsaturated fatty acids are monoenoic acid and the un-saturation degree is low and acid stability is good.

The jojoba oil is an ester-type wax made from unsaturated higher fatty acids obtained from seeds of jojoba and alcohol. The most of them have carbon atoms of C40 and C42. Crude wax, obtained from a squeezing process, is liquid, and this is refined to a non-colored transparent substance.

As to preferable meadow-foam derivatives, examples thereof include: meadow-foam oil fatty acids, metal salts of meadow-foam oil fatty acids, meadow-foam oil fatty acid esters, hydrogenated meadow-foam oil, meadow-foam oil amides, homo-meadow-foam oil amides, meadow-foam oil trimesters, maleic acid derivatives of epoxidated meadow-foam oil, isocyanate polymers of meadow-foam oil fatty acid polyhydric alcohol esters, and halogenated modified meadow-foam oil. These may be used alone, or two kinds of more of these may be used in combination.

The meadow-foam oil fatty acids, obtained by saponifying and decomposing the meadow-foam oil, are composed of fatty acids having carbon atoms of 18 to 22. As to its metal salts, metals, such as sodium, potassium, calcium, magnesium, barium, zinc, lead, manganese, iron, nickel, cobalt and aluminum, may be used.

As to the meadow-foam oil fatty acid esters, examples thereof include: esters of methyl, ethyl, butyl, glycerin, pentaerythritol, polypropylene glycol and trimethylol propane, and in particular, meadow-foam oil fatty acid pentaerythritol monoester, meadow-foam oil fatty acid pentaerythritol triester and meadow-foam oil fatty acid trimethylol propane ester are preferably used.

Moreover, isocyanate polymers of meadow-foam oil fatty acid polyhydric alcohol esters may be preferably used; these are obtained by allowing an esterification reaction product between a meadow-foam oil fatty acid and a polyhydric alcohol such as glycerin, pentaerythritol or trimethylolpropane to be crosslinked by isocyanate, such as tolylenediisocyanate (TDI) or diphenylmethane-4,4'-diisocyanate (MDI).

The hydrogenated meadow-foam oil is formed by hydrogenating meadow-foam oil to convert its unsaturated bonds into saturated bonds. Those subjected to an extreme hydrogenating process are preferably used.

The meadow-foam oil amide is formed as follows: after meadow-foam oil has been subjected to hydrolysis, this is esterified to form a fatty acid methyl ester, and this is allowed to react with a mixture of conc. aqueous ammonia and ammonium chloride to obtain the target product. Moreover, this is further hydrogenated so as to adjust the melting point thereof. Here, prior to hydrolysis, it may be hydrogenated. Thus, the melting point is from 75 to 120° C. The homomeadow-foam oil amide is formed through a processes in which meadow-foam oil is subjected to hydrolysis, and then reduced to form alcohol, and this is converted to nitrile.

As to preferable jojoba oil derivatives, examples thereof include: jojoba oil fatty acids, metal salts of jojoba oil fatty acids, jojoba oil fatty acid esters, hydrogenated jojoba oil, jojoba oil amides, homo-jojoba oil amides, jojoba oil triesters, maleic acid derivatives of epoxidated jojoba oil, isocyanate polymers of jojoba oil fatty acid polyhydric alcohol esters, and halogenated modified jojoba oil. These may be used alone, or two kinds of more of these may be used in combination.

The jojoba oil fatty acids, obtained by saponifying and decomposing the jojoba oil, are composed of fatty acids having carbon atoms of 18 to 22. As to its metal salts, metals, such as sodium, potassium, calcium, magnesium, barium, zinc, lead, manganese, iron, nickel, cobalt and aluminum, may be used.

As to the jojoba oil fatty acid esters, examples thereof include: esters of methyl, ethyl, butyl, glycerin, pentaerythritol, polypropylene glycol and trimethylol propane, and in particular, jojoba oil fatty acid pentaerythritol monoester, jojoba oil fatty acid pentaerythritol triester and jojoba oil fatty acid trimethylol propane ester are preferably used.

Moreover, isocyanate polymers of jojoba oil fatty acid polyhydric alcohol esters may be preferably used; these are obtained by allowing an esterification reaction product between a jojoba oil fatty acid and a polyhydric alcohol such as glycerin, pentaerythritol or trimethylolpropane to be crosslinked by isocyanate, such as tolylenediisocyanate (TDI) or diphenylmethane-4,4'-diisocyanate (MDI).

The hydrogenated jojoba oil is formed by hydrogenating jojoba oil to convert its unsaturated bonds into saturated bonds. Those subjected to an extreme hydrogenating process are preferably used.

The jojoba oil amide is formed as follows: after jojoba oil has been subjected to hydrolysis, this is esterified to form a fatty acid methyl ester, and this is allowed to react with a mixture of conc. aqueous ammonia and ammonium chloride to obtain the target product. Moreover, this is further hydrogenated so as to adjust the melting point thereof. Here, prior to hydrolysis, it may be hydrogenated. Thus, the melting point is from 75 to 120° C. The homojojoba oil amide is formed through processes in which jojoba oil is subjected to hydrolysis, and then reduced to form alcohol, and this is converted to nitrile.

Moreover, the jojoba oil triesters are obtained by epoxidating jojoba oil, hydrating and ring-opening, followed by an acylation process using an organic acid and a fatty acid.

The addition amount of this is preferably from 0.1 to 20 parts by weight based on 100 parts by weight of toner. The addition amount smaller than 0.1 parts by weight fails to provide the effects of fixing property and anti-offset property, and the addition amount greater than 20 parts by weight causes reduction in storage stability and a problem with grinding property such as an extreme grinding process. The melting point is preferably from 40 to 130° C., more preferably, 45 to 120° C., most preferably, 50 to 110° C. The melting point not more than 40° C. causes reduction in storage stability, and the melting point exceeding 130° C. causes degradation in fixing functions such as fixing property and anti-offset property.

Moreover, based on the molecular weight in GPC, those having Mn of 100 to 5,000, Mw of 200 to 10,000, Mw/Mn of not more than 8 and Mz/Mn of not more than 10 are preferably used. More preferably, those having Mn of 100 to 5,000, Mw of 200 to 10,000, Mw/Mn of not more than 7 and Mz/Mn of not more than 9 are used. Most preferably, those having Mn of 100 to 5,000, Mw of 200 to 10,000, Mw/Mn of not more than 6 and Mz/Mn of not more than 8 are used. If Mn is smaller than 100 or Mw is smaller than 200, storage stability becomes poor. If Mn is greater than 5,000, Mw is greater than 10,000, Mw/Mn is greater than 8, or Mz/Mn is greater than 10, fixing functions such as fixing property and anti-offset property, becomes poor.

As to the hydrocarbon wax obtained through the Fischer Tropsch method, sazol wax of fine-particle type as well as of acidic type is preferably used. In this wax, the density is not less than 0.93 g/cm$^3$, the number average molecular weight (Mn) is from 300 to 1000, the weight average molecular weight (Mw) is from 500 to 3,500, and Mw/Mn is not more than 5. The melting point is preferably from 85 to 120° C. If the molecular weight becomes large and the melting point becomes high, dispersing property is lowered, and anti-offset property is lowered. If the molecular weight becomes small and the melting point becomes low, storage stability is lowered.

As to preferable low molecular weight polyolefin containing fluorine, the specific gravity is not less than 1.05 at 25° C., the tangential line melting-point temperature during heating in the differential scanning calorie measurement (the tangential line melting-point temperature represents an intersecting point between a tangential line of a rising curve at initial heat-absorbing time during heating, and a tangential line of a curve directed to the peak after the rising), is from 70 to 140° C., the peak temperature is from 73° C. to 148° C., and the difference between the peak temperature and the tangential line melting-point temperature is not more than 20 K.

More preferably, the specific gravity is not less than 1.08 at 25° C., the tangential line melting-point temperature is from 75 to 135° C., the peak temperature is from 78° C. to 143° C., and the difference between the peak temperature and the tangential line melting-point temperature is not more than 18 K.

Most preferably, the specific gravity is not less than 1.1 at 25° C., the tangential line melting-point temperature is from 78 to 132° C., the peak temperature is from 81° C. to 140° C., and the difference between the peak temperature and the tangential line melting-point temperature is not more than 16 K.

The specific gravity smaller than 1.05 causes reduction in a fluorine ratio, resulting in degradation in anti-offset effect.

The tangential line melting-point temperature smaller than 70° C. causes degradation in storage stability, and thermal aggregation may easily occur. Moreover, filming may occur to a photosensitive member, an intermediate transfer member and a developing roller. The tangential line melting-point temperature greater than 140° C. causes degradation in anti-offset effect and reduction in dispersing property; consequently, an amount of waste toner increases and fogging tends to occur.

The peak temperature lower than 73° C. causes degradation in storage stability, and thermal aggregation may easily occur. Moreover, filming may occur to a photosensitive member, the intermediate transfer member and a developing roller. The peak temperature greater than 148° C. causes degradation in anti-offset effect and reduction in dispersing property; consequently, an amount of waste toner increases, and fogging tends to occur.

If the difference between the peak temperature and the tangential line melting-point temperature is greater than 20 K, low temperature melting components that melt at temperatures not more than the peak temperature are contained in large amount; therefore, dispersing property at the time of kneading is lowered, an amount of waste toner increases, and fogging tends to occur. Moreover, filming may occur to a photosensitive member, an intermediate transfer member and a developing roller.

As to the low molecular weight polyolefin containing fluorine, preferable materials are: a copolymer of olefin and tetrafluoroethylene, partially fluoridated or extremely fluoridated jojoba oil or meadow-foam oil, a copolymer of tetrafluoroethylene and an acrylate represented by the following formula (1) and/or formula (2), and a copolymer of tetrafluoroethylene, olefin and an acrylate represented by formula (1) and/or formula (2). These may be used alone, or may be used in a mixed manner.

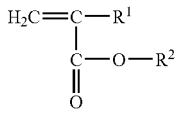

(1)

wherein, $R^1$ represents a hydrogen atom or an alkyl group having carbon atoms up to 3, and $R^2$ represents an alkyl group having carbon atoms of 16 to 25.

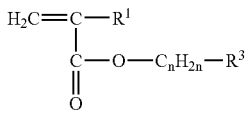

(2)

wherein, $R^1$ is the same as described above, $R^3$ represents an alkyl group having carbon atoms of 1 to 5, and n represents an integer of 1 to 5.

The fluoridated meadow-foam oil is formed by adding fluorine to meadow-foam oil to convert unsaturated bonds into saturated bonds. Those that are extremely fluoridated or partially fluoridated are preferably used.

The fluoridated jojoba oil is formed by adding fluorine to jojoba oil to convert unsaturated bonds into saturated bonds. Those that are extremely fluoridated or partially fluoridated are preferably used.

The addition amount of this is preferably from 0.1 to 20 parts by weight based on 100 parts by weight of toner. The addition amount smaller than 0.1 parts by weight fails to provide the effects of fixing property and anti-offset property, and the addition amount greater than 20 parts by weight causes degradation in storage stability and problem on grinding property such as overgrinding.

Moreover, in a mixture of fine particles of polytetrafluoroethylene and fine particles of polyolefin, the following mixture is preferably used: the particle size of polytetrafluoroethylene fine particles is from 0.1 to 2 μm, the particle size of polyolefin fine particles is from 2 to 8 μm, and the particle size of polytetrafluoroethylene fine particles is not more than ⅓ of the particle size of polyolefin fine particles with the polytetrafluoroethylene fine particles being allowed to adhere a surface of the polyolefin fine particles in a mixed manner.

If the particle size of polytetrafluoroethylene fine particles is smaller than 0.1 μm, or the particle size of polyolefin fine particles is smaller than 2 μm, productivity is lowered, costs for production becomes high. If the particle size of polytetrafluoroethylene fine particles is greater than 2 μm, or the particle size of polyolefin fine particles is greater than 8 μm, anti-offset property becomes poor, and light-transmittance is also lowered. If the particle size of polytetrafluoroethylene fine particles is greater than ⅓ of the particle size of polyolefin fine particles, adhesiveness between the polytetrafluoroethylene fine particles and the polyolefin fine particles is lowered, they may be separated at the time of adding and mixing processes with toner, a multiplier effect is impaired, resulting in degradation in anti-offset property.

In order to achieve high resolution images, there are demands for further miniaturizing the toner particle size and for providing a sharper particle size distribution. In this case, relationship between a particle size of a fixing adjuvant to be added to the toner and a particle size of the toner greatly devotes to developing property, charging property and anti-filming property. In other words, if the fixing adjuvant do not have a particle size of a certain range based on a toner particle size, problems such as filming arise, and anti-offset property is not effectively exerted.

For this reason, particle size distribution needs to be set to a fixed specific value. In other words, supposing that the volume average particle size of the toner is TP and that the volume average particle size of the fixing adjuvant is FP, the particle sizes are set in a range so as to satisfy FP/TP of not less than 0.3 to not more than 0.9.

The value smaller than 0.3 causes degradation in anti-offset effect at the time of fixing, non-offset temperature range becomes narrow. The value greater than 0.9 tends to cause filming to a photosensitive member due to load exerted at the time of cleaning untransferred toner remaining on a photosensitive member after a transferring process. Further, when a thin toner layer is formed on a developing roller, the roller is more contaminated. Moreover, at the time of recycling a waste toner, a fixing adjuvant, separated from the toner, tends to remain in an untransferred toner, and when this is again returned to a developer, the developer has variations in charge, resulting in difficulty in maintaining proper image quality. Furthermore, after a long-term repeated use, the toner tends to be overcharged, resulting in degradation in image density.

The volume average particle size of the toner is from 3 to 11 μm, preferably, 3 to 9 μm, and more preferably, 3 to 6 μm. If this is greater than 11 μm, resolution is lowered, images with good quality is hardly obtained, and when this is smaller than 3 μm, toner aggregation tends to occur, and background fogging increases.

When the binder resin to which these fixing assistant agents are added, has a specific molecular weight distribution, and when the toner, subjected to a kneading process has a specific molecular weight distribution value, it is possible to provide a uniform dispersing property, and consequently to improve the properties such as fixing property and durability.

The application of a conventional sharp-melt resin having molecular weight distribution having one peak to a low molecular weight color toner in which a resin is substantially melted completely, tends to cause filming to a photosensitive member and other members.

This is probably because, as a result of the use in combination with a low softening-point sharp-melt resin, the toner is weakened against stresses exerted by a developing and cleaning processes. Moreover, this also fails to improve anti-offset property.

Thus, when the toner is used in combination with the above-mentioned binder resin, it is possible to achieve both of high light-emitting property and anti-offset property without the need of applying anti-offset-use oil to a fixing roller. In particular, in this case, it is necessary not only to provide anti-offset property, but also to prevent paper from winding around a fixing roller; thus, application of the above-mentioned fixing adjuvant makes it possible to achieve anti-offset property and also to prevent paper from winding around the fixing roller.

Moreover, this also makes a photosensitive member and other members less susceptible to filming. It is also possible to stabilize charging property and powder fluidity of a toner in high-temperature, high-humidity and low-temperature, low-humidity environments, and also to provide appropriate materials for use as functional materials for toner-use.

Other Internal Additive Agents

Moreover, in the present invention, a charge control agent is blended to a binder resin in order to control charge of a toner. Preferable materials for this are: metal salts of derivatives of salicylic acid, metal salts of derivatives of benzylic acid and quaternary ammonium salts of phenyl borate. As to the metals, zinc, nickel, copper and chromium are preferably used. The addition amount thereof is preferably from 0.5 to 5 parts by weight based on 100 parts by weight of the binder resin, more preferably, 1 to 4 parts by weight, most preferably, 3 to 4 parts by weight.

As to the pigments used in the present invention, examples thereof include: carbon black, iron black, graphite, nigrosine, metal complexes of azo dyes, monoazo yellow pigments of acetoacetic acid aryl amide type such as C.I. Pigment Yellow 1, 3, 74, 97, 98, disazo yellow pigments of acetoacetic acid aryl amide type such as C.I. Pigment Yellow 12, 13, 14, 17, C.I. Solvent Yellow 19, 77, 79, C.I. Disperse Yellow 164, red pigments such as C.I. Pigment Red 48, 49:1, 53:1, 57, 57:1, 81, 122, 5, red dyes such as C.I. Solvent Red 49, 52, 58, 8, blue dyes and pigments of phthalocyanine and derivatives thereof such as C.I. Pigment Blue 15:3, and one kind or two or more kinds of these are blended. The addition amount thereof is preferably from 3 to 8 parts by weight based on 100 parts by weight of the binder resin.

In the present invention, a magnetic material may be added to a black toner to form a magnetic toner. As to magnetic fine powder, ferromagnetic metals such as iron, cobalt, nickel, manganese and magnetite, alloys of these or compounds containing these metals are preferably used. The shape of the magnetic fine powder is preferably spherical shape or an octahedron. Here, metal oxide fine powder composed of magnetic fine powder having an average particle size of 0.02 to 2.0 μm, a ratio D25/D75 of the 25% residual particle size D25 and the 75% residual particle size D75 of 1.3 to 1.7, a BET specific surface area based upon nitrogen adsorption of 0.5 to 80 $m^2/g$, an electrical resistance of $10^2$ to $10^{11}$ Ωcm, a bulk density of 0.3 to 0.9 $g/cm^3$, a compression rate of 30 to 80%, a linseed oil absorption amount of 10 to 30 (ml/100 g), a residual magnetization of 5 to 20 emu/g, and a saturated magnetization of 40 to 80 emu/g is added to the toner so that charging property is stabilized, waste toner recycling property is improved, and transferring property is also improved. In particular, at the time of recycling waste toner, it is possible to stabilize the charge, to prevent filming, and also to maintain the charge even at the time of continuous use under low humidity.

The average particle size of the magnetic fine powder is preferably from 0.02 to 2.0 μm, and D25/D75 is preferably from 1.3 to 1.7. More preferably, the average particle size is from 0.05 to 1.0 μm, and D25/D75 is from 1.3 to 1.6, and most preferably, the average particle size is from 0.05 to 0.5 μm, and D25/D75 is from 1.3 to 1.5.

When the particle size of the magnetic fine powder is smaller than 0.02 μm or the ratio D25/D75 is less than 1.3, a rate of small size particles becomes high, with the result that aggregation tends to occur and dispersing property is not improved at the time of mixing, failing to exert the effect of addition. If the particle size of the magnetic fine powder is greater than 2.0 μm or the ratio D25/D75 is greater than 1.7, a rate of large size particles becomes high and width of the particle size distribution is widened; thus, both of a rate of large size particles and a rate of small size particles become high, resulting in poor dispersing property, poor image quality and increased scratches on a photosensitive member. The measuring process was carried out by taking photographs using a scanning electronic microscope and selecting 100 particles at random, and the particle sizes were measured.

The BET specific surface area of the magnetic fine powder based upon nitrogen adsorption is preferably from 0.5 to 80 $m^2/g$. More preferably, this is from 2 to 60 $m^2/g$, more preferably, 10 to 60 $m^2/g$, most preferably, 18 to 60 $m^2/g$. The value smaller than 0.5 $m^2/g$ causes separation from the toner, resulting in degradation in kneading property, and prevention in conversion of an ultra-high molecular weight component to a low molecular weight component. If the value becomes greater than 80 $m^2/g$, the particles tend to aggregate with each other, dispersion at the time of mixing becomes uneven, and it becomes hard to obtain the effects of developing property and control stability of toner density. The BET specific surface area was measured by a Flow Sorb II 2300 made by Shimadzu Corporation.

The electric resistance of the magnetic fine powder is preferably from $10^2$ to $10^{11}$ Ωcm, more preferably, $10^5$ to $10^{10}$ Ωcm, most preferably, $10^6$ to $10^9$ Ωcm. If the resistance of the powder is low, there is a drop in the quantity of charge in high humidity environment, fogging and toner scattering increase. If the resistance of the powder is high, the effect for regulating an overcharge is weakened in high temperature and low humidity environment.

The measurements of the volume electric resistance were carried out as follows: 1 ml of magnetic particle material was put into a cylindrical container having a bottom face made of an electrode having an inner diameter of 20 mm with a side wall made of an insulating material, and an electrode plate weighing 100 g and having a diameter of slightly less than 20 mm was put on the sample; thus, after having been left for one hour, 100 V of DC voltage was applied across the electrodes, and one minute after the application, the current voltage was measured and calculated.

The bulk density of the magnetic fine powder is preferably from 0.3 to 0.9 $g/cm^3$, the compression rate is preferably from 30 to 80%. More preferably, the bulk density is from 0.4 to 0.9 $g/cm^3$, and the compression rate is from 40 to 70%. Most preferably, the bulk density is from 0.5 to 0.9 $g/cm^3$, the compression rate is from 45 to 65%. If the bulk density is greater than 0.9 $g/cm^3$ or the compression rate is less than 30%, density of the developer itself tends to increase when left under a high humidity environment, while toner density control becomes unstable under a high humidity environment, resulting in overtoner. If the bulk density is smaller than 0.3 $g/cm^3$, or the compression rate is greater than 80%, aggregation of particles increases, failing to carry out a uniform mixing process and resulting in reduction in the regulating effect for an overcharge in high-temperature and low-humidity environments. The bulk density and the compression rate were measured by using a powder tester made by Hosokawa Micron Corporation. The compression rate was calculated as follows: the difference between the bulk density that is a loose specific gravity and the tap density was divided by the tap density, and the resulting value was multiplied by 100. Here, it is preferable to subject the magnetic fine powder to a pulverizing process. This is preferably carried out by a mechanical grinding machine provided with a high-speed rotor or a pressure dispersing machine provided with a pressure roller. The magnetic fine powder preferably has a linseed oil absorption of 10 to 30 (ml/100 g). This provides the same effects as the above-mentioned compression rate and the bulk density. This value was measured in conformity with JISK5101-1978.

Moreover, under a magnetic field of 1 (kOe), the residual magnetization of the magnetic fine powder is preferably from 5 to 20 emu/g, and the saturated magnetization is preferably from 40 to 80 emu/g. It has been found that addition amount of the fine powder is effective to reduce fogging on a photosensitive member, in particular, in a high humidity environment. This is probably because, based on the toner adhering to a photosensitive member to cause fogging, by the application of the magnetic material, the surface of each toner particle comes to have the magnetic fine powder adhering thereto in a brush shape, and this exerts a scraping effect to collect the toner, thereby making it possible to reduce fogging.

It is preferable to subject the surface of the magnetic fine powder to be added to the toner to a surface treatment by using a titanium coupling agent, silane coupling agent, epoxy silane coupling agent, acrylic silane coupling agent or an amino silane coupling agent. For example, titanate coupling agents include: isopropyltriisostearoyl titanate, tetrabutoxy titanium, isopropyltris(dioctylpyrophosphate) titanate, isopropyltri(N-aminoethyl-aminoethyl) titanate, tetraoctylbis(ditridecylphosphate) titanate, bis(dioctylpyrophosphate)oxyacetate titanate, bis(dioctylpyrophosphate) ethylene titanate, isopropyltrioctanoyl titanate, isopropyltrioctanoyl titanate, and isopropyldimethacrylisostearoyl titanate; silane coupling agents include: fvinyltriethoxysilane, vinyltris(β-methoxyethoxy)silane, γ-methacryloxypropyltrimethoxysilane, γ-glycidoxypropyltrimethoxysilane, β-(3,4epoxycyclohexyl)ethyltrimethoxysilane, N-β(aminoethyl) γ-aminopropylmethyldimethoxysilane, γ-aminopropyltriethoxysilane, N-phenyl-γ-aminopropyltrimethoxysilane, γ-mercaptipropyltrimethoxysilane and γ-chloropropyltrimethoxysilane; acrylic silane coupling agents include: γ-methacryloxypropyltrimethoxysilane; epoxy silane coupling agents include: β-ethyltrimethoxysilane, γ-glycidoxypropyltrimethoxysilane and γ-glycidoxypropylmethyldiethoxysilane; and amino silane coupling agents include: N-β-aminoethyl γ-aminopropyltrimethoxysilane, N-β-aminoethyl γ-aminopropylmethylditoxysilane, γ-aminopropyltriethoxysilane and N-phenyl-γ-aminopropyltrimethoxysilane. For example, the treatment may be carried out by using a known method such as a dry treatment in which a gaseous silane coupling agent is allowed to react with the magnetic material, or a wet treatment in which a silane coupling agent is dripped and allowed to react with a solvent in which the magnetic material has been dispersed.

The addition amount of the magnetic material to the toner is preferably from 20 to 70 wt %.

Preparation Method of Toner

The toner of the present invention is prepared through a preliminary mixing process, a melt-kneading process, a grinding and classifying process and an externally adding process.

The preliminary mixing process is a process in which a binder resin and internal additive agents to be dispersed therein are uniformed dispersed by using a mixer, etc., provided with stirring blades. As to the mixer, a known mixer such as a Super Mixer (made by Kawata Seisakusho K.K.), a Henschel Mixer (made by Mitsuimiike Kogyo K.K.), a PS mixer (made by Shinko Pantec Co., Ltd.) or a Ledige Mixer.

Figure 5:
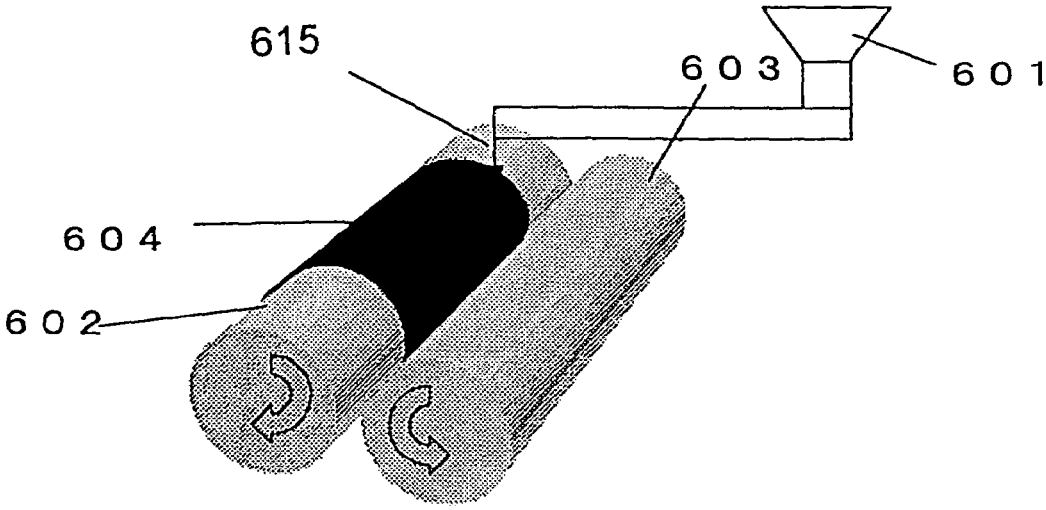
FIG. 5 is a schematic perspective view that shows a toner melt-kneading process used in an example of the present invention.
Figure 6:
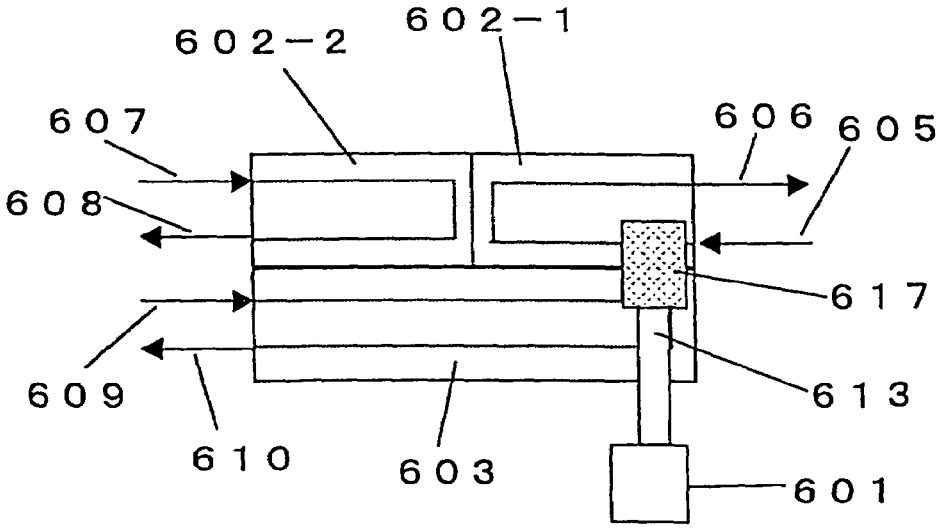
FIG. 6 is a plan view that shows a toner melt-kneading process used in an example of the present invention.
Figure 7:
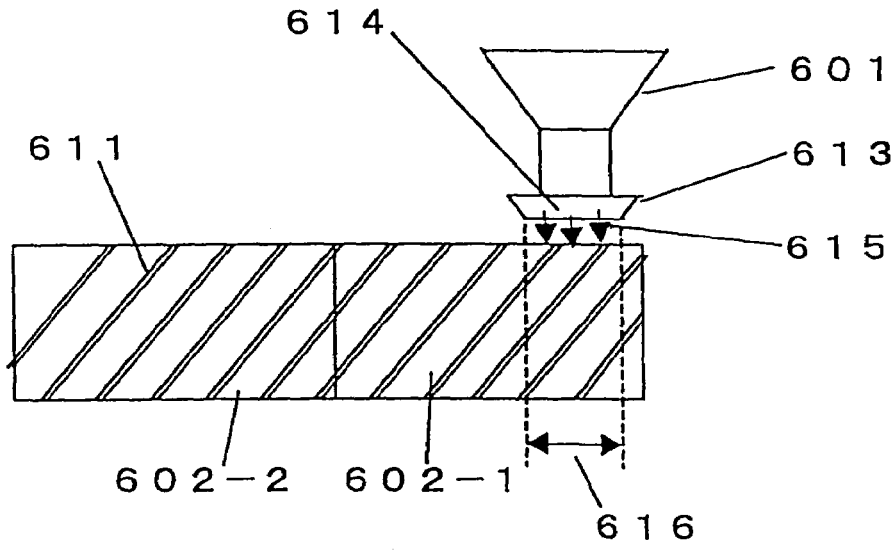
FIG. 7 is a front view that shows a toner melt-kneading process used in an example of the present invention.
Figure 8:
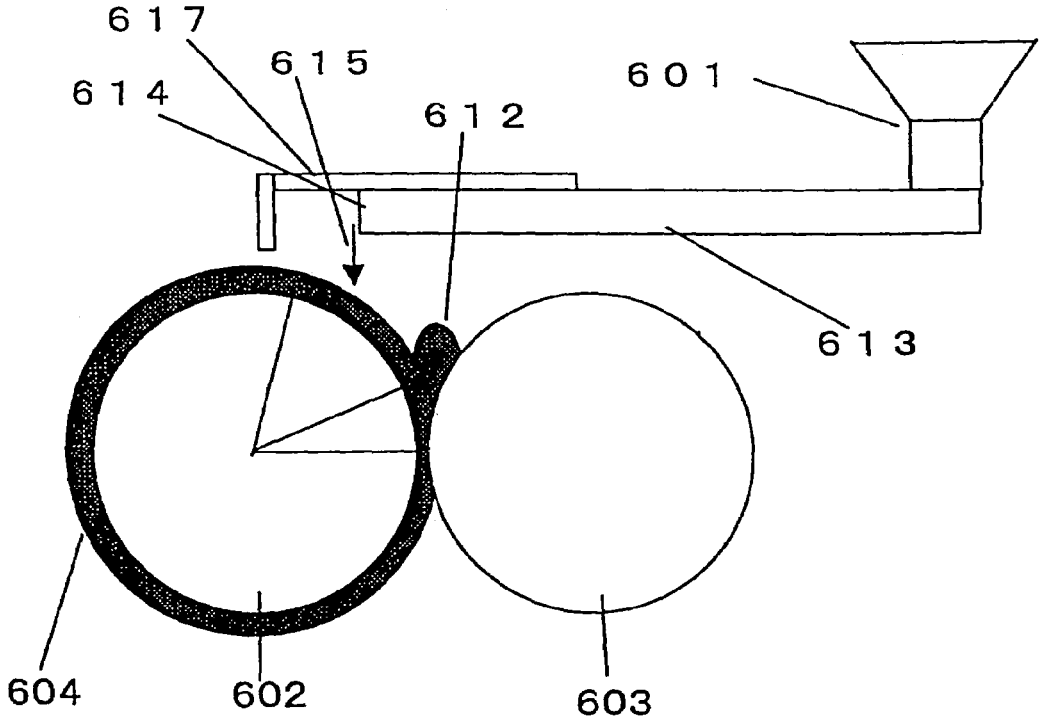
FIG. 8 is a cross-sectional view that shows a toner melt-kneading process used in an example of the present invention.

FIG. 5 is a schematic perspective view showing a toner melt-kneading process, FIG. 6 is a plan view, FIG. 7 is a front view and FIG. 8 is a right side view thereof. Reference numeral 601 is a fixed-amount supplying device for toner materials, 602 is a roll (RL1), 603 is a roll (RL2), 604 is a toner molten film wrapped around the roll (RL1), 602-1 is a front-half portion (the upstream side in the transporting direction of the material; IN side) of the roll (RL1), 602-2 is a rear-half portion (the downstream side in the transporting direction of the material; OUT side) of the roll (RL1), 605 is an inlet of a heating medium for heating the front-half portion 602-1 of the roll (RL1), 606 is an outlet of the heating medium that has heated the front-half portion 602-1 of the roll (RL1), 607 is an inlet of a heating or cooling medium for heating or cooling the rear-half portion 602-2 of the roll (RL1), 608 is an outlet of the heating medium that has heated or cooled the rear-half portion 602-2 of the roll (RL1), 609 is an inlet of a thermal medium for heating or cooling the roll (RL2) 603, 610 is an outlet of the thermal medium that has heated or cooled the roll (RL2) 603, 611 is a spiral-shaped groove on the roll surface having a depth of approximately 2 to 10 mm, and 612 is a toner holding portion formed between the rolls.

The spiral-shaped groove 611 is formed so as to smoothly transport the material from the right end of a material charging section to the left side of a discharging section at the time of kneading the toner.

As indicated by arrow 615, the toner material is dropped on the vicinity of the end of the roll (RL1) 602-1 through an opening 614 along a material supplying feeder 613 from the fixed-amount supplying device 601. Reference numeral 616 represents the length of the opening of the supplying feeder. This length is preferably a length ½ to 4 times the roll diameter. If the length is too short, the amount of the material that is dropped down between the two rollers before it has been melted is greatly increased. If the length is too long, the material is separated in the middle of the transporting process in the material feeder, failing to provide uniform dispersion. As to the supplying feeder, those of the vibration type and the screw type may be used. In particular, those of the screw type are preferably used. In the case of the vibration type, the mixed material tends to be separated in the middle of the transporting process, failing to provide uniform dispersion.

Moreover, as illustrated in FIG. 8, the dropping position is set to a point within a range of 20° to 80° from a point at which the two rolls of the roll (RL1) 602 are located closest to each other. The angle smaller than 20° greatly increases the amount of the material dropping through the gap of the two rolls. The angle greater than 80° causes the toner powder to scatter while it is being dropped, resulting in ambient contamination.

Moreover, a cover 617 is placed so as to cover an area wider than the length 616 of the opening. The cover is omitted in FIG. 7 and FIG. 5.

The toner material, dropped from the opening 614 along the material-supplying feeder 613, is melted in its resin by heat of the roll (RL1) 602-1 and a compressive shearing force of the roll (RL2) 603, and allowed to wrap around the front-half portion 602-1 of the roll (RL1). This state spreads to the end of the rear-half portion 602-2 of the roll (RL1), and is separated from the rear-half portion 602-2 of the roll (RL2) that has been heated at a temperature lower than that of the front-half portion 602-1 of the roll (RL1). Here, during the process, the roll 603 is cooled to not more than room temperature and maintained at this temperature. The clearance between the roll (RL1) 602 and the roll (RL2) 603 is preferably from 0.05 to 1.0 mm, more preferably, 0.1 to 0.25 mm. This arrangement makes it possible to increase shearing force, and consequently to provide good kneading property. The clearance less than 0.05 mm increases a mechanical stress, causing damages to the machine. The clearance not less than 1.0 mm causes an increase in the amount of the dropping material between the rolls, weakens shearing force, and results in serious degradation in dispersing property.

For example, the charge of the material is from 10 kg/h, the diameter of the rolls (RL1), (RL2) is from 140 mm, the length is from 800 mm, the clearance is from 0.1 mm, and the supplying feeder is of the screw type (Examples).

The kneading process using high shearing force makes it possible to improve the properties such as fixing property, developing property and durability.

The factors, such as the temperature setting and temperature gradient, the kneading conditions of the number of revolutions and load current, the softening point of the binder resin, the flowing start temperature and the glass transition point, are set to optimal conditions so that it is possible to improve the process.

A ratio of the numbers of revolutions of the two rolls is from 1.1 times to 2.5 times so that an appropriate shearing force is generated at the time of kneading, and the binder resin is allowed to have a low molecular weight component properly. As a result, dispersing property of the fixing adjuvant is improved, and fixing property and developing property are also improved. In other words, the roll (RL1) on which the heated and melted toner is wrapped is allowed to have a higher rotation ratio. The ratio not more than 1.1 fails to provide a proper shearing force, also fails to improve dispersing property of a fixing adjuvant, and causes degradation in light-transmittance. In contrast, the ratio not less than 2.5 times causes serious reduction in productivity, poor dispersing property and degradation in developing property.

Moreover, in this case, a ratio of load current values applied to the two rolls is from 1.25 to 10; that is, the roll (RL1) on which the melted toner is wrapped is allowed to have higher load during a kneading process so that appropriate shearing force is applied and dispersing property of an internal additive agent is improved. The ratio smaller than this range fails to improve dispersing property, and causes degradation in light-transmittance. Further, productivity is also lowered. In contrast, the ratio exceeding this range increases load imposed on the roller; thus, too much amount of a ultra-high molecular weight component is converted into a low molecular weight component, with the result that anti-offset property is lowered and offset occurs.

In this arrangement, one of the rolls (RL1) is allowed to have a temperature difference between the front-half portion (IN side) for supplying the material and the rear-half portion (OUT side) used for taking out the kneaded material. On the IN side, the temperature is set higher so as to allow the supplied material to melt and wrap around the roller, while on the OUT side, the temperature is set lower so as to allow the material to have a shearing force to make the resin have a low molecular weight component and also to improve dispersing property of the fixing adjuvant. It is preferable to set the area of the OUT side to cover not less than half of the roll. If the area is not more than the half, dispersing property is not improved. The area is more preferably not less than ⅔ of the roll. It is possible to improve the properties by carrying out the processes at a low temperature for a longer time.

The temperature of the roll for heating the IN side is set to a temperature lower than the resin softening point of the binder resin. This is set to a temperature lower than the softening point by 10° C. or more, more preferably, by 20° C. or more.

Since the kneading process is carried out in a narrow gap between the rolls, the material is allowed to melt and wrap around the roll even at a temperature lower than the softening point. Thus, it is possible to provide an appropriate shearing force to the material, and consequently conversion of the resin into a low molecular weight component is properly carried out and dispersing property of the colorant and fixing adjuvant that form internal additive agents. If the processes are carried out with a temperature higher than the resin softening point, shearing force becomes insufficient during the kneading process, causing unevenness in dispersing property of the colorant and fixing adjuvant that form internal additive agents. In contrast, when the temperature is set to a temperature lower than the softening point by 70° C. or more, the resin is transported without being sufficiently melted, with the result that dispersing property of the fixing adjuvant is lowered, more material tends to drop, and productivity is reduced.

Moreover, the temperature of the roll on the IN side is set to a temperature range from not less than a temperature that is 50° C. lower than the flowing start temperature of the resin to not more than a temperature that is 20° C. higher than the flowing start temperature of the resin. With this arrangement, an appropriate shearing force is exerted in the resin so that it becomes possible to improve the conversion of the resin into a low molecular weight component and dispersing property of the internal additive agents. If the process is carried out at a temperature not more than the temperature that is 50° C. lower than the flowing start temperature of the resin, it fails to allow the resin to wrap around the roll, causes the material to drop, and results in reduction in productivity. If the process is carried out at a temperature not less than the temperature that is 20° C. higher than the flowing start temperature of the resin, shearing force on the IN side is weakened, resulting in degradation in dispersing property of the pigment.

A temperature difference of the rolls on the IN side and the OUT side is set in a range from a temperature that is 90° C. lower than the resin softening point to a temperature that is 20° C. lower than the resin softening point; thus, it is possible to improve properties. The temperature difference is provided so that the material, which is transported from the IN side to the OUT side, is melted to a certain degree in the IN side with the fixing adjuvant being dispersed in the resin, and this is subjected to stronger shearing force at the low temperature on the OUT side so that dispersing property becomes even. Moreover, conversion into a low molecular weight component is properly carried out. If the temperature is not more than a temperature that is 90° C. lower than the resin softening point, an excessive load is applied to the production device, causing reduction in productivity. If the process is carried out at a temperature not less than the temperature that is 20° C. lower than the resin softening point, shearing force is weakened due to the temperature difference, causing degradation in dispersing property of the fixing adjuvant and ability of forming a low molecular weight component of the resin.

Moreover, the temperature difference of the rolls on the IN side and the OUT side is set in a range from a temperature that is 70° C. lower than the resin flowing start temperature to the resin flowing start temperature; thus, it is possible to improve properties. The temperature difference is provided so that the material, which is transported from the IN side to the OUT side, is melted to a certain degree in the IN side with the fixing adjuvant being dispersed in the resin, and this is subjected to a stronger shearing force at the low temperature on the OUT side so that dispersing property becomes even. Moreover, it is possible to carry out the conversion of the resin into a low molecular weight component. If the temperature is not more than a temperature that is 90° C. lower than the resin softening point, an excessive load is applied to the production device, causing reduction in productivity. If the process is carried out at a temperature not less than the temperature that is 20° C. lower than the resin softening point, shearing force is weakened due to the temperature difference, causing degradation in dispersing property of the fixing adjuvant and conversion of the resin into a low molecular weight component is not properly carried out.

A temperature difference between the two rolls (the temperature on the IN side of the roll (RL1) on the heating side and the temperature of the other roll (RL2)) is set to a temperature not less than ½ of the glass transition point of a resin; thus, it becomes possible to improve the properties. More preferably, it is not less than the glass transition point of the resin.

The glass transition point is a point at which the state of a resin has a transition from a glass state to a rubber state, and in this transit state, the resin is subjected to a strong shearing force from the other roll (RL2) that has been cooled so that shearing force is easily exerted and concentrated on a high molecular weight component of the resin that controls the glass transition point; thus, it is considered that it becomes possible to improve the conversion of the resin into a low molecular weight component and dispersing property of a fixing adjuvant. The reason for the setting to ½ is that not only the temperature, but also pressure gives a strong function to a process. The temperature lower than ½ fails to provide a proper shearing force, conversion of the resin into a low molecular weight component is not properly carried out, dispersing property of a fixing adjuvant is not improved.

Moreover, a temperature difference is set between the IN side and the OUT side of the heating roll (RL1), and the temperature difference is not less than a temperature that is 20° C. lower than the glass transition point of the resin so that the effects are enhanced. More preferably, the temperature difference is set not less than a temperature that is 40° C. lower than the glass transition temperature.

The temperature lower than this temperature causes a weakened stress to the resin, conversion of the resin into a low molecular weight component is not properly carried out, dispersing property of the fixing adjuvant is lowered. In contrast, it has been found that when the temperature is set not less than a temperature that is 30° C. higher than the glass transition point, fogging tends to occur. Although a detailed explanation has not been given, it is assumed that aggregation of the internal additive agents takes place due to the temperature difference at the time of cooling.

The kneading process is preferably carried out in a state where the surface temperature of the toner melted film wrapping around the roll (RL1) derived from the melted resin is set at not less than the temperature on the IN side of the roll (RL1). Preferably, this is set at not less than 5° C. higher than the roll temperature, more preferably, 20° C. higher than the roll temperature. By strengthening shearing force between the rolls, the temperature of the melted film tends to rise; however, by regulating the degree of the rise, it is possible to generate an appropriate shearing force. If the temperature becomes not less than 60° C. higher than the roller temperature, the resin and the charge control agent tend to react with each other so that crosslinking occurs during the kneading process, and this might give adverse effects to light-transmittance. In particular, the crosslinking during the kneading process tends to occur between a polyester resin having an acid value and a metal complex of a salicylic acid, and it is difficult to prevent this phenomenon.

Moreover, after the toner melted film has been formed on the surface of the heated roll, the heating temperature of the IN side of the roll (RL1) is lowered so that shearing force at the time of kneading is increased in the melted state. At this time, when the range of the temperature drop is too great, the toner melted layer is separated from the roll, causing the separated portion to scatter. Therefore, the range is preferably set from the glass transition point of the resin or the glass softening point of the resin to a temperature 50° C. lower than this, and not less than 10° C.

By carrying out the process in the state as described above, it is possible to carry out the process for converting of a high molecular weight component into a low molecular weight component at the time of kneading in an appropriate state, to evenly knead and disperse the fixing adjuvant, and also to achieve both of light-transmittance, in particular, in color toners and anti-offset property in an oil-less fixing process.

Moreover, it becomes possible to improve waste toner recycling property, high transferring property and developing property. Moreover, it is possible to stabilize developing property in high-temperature, high-humidity and low-temperature, low-humidity environments.

Here, in the case when the material is put onto the two rolls, it is not possible to avoid a phenomenon in which the material is scattered and suspended at the time of loading. In particular, the charge control agent, which has a small specific gravity, tends to be scattered. This scattered and suspended material needs to be collected by a local dust collector, etc., so as not to contaminate ambient apparatuses and not to cause toner contamination. For this reason, a special provision should be given to the material loading process.

In the present arrangement, when the toner constituent material is loaded onto the two rolls from the material supplying feeder, the material feeder is inserted from the roll (RL2) side on the cooling side, and the loading position is set in a range from 20° to 80° in the reverse direction to the rotation direction of the roll (RL1) from the closest point between the heating side roll (RL1) and the roll (RL2), at which the material is dropped onto the surface of the roll (RL1). The scattering is influenced by convection due to heat between the rolls; therefore, the rear face of the feeder is placed at a position at which the convection of heat generated through the gap of the rolls so that the rising air is alleviated. Thus, it is possible to reduce the scattering and floating of the material. Any area other than this area causes increased scattering as well as increased dropping material. Moreover, a cover, which is 1.2 to 2 times larger in the area ratio than the loading opening of the material-supplying feeder, may be placed above the opening so that it is possible to reduce the scattering.

Moreover, the opening, used at the time when the toner material is dropped from the material-supplying feeder, is allowed to have a width having a predetermined length so that it is possible to reduce the scattering and floating. In the opening, the length in the roll (RL1) axis direction is not less than ½ of the diameter of the roll (RL1) and also to not more than two times thereof. If the opening is made shorter, the dropping positions form a dotted shape, resulting in an increase in the amount of the material that is dropped without being melted. By making it longer, the material is dropped on the roller in a face-contact state so that the melting takes place smoothly, reducing the amount of the dropping material. In contrast, when it is too long, evenness of the material at the time of loading is impaired, causing variations in density related to a blending ratio depending on the places.

Moreover, it is found that the blending of the fixing adjuvant makes it possible to greatly reduce the scattering and floating. The addition amount needs to be not less than 3 parts by weight. The factor has not been specified; however, it is considered that the agent encloses the charge control agent and the pigment electrically or physically so that the scattering is prevented.

The resulting toner lumps are coarsely ground by a cutter mill, etc., and then finely ground by a jet mill (for example, an IDS grinder made by Nippon Pneumatic MFG), and the resulting fine particles are cut by an air-flow type classifier, if necessary, to obtain toner particles (toner base particles) having a desired particle size distribution. The grinding and classifying processes may be carried out by using mechanical systems, and in this case, for example, a Kryptron System (made by Kawasaki Heavy Industries, Ltd.) and a Turbo Mill (made by Turbo Kogyo K.K.), in which toner is put into a fine gap between a fixed stator and a rotating roller and finely ground therein, are used. Through this classifying process, toner particles (toner base particles) having a volume average particle size of 3 to 6 μm, are obtained.

The externally adding process is a process in which the toner particles (toner base particles), obtained from the classifying process, are mixed with an external additive agent such as silica. This process is carried out by using a known mixer such as a Henschel Mixer or a Super Mixer.

Toner

The toner, which has been kneaded in the above-mentioned method, has a molecular weight maximum peak in a range from $2\times10^3$ to $3\times10^4$ in molecular weight distribution of GPC chromatogram, and also has a molecular weight maximum peak or shoulder in a range of molecular weights from $3\times10^4$ to $1\times10^6$.

The molecular weight maximum peak or the shoulder in the range from $3\times10^4$ to $1\times10^6$ is obtained by kneading a toner composition containing the above-mentioned binder resin and converting the high molecular weight of the binder resin to a low molecular weight through thermal and mechanical energy exerted at the time of a kneading process.

Preferably, the molecular weight maximum peak located on the toner low molecular weight side is in a range of molecular weights from $3\times10^3$ to $2\times10^4$ in molecular weight distribution of GPC chromatogram, more preferably, in a range of molecular weights from $4\times10^3$ to $2\times10^4$.

Furthermore, the molecular weight maximum peak or the shoulder, located on the toner high molecular weight side, has a position within a range from $4\times10^4$ to $7\times10^5$ in molecular weight distribution of GPC chromatogram, more preferably, within a range from $6\times10^4$ to $5\times10^5$ therein.

When the position of the molecular weight maximum peak of the toner molecular weight distribution located on the low molecular weight side is smaller than $2\times10^3$, durability becomes poor. The fixing adjuvant is not properly dispersed, resulting in filming. If this is greater than $3\times10^4$, fixing property becomes poor, and light-transmittance is lowered.

Moreover, when the molecular weight maximum peak or the shoulder, located on the toner high molecular weight side, is smaller than $3\times10^4$, anti-offset property is lowered, and storage stability becomes poor. Developing property becomes poor, and waste toner recycling property is lowered. If this is greater than $1\times10^6$, the grinding property is lowered, and production efficiency is lowered.

Moreover, as to the component located in the toner high molecular weight range, the content of a high molecular weight component of not less than $3\times10^5$ is not more than 10 wt % based on the entire binder resin. The state in which the component located in the high molecular weight range of not less than $3\times10^5$ becomes high, or macromolecules are included, resulting in uneven kneading stress applied to the toner constituent material at the time of kneading, and subsequent poor kneading state. This causes serious degradation in light-transmittance. Moreover, the poor dispersing process of the fixing adjuvant causes increased fogging, scratches on a developing roller and a supply roller, degradation in grinding property of the toner and reduction in the production efficiency.

More preferably, the content of a high molecular weight component of not less than $5\times10^5$ is not more than 5% based on the entire binder resin, and more preferably, the content of a high molecular weight component of not less than $1\times10^6$ is not more than 1% based on the entire binder resin, or is not included.

Moreover, as to the molecular weight distribution in toner GPC chromatogram, when height of the molecular weight distribution of the molecular weight maximum peak located on $2\times10^3$ to $3\times10^4$ is denoted by Ha and height of the molecular weight maximum peak or the shoulder located on $3\times10^4$ to $1\times10^6$ is denoted by Hb, the ratio Hb/Ha is from 0.15 to 0.9.

If the ratio Hb/Ha is smaller than 0.15, anti-offset property is lowered and storage stability is also lowered, resulting in increased filming on a developing sleeve and a photosensitive member. If the ratio is more than 0.9, a developing roller and a supply roller may have scratches, and grinding property becomes poor, and productivity, resulting in subsequent high costs. More preferably, Hb/Ha is from 0.15 to 0.7, and more preferably, Hb/Ha is from 0.2 to 0.6.

Moreover, at least one molecular weight minimum peak is placed on a range of $2\times10^4$ to $2\times10^5$, and when height of the molecular weight distribution of the molecular weight minimum peak is denoted by La, (Hb-La)/(Ha-La) is from 0.04 to 0.5 so that fixing property and developing property are further improved. This effect is obtained by exerting the molecular cutting function of the resin more efficiently.

Here, if the molecular weight minimum peak value becomes smaller than $2\times10^4$, dispersing property of the internal additive agent is slightly lowered at the time of kneading, and when this becomes greater than $2\times10^5$, fixing property is lowered, and light-transmittance is lowered.

Moreover, when (Hb-La)/(Ha-La) becomes smaller than 0.04, durability at the time of developing becomes insufficient, filming on a developing sleeve and a photosensitive member is promoted, and when this is greater than 0.5, fixing property is lowered, and light-transmittance becomes poor. More preferably, (Hb-La)/(Ha-La) is from 0.08 to 0.5, and most preferably, (Hb-La)/(Ha-La) is from 0.1 to 0.3.

Furthermore, in order to ensure high light-transmittance and anti-offset property without the necessity of fixing oil; as to the molecular weight distribution in GPC chromatogram of toner; in an arrangement in which a molecular weight maximum peak is located on a range of $2\times10^3$ to $3\times10^4$, and a molecular weight maximum peak or shoulder is located on a range of $3\times10^4$ to $1\times10^6$; taking account of a molecular weight curve located on a range greater than the molecular weight value corresponding to the maximum peak or shoulder of the molecular weight distribution located on molecular weights of $3\times10^4$ to $1\times10^6$; on the assumption that height of the maximum peak or shoulder of the molecular weight distribution is set to 1 as a reference; when the molecular weight corresponding to 90% of height of the molecular weight maximum peak or shoulder is denoted by M90, and the molecular weight corresponding to 10% of height of the molecular weight maximum peak or shoulder is denoted by M10, the ratio M10/M90 is not more than 6; thus, the above-mentioned objectives are achieved. More preferably, the ratio (M10-M90)/M90 is not more than 5.

By specifying the value M10/M90, and further, the value (M10-M90)/M90 (gradient of the molecular weight distribution curve), it becomes possible to quantify the state of the process for converting an high molecular weight component into a low molecular weight component, and when this value is not more than the above-mentioned value (representing that the gradient of the molecular weight distribution curve is abrupt), a high molecular weight component which interfere light-transmittance is eliminated because of a cutting process during kneading, and high light-transmittance is provided. Moreover, this high molecular weight component having an abrupt peak that appears on the high molecular weight side devotes to better anti-offset property, making it possible to prevent generation of an offset in color toners without the need of using oil.

Moreover, during the process for converting a high molecular weight component into a low molecular weight component, internal additive agents, such as colorant, a fixing adjuvant and a charge control agent, may be highly dispersed; thus, charge quantity becomes even, clear resolution is achieved, and durability is not lowered even after a long-term continuous use. Moreover, it is possible to greatly reduce fogging at the time of waste toner recycling. Furthermore, it is also possible to prevent void images at the time of transferring, and consequently to provide a highly efficient transfer process.

In the case when the value of M10/M90 is greater than 6 or when (M10-M90)/M90 is greater than 5, the high molecular weight component still remains, and interferes light-transmittance. Dispersing properties of colorant, a charge control agent and a fixing adjuvant are lowered.

Preferably, the value of M10/M90 is not more than 5.5, and the value of (M10-M90)/M90 is not more than 4.5. More preferably, the value of M10/M90 is not more than 4.5, and the value of (M10-M90)/M90 is not more than 3.5.

After the kneading process, the weight average molecular weight Mwv of toner is from 8,000 to 300,000, and when the ratio Mwv/Mnv of the weight average molecular weight Mwv and the number average molecular weight Mnv is denoted by Wmv, Wmv is from 2 to 100, and when the ratio Mzv/Mnv of the Z average molecular weight Mzv and the number average molecular weight Mnv is denoted by Wzv, Wzv is preferably from 8 to 1200. The toner is kneaded and processed into these optimal ranges, by using high compressive shearing force, so that it is possible to achieve both of high light-transmittance and anti-offset property in color toners even by a fixing process without using any oil.

Preferably, Mwv is from 11,000 to 300,000, and more preferably, Mwv is from 13,000 to 300,000. More preferably, Mwv is from 8,000 to 200,000, Wmv is from 2 to 30, and Wzv is from 8 to 100.

Most preferably, Mwv is from 8,000 to 100,000, Wmv is from 2 to 10, and Wzv is from 8 to 50.

If Mwv is smaller than 8,000, Wmv is smaller than 2, or Wzv is smaller than 8, dispersing property of the internal additive agent is lowered at the time of kneading, with the result that fogging increases and durability at the time of waste-toner recycling becomes poor, anti-offset property and high-temperature storage stability become poor, and filming occurs onto a cleaning blade and a photosensitive member in high-temperature, high-humidity environments, in particular, at the time of waste-toner recycling.

If Mwv of the binder resin is greater than 300,000, Wmv is greater than 100 and Wzv is greater than 1200, an excessive load is imposed on the device during the kneading process, causing a serious reduction in productivity, degradation in light-transmittance in color images and degradation in fixing strength.

Consequently, in the case when the molecular weight of the resin is small, the resin cannot be received an appropriate compressive shearing force from the roller during the kneading process, failing to improve dispersing properties of colorant, a charge control agent, and a fixing adjuvant in the binder resin, and resulting in offset. In other words, it is necessary to provide a molecular weight not less than a specific value.

For this purpose, Mwf/Mwv is from 1.2 to 10, Wmf/Wmv is from 1.2 to 10, and Wzf/Wzv is from 2.2 to 30.

More preferably, Mwf/Mwv is from 1.2 to 5, Wmf/Wmv is from 1.2 to 5, and Wzf/Wzv is from 3 to 20.

Most preferably, Mwf/Mwv is from 1.5 to 4, Wmf/Wmv is from 1.5 to 3, and Wzf/Wzv is from 3 to 15.

If Mwf/Mwv is smaller than 1.2, Wmf/Wmv is smaller than 1.2, or Wzf/Wzv is smaller than 2.2, compressive shearing force is not exerted sufficiently, dispersing properties of colorant, a charge control agent and a fixing adjuvant are not improved, and light-transmittance is not improved. Moreover, when waste toner is recycled, fogging increases due to insufficient dispersing properties. Filming on a photosensitive member is caused by a fixing adjuvant due to pressure from a blade at the time of cleaning. Moreover, fixing property is lowered due to influences from a high molecular weight component.

If Mwf/Mwv is greater than 10, Wmf/Wmv is greater than 10, or Wzf/Wzv is greater than 30, excessive pressure is given from the compressive shearing force, resulting in aggregation between a fixing adjuvant and a charge control agent. In particular, in the case when a metal complex of salicylic acid or metal complex of benzylic acid is added to a polyester resin as a charge control agent, this phenomenon occurs more seriously. Consequently, dispersing property is lowered, waste toner recycling property is lowered, image density is lowered and insufficient transfer process occurs.

In the color images without using any oil, anti-offset property tends to become poor, and double imaged transfer and bleeding in images tend to occur due to insufficient light-transmittance and offset caused by degradation in dispersing property.

In accordance with the present invention, it is important to prepare a toner by using a binder resin having the above-mentioned molecular weight characteristics. In other words, a resin having components located in specific high molecular weight ranges is kneaded so that it becomes possible to set the molecular weight distribution of the toner in the above-mentioned characteristic ranges.

External Additive Agent

In the present invention, an external additive agent may be added to a toner base material thus prepared. As to silica that is properly applied as an external additive agent, silica generated by using a so-called dry method in which a silica halogen compound is subjected to vapor-phase oxidation, or so-called fumed silica, is preferably used. A silanol group existing on the surface thereof is treated by a silane coupling agent or a silicone oil material, and coated so as to improve its moisture-resistant property. In particular, hydrophobic property is improved by the process using a silicone oil material, resulting in improved durability and moisture-resistant property. Moreover, this material also reduces filming onto a photosensitive member and a transfer member.

As to the silicone oil material applied to silica, examples thereof include: silica that is treated by at least not less than one kind of dimethyl silicone oil, methylphenyl silicone oil, alkyl modified silicone oil, fluorine modified silicone oil, amino modified silicone oil and epoxy modified silicone oil. For example, SH200, SH510, SF230, SH203, BY16-823, BY16-855B, etc., made by Toray Dow Corning Ltd., are listed.

For example, the treatment methods include: a method in which silica fine powder and a silicone oil material are mixed by a mixing device such as Henschel Mixer, a method for atomizing a silicone oil material onto silica, and a method in which, after a silicone oil material has been dissolved or dispersed in a solvent, this is mixed with silica fine powder, and the solvent is then removed. As to the blending amount of the silicone oil material, it is preferably from 0.1 to 8 parts by weight based on 100 parts by weight of silica.

Moreover, after having been subjected to a silane coupling treatment, this may be treated by the silicone oil material. For example, silane coupling agents include: dimethyldichlorosilane, trimethylchlorosilane, allyldimethylchlorosilane, hexamethyldisilazane, allylphenyldichlorosilane, benzilmethylchlorosilane, vinyltriethoxysilane, γ-methacryloxypropyltrimethoxysilane, vinyltriacetoxysilane, divinylchlorosilane and dimethylvinylchlorosilane. The silane coupling agent treatment is carried out by, for example, a dry process in which the fine powder is stirred to form a cloud state and this is allowed to react with a gaseous silane coupling agent, or a wet process in which a silane coupling agent is dripped to react with a solvent in which the fine powder has been dispersed.

In this silica applying process, hydrophobic silica having a BET specific surface area of 30 to 350 $m^2/g$ based upon nitrogen adsorption is externally added to the toner base material. Preferably, the specific surface area is from 50 to 300 $m^2/g$, more preferably, 80 to 250 $m^2/g$. The specific surface area smaller than 30 $m^2/g$ fails to improve fluidity of the toner, resulting in degradation in storage stability. The specific surface area greater than 350 $m^2/g$ causes degradation in silica aggregation, externally adding process cannot evenly carried out. As to a blend amount of the hydrophobic silica, it is from 0.1 to 5 parts by weight, more preferably, 0.2 to 3 parts by weight, based on 100 parts by weight of the toner base particles. The blend amount smaller than 0.1 parts by weight fails to improve toner fluidity, and the blend amount greater than 5 parts by weight increases floating silica, resulting in contamination inside the device.

Moreover, more preferable characteristics are obtained by externally mixing and adding metal acid salt fine powder to the toner base material together with the hydrophobic silica. Metal acid salt fine powder composed of at least not less than one kind of titanate fine powder and zirconate fine powder, which has an average particle size of 0.02 to 4 μm and a BET specific surface area of 0.1 to 100 $m^2/g$ based upon nitrogen adsorption, is added to the toner so that it is possible to stabilize charging property, to improve waste toner recycling property, and also to improve transferring property. In particular, this process effectively makes it possible to stabilize charging property at the time of recycling waste toner, to prevent filming and to maintain the quantity of charge even at the time of continuous use in a low humidity environment.

Examples of the materials include: $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $SrSiO_3$, $BaSiO_3$, $MnSiO_3$, $CaSiO_3$ and $MgSiO_3$.

Here, larger effects are expected in the case when these metal acid salt powders are formed through a hydrothermal method or an oxalic acid thermal decomposition method. This is because these methods allow the resulting material to have even particle size distribution and a shape close to spherical shape rather than irregular shapes. If the average particle size is smaller than 0.02 μm, or the BET specific surface area based upon nitrogen adsorption is greater than 100 $m^2/g$, aggregation of particles becomes stronger, resulting in reduction in dispersing property. If the average particle size is greater than 4 μm, or the BET specific surface area based upon nitrogen adsorption is smaller than 0.1 $m^2/g$, the particles cause scratches to a photosensitive member.

As to a method for synthesizing the fine powder under the hydrothermal condition, examples thereof include: hydrothermal oxidation method, hydrothermal precipitation method, hydrothermal synthesizing method, hydrothermal dispersion method, hydrothermal crystallization method, hydrothermal hydrolysis method, hydrothermal Attrider mixture method, and hydrothermal mechanochemical method. Preferably, methods, such as hydrothermal oxidation method, hydrothermal precipitation method, hydrothermal synthesizing method, hydrothermal dispersion method, and hydrothermal hydrolysis method, are used.

The fine powders synthesized through these methods form spherical fine particles that are less susceptible to aggregation, and have narrow particle size distribution and superior fluidity. Therefore, when externally mixed and applied to the toner, this exerts good dispersion property and adheres to the toner evenly. Moreover, it does not give unintended scratches to a photosensitive member because of its spherical shape. Furthermore, this exerts appropriate rolling property during a cleaning process so that it is possible to improve cleaning property without increasing frictional coefficient, thereby making it possible to effectively prevent filming, in particular, when toner having small particles is used. The addition amount of the metal oxide fine powder and/or the metal acid salt fine powder to be externally added to the toner is preferably from 0.1 to 5 parts by weight based on 100 parts by weight of the toner base material. The addition amount smaller than 0.1 fails to exert these functions, and the addition amount greater than 5 causes degradation in moisture-resistant property.

In order to obtain high-resolution images, there have been demands for making the toner particle size smaller, and particle size distribution sharper. However, as the particle size is made too small by finely grinding, cleaning load imposed increases at the time when untransferred toner after the transferring process, is cleaned from a photosensitive member, resulting in a higher probability of filming. Moreover, at the time when a thin toner layer is formed by a developing sleeve, the sleeve is more seriously contaminated. Furthermore, toner having fine particle sizes tends to remain in untransferred toner at the time of recycling waste toner, and when this is again returned to the developer, the developer has variations in particle size distribution in the toner therein, resulting in difficulty in maintaining proper image quality. For this reason, it is necessary to set the particle size distribution to a specific value. The volume average particle size is from 3 to 10 μm, preferably, 4 to 10 μm, more preferably, 5 to 8 μm. The size greater than 10 μm causes reduction in resolution and subsequent failure to provide images with high quality. The size smaller than 3 μm causes strong toner aggregation, resulting in background fogging.

Moreover, the fluctuation coefficient of the volume average particle size distribution is preferably from 15 to 35%, and the fluctuation coefficient of the number average particle size is preferably from 20 to 40%. More preferably, the fluctuation coefficient of the volume average particle size distribution is from 15 to 30%, and the fluctuation coefficient of the number average particle size is from 20 to 35%. Most preferably, the fluctuation coefficient of the volume average particle size distribution is from 15 to 25%, and the fluctuation coefficient of the number average particle size is from 20 to 30%.

The fluctuation coefficient is a value obtained by dividing standard deviation of the toner particle size by the average particle size. This value is found based upon particle sizes measured by using a Coulter Counter (made by Coulter Co., Ltd.). The standard deviation is calculated as follows: n-number of particle series are measured to obtain differences of the respective measured values from the average value, and the difference is squared and then divided by (n−1); thus, root of the resulting value is found. In other words, the fluctuation coefficient represents how wide the particle size distribution varies, and when the fluctuation coefficient of the volume particle size distribution is less than 15% or when the fluctuation coefficient of the number particle size distribution is less than 20%, it becomes difficult to manufacture, and the costs become high. If the fluctuation coefficient of the volume particle size distribution is greater than 35% or when the fluctuation coefficient of the number particle size distribution is greater than 40%, the particle size distribution becomes broader, causing strong toner aggregation and the subsequent filming on a photosensitive member.

When the toner particle size is made to small and the distribution width is set within a specific value, it is necessary to add a specific amount of a fluidizing agent so as to properly maintain fluidity. Moreover, when dispersing property at the time of kneading is poor, this also causes adverse effects on the fluidity, with the result that image quality becomes poor, waste toner recycling is not properly carried out, transferring efficiency is lowered, and it becomes difficult to form an even toner layer on a developing sleeve. Furthermore, in the two-component developing system, mixing property with a carrier is lowered, toner density control becomes unstable and charge distribution becomes uneven, resulting in degradation in image quality. Therefore, as the toner has a smaller particle size, more silica needs to be added thereto since it provides high fluidity.

Therefore, in the case when the toner particle size is made to small and distribution width based upon the fluctuation coefficient is set within a specific value, by using an external additive agent and a binder resin disclosed by the present embodiment and applying a kneading process disclosed by the present embodiment, it becomes possible to stabilize characteristics of the fine particle size toner in a more appropriate manner.

Moreover, in the present invention, metal oxide fine powder, which has an average particle size of 0.02 to 2 μm, a BET specific surface area based upon nitrogen adsorption of 0.1 to 100 $m^2/g$ and an electric resistivity of not less than $10^9$ Ωcm, and which is composed of at least not less than one kind selected from the group consisting of titanium oxide fine powder, aluminum oxide fine powder, strontium oxide fine powder, tin oxide fine powder, zirconium oxide fine powder, magnesium oxide fine powder and indium oxide fine powder, is added to a toner so as to stabilize the characteristics. In particular, when a toner having small particle size is used, the toner tends to be charged excessively, resulting in degradation in image density during a long-term continuous use; therefore, this arrangement exerts effects properly.

Preferably, the average particle size is from 0.02 to 0.8 μm, and the BET specific surface area is from 1.0 to 85 $m^2/g$ based upon nitrogen adsorption; more preferably, the average particle size is from 0.02 to 0.1 μm, and the BET specific surface area is from 8 to 85 $m^2/g$ based upon nitrogen adsorption; and most preferably, the average particle size is from 0.02 to 0.06 μm, the BET specific surface area is from 10 to 85 $m^2/g$ based upon nitrogen adsorption.

Thus, it is possible to improve waste toner recycling property and transferring property. In particular, at the time of waste toner recycling, it is possible to stabilize the charge, to prevent filming and to properly maintain the charge even during a long-term continuous use in a low humidity environment. Moreover, in the case of the use in a two-component developing system, toner density control is stabilized and superior effects are obtained particularly in high-temperature, high-humidity environments.

When the average particle size is smaller than 0.02 μm and when the BET specific surface area is greater than 100 $m^2/g$ based upon nitrogen adsorption, aggregation becomes stronger, it becomes impossible to disperse evenly at the time of an externally adding process and failure to exert the above-mentioned effects. When electric resistivity is greater than $10^9$ Ωcm, the above-mentioned effects are lowered. If the average particle size is greater than 2 μm and when the BET specific surface area is smaller than 0.1 $m^2/g$ based upon nitrogen adsorption, separation from the toner base material tends to occur, resulting in degradation in durability and damages to a photosensitive member.

Moreover, metal oxide fine powder, composed of titanium oxide and/or silica oxide fine powder that have been subjected to a surface coating process by a mixture of tin oxide and antimony having a BET specific surface area of 1 to 200 $m^2/g$ based upon nitrogen adsorption may be contained therein together with silica that has less residual components having a bone structure of polydimethyl siloxane; thus, it becomes possible to stabilize charging property, to improve waste toner recycling property, and also to improve transferring property. In particular, at the time of waste toner recycling, it is possible to stabilize the charge, to prevent filming and to properly maintain the charge even during a long-term continuous use in a low humidity environment. If the value is greater than 200 $m^2/g$, the mixing process is not carried out evenly, and when it is smaller than 1 $m^2/g$, separation from the toner increases, resulting in degradation in toner durability.

The addition amount of the metal oxide fine powder and/or metal acid salt fine particle to be externally added to the toner is preferably from 0.1 to 5 parts by weight based on 100 parts by weight of the toner base material. The value smaller than 0.1 fails to exert the functions, and the value greater than 5 causes degradation in moisture-resistant property.

In the case when the toner is used as a two-component developer, it is preferable to use a carrier that consists of a magnetic material coated with a resin containing conductive fine powder. As to the conductive fine powder to be used, examples thereof include metal powder and carbon black, conductive oxides such as titanium oxide and zinc oxide, and materials in which the surface of powder, such as titanium oxide, zinc oxide, barium sulfate, aluminum borate and potassium titanate, is coated with tin oxide, carbon black or metal, and its resistivity is preferably not more than $10^{10}$ Ωcm.

Examples of the carrier core material which is set to have an average particle size of 20 to 100 μm, preferably, 30 to 80 μm, more preferably, 30 to 60 μm include: metal powder of magnetite, iron, manganese, cobalt, nickel, chromium and magnetite, and alloy of these, chromium oxide, diiron trioxide, triiron tetroxide, Cu—Zn ferrite, Mn—Zn ferrite, Ba—Ni ferrite, Ni—Zn ferrite, Li—Zn ferrite, Mg—Mn ferrite, Mg—Zn—Cu ferrite, Mn ferrite, Mn—Mg ferrite and Li—Mn ferrite. In particular, among these, those Mn ferrite, Mn—Mg ferrite and Li—Mn ferrite having a volume resistivity of $10^8$ to $10^{14}$ Ωcm are preferably used from the viewpoint of environmental protection, and these materials also form a shape close to the true spherical shape as compared with that of Cu—Zn type materials. The average particle size smaller than 20 μm causes increase in the carrier adhesion. The average particle size greater than 100 μm makes it difficult to obtain images with high precision. The volume resistivity smaller than $10^8$ Ωcm causes an increase in the carrier adhesion, and the volume resistivity greater than $10^{14}$ Ωcm causes degradation in image density due to an overcharge in the developer.

In order to form a coated layer over the core of the carrier, known coating methods, such as a dipping method for dipping powder serving as the carrier core material in a coated layer-forming solution, a spraying method for atomizing a coat-forming solution onto a surface of the carrier core, a fluidized bed method for atomizing a coated layer-forming solution on the carrier core with the carrier core being floated by fluidizing air, and a kneader coater method in which the carrier core and a coat-layer forming solution are mixed in a kneader coater and the solvent is then removed.

As to the resin used for the carrier coated layer, examples thereof include straight silicone resins composed of organosiloxane bonds and modified products thereof, such as alkyd-modified, epoxy-modified and urethane-modified products, fluororesin, styrene resin, acrylic resin, methacrylic resin, polyester resin, polyamide resin, epoxy resin, polyether type resins and phenol type resins; and these may be used alone, or may be used in combination. Moreover, these may be used as copolymers.

Here, it is effective to use a coating layer formed by mixing a silicone-type resin and an acrylic resin. In particular, a mixed-type resin in which a straight silicone resin consisting of only alkyl groups having carbon atoms of 1 to 4 with side chain groups consisting of methyl groups, etc., a straight silicone resin containing phenyl groups in its side chain groups and a (meth)acrylic resin are mixed, is preferably used.

It is preferable to use an ambient temperature curing type silicone resin based on the silicone-type resin. Example thereof include: KR271, KR255, KR152 (made by Shinetsu Kagaku K.K.), and SR2400, SR2406, SH840 (made by Toray Silicone K.K.). Examples of acrylic resins include: polymer resins of alkyl (meth)acrylate, such as (meth) acrylic acid, methyl (meth)acrylate, ethyl (meth)acrylate, butyl (meth)acrylate, dodecyl (meth)acrylate, octyl (meth) acrylate, isobutyl (meth)acrylate and 2-ethylhexyl (meth) acrylate. Moreover, the characteristics are further improved by using a resin composed of an alkyl (meth)acrylate polymer having long chain alkyls having carbon atoms of 14 to 26, as the coating layer.

Electrophotographic Apparatus

The present invention is preferably used for an electrophotographic apparatus provided with a toner transfer system in which: paper is fed between a photosensitive member and a conductive elastic roller, and transfer bias voltage is applied to the conductive elastic roller so that a toner image on the image-bearing member is transferred onto the paper through an electrostatic force. Such a toner transfer system, which is a contact transfer system, tends to have problems in which: reversely polarized toner adhering to a surface of a photosensitive member, which should not be transferred, is transferred due to mechanical force other than the electric force exerted on a transfer process, or with no paper being fed, toner adhering to a surface of a photosensitive member causes contamination on a surface of a transfer roller to contaminate a rear face of a paper.

Therefore, toner materials of the present invention are used, and a kneading process of the present invention is applied thereto so that it becomes possible to prevent filming from occurring on an intermediate transfer member and a photosensitive member, to stabilize charging property, to prevent void images at the time of transferring, and consequently to obtain high transferring efficiency. Moreover, it is possible to prevent contamination on transfer paper caused by useless toner particles. Furthermore, it is also possible to prevent filming on a surface of a transfer roller due to a toner and isolated silica, and consequently to prevent an image loss caused by a toner, isolated silica and a fixing adjuvant that are retransferred from a surface of a transfer roller to a surface of a photosensitive member. Here, as to small particle-size toners, it is possible to more appropriately stabilize their characteristics.

Moreover, the present invention is suitably applied to an electrophotographic apparatus provided with a waste toner recycling system for collecting residual toner on an image-bearing member after a transferring process into a developing device and for using this again in the developing process. In the case when waste toner is reused in a developing process, silica particles that have been isolated due to mechanical impacts exerted in a cleaning device when they are collected from a cleaning device to the developing device, in a transporting tube connecting a cleaning device to a developing device and inside the developing device, are dropped out or cause filming on a photosensitive member.

Therefore, a toner materials of the present invention are used and the kneading process of the present invention is applied thereto so that the fixing adjuvant is evenly dispersed and unevenly dispersed particles are reduced; thus, even when waste toner is recycled, it is possible to prevent fogging caused by fluctuations in charging quantity distribution. Moreover, it is possible to stabilize charging property and fluidity, and consequently to stabilize charging property even in the case of a long-term continuous use.

The present invention is also preferably applied to a mono-component developing system. In this developing system, a supply roller made of an urethane resin and a developing roller made of a silicone resin or an urethane resin are made into contact with each other with a predetermined biting amount (0.1 to 1 mm); and in this state, toner is supplied from a supply roller to a developing roller and an elastic rubber or a doctor blade made of metal stainless is allowed to contact a surface of a developing roller to form a toner thin film thereon, and while this is maintained in contact state or non-contact state with a photosensitive member, DC or AC voltage is applied thereto so as to form a toner image. At this time, a supply roller and a developing roller are rotated in the same direction, and the peripheral speeds of the developing roller and the supply roller are set at a ratio from 1:1 to 0.8:0.2 so as to allow the developing roller to rotate faster. Moreover, a developing roller is pressed to contact a surface of a photosensitive member with a pressure of $9.8\times10^2$ to $9.8\times10^4$ ($N/m^2$) so that an electrostatic latent image on a photosensitive member is developed. Here, the elastic blade is made in contact with a developing roller with a pressure of $5\times10^3$ to $5\times10^5$ ($N/m^2$) so that a toner layer is formed thereon.

At this time, aggregation due to thermal fusion tends to occur in a toner because of sliding friction between a supply roller and a developing roller. Consequently, scratches occur on a developing roller, resulting in image noise. Moreover, when there are fluctuations in the toner charging property during a long-term use, the supply of toner from a supply roller to a developing roller becomes unstable, causing degradation in image density and fogging.

Here, the application of the toner materials and kneading method of the present invention makes it possible to convert a high molecular weight component into a low molecular weight component having a proper size so that generation of scratches is prevented and aggregation due to thermal fusion is also prevented. Moreover, since colorant, a charge control agent and a fixing adjuvant are evenly dispersed in a toner, it is possible to stabilize charge, to reduce generation of fogging, and consequently to stabilize image quality even during a long-term use.

Moreover, the present invention is also preferably applied to an electrophotographic apparatus provided with a transfer system having an arrangement in which: a surface of an intermediate transfer member having an endless shape is allowed to contact a surface of a photosensitive member so that a toner image formed on a surface of the photosensitive member is transferred on a surface thereof, and this primary transfer process is repeatedly executed several times, and superimposed toner images, thus transferred on a surface of the intermediate transfer member after the repeated primary transfer processes, are transferred on paper in one batch during a secondary transfer process. In this case, a photosensitive member and the intermediate transfer member are made in contact with each other with a pressure of $9.8\times10^2$ to $2\times10^5$ ($N/m^2$) so that a toner on the photosensitive member is transferred. Moreover, the toner image formed on a surface of the intermediate transfer member is transferred onto recording paper while the transfer member is pressed onto a surface of the intermediate transfer member with a pressure of $5\times10^3$ to $2\times10^5$ ($N/m^2$) with the recording paper being interpolated in between.

Here, the toner materials of the present invention are used and a kneading process of the present invention is applied thereto so that it becomes possible to prevent occurrence of filming, to stabilize charging property, to prevent void images at the time of transferring, and consequently to obtain high transferring efficiency. Moreover, it is possible to prevent contamination on transfer paper caused by useless toner particles. Furthermore, it is also possible to prevent filming on a surface of a transfer member due to toner and isolated fixing adjuvant, and consequently to prevent an image loss caused by a toner and isolated silica that are retransferred from a surface of a transfer member to a surface of a photosensitive member. Here, as to small particle-size toners, it is possible to more appropriately stabilize their characteristics.

Moreover, the present invention is suitably applied to a color electrophotographic apparatus having an arrangement in which: a group of movable image-forming units, each having a rotative photosensitive member and a developing means having a toner with a color different from each other so as to form a toner image having different color on a photosensitive member, are arranged in ring shape, and the group of image-forming units as a whole are rotated and shifted so that the toner images having respectively different colors on the photosensitive members are positioned on copy material and transferred thereon in a superposed manner to form a color image. However, since the image-forming unit itself is revolved, waste toner, after having been cleaned and separated from a photosensitive member, inevitably adheres again temporarily to a photosensitive member repeatedly. Since waste toner repeats adhesion and separation to and from a photosensitive member, an photosensitive member is susceptible to filming, and this causes a short service life of a photosensitive member. Moreover, since the image-forming unit is rotated, with the result that the toner is moved up and down frequently, the toner tends to be spilled from the sealing portion; consequently, the sealing needs to be tightened at the sealing portion, and a fusing phenomenon tends to occur, resulting in lumps and the subsequent image noise such as black lines and white lines. Furthermore, the toner is always separated from a developing roller temporarily; therefore, in the case of a poor rising property of a charge during the initial stage of the developing process, background fogging tends to occur. In the case of a toner containing insufficiently dispersed wax that is located in a biased manner, rising property of charge tends to deteriorate correspondingly.

Here, the application of the toner materials and kneading method of the present invention makes it possible to evenly disperse a fixing adjuvant as well as a charge control agent, and the application of the suitable materials makes it possible to improve rising property of a charge, and consequently to eliminate generation of background fogging during the initial stage of a developing process. Moreover, existence of a high molecular weight component makes it possible to prevent generation of filming and fusing, and consequently to provide stable developing characteristics for a long time.

EXAMPLES

Next, referring to Examples, the following description will discuss the present invention in detail.

Table 1 and Table 2 show conditions of a kneading process.

TABLE 1

| Kneading condition | Binder resin | Tfb (° C.) | Tm (° C.) | Tg (° C.) | Trj1 (° C.) | Trj2 (° C.) | Trk1 (° C.) | Tr2 (° C.) |
|---|---|---|---|---|---|---|---|---|
| Q-1 | PES-1 | 96.0 | 115.0 | 58.0 | 75 | 55 | 30 | 20 |
| Q-2 | PES-2 | 100.0 | 118.0 | 61.0 | 80 | 60 | 25 | 10 |
| Q-3 | PES-3 | 85.0 | 104.0 | 55.5 | 60 | 40 | 20 | 6 |
| Q-4 | PES-4 | 95.0 | 110.8 | 57.3 | 75 | 55 | 30 | 20 |
| Q-5 | PES-5 | 96.2 | 107.5 | 57.3 | 60 | 40 | 20 | 6 |
| Q-6 | PES-6 | 95.6 | 109.0 | 55.0 | 70 | 40 | 20 | 6 |
| q-7 | pes-7 | 85.0 | 100.0 | 54.0 | 110.0 | 110.0 | 110.0 | 50.0 |

TABLE 2

| Kneading condition | Hrt1 (° C.) | Rw1 ($min^{-1}$) | Rw2 ($min^{-1}$) | Rw1/ Rw2 | Dr1 (A) | Dr2 (A) | Dr1/ Dr2 |
|---|---|---|---|---|---|---|---|
| Q-1 | 95.0 | 95.0 | 50.0 | 1.9 | 29.2 | 12.1 | 0.4 |
| Q-2 | 99.0 | 70.0 | 30.0 | 2.3 | 17.1 | 10.0 | 0.6 |
| Q-3 | 94.0 | 95.0 | 65.0 | 1.5 | 31.0 | 16.5 | 0.5 |
| Q-4 | 102.0 | 75.0 | 50.0 | 1.5 | 25.2 | 12.5 | 0.5 |
| Q-5 | 102.0 | 80.0 | 40.0 | 2.0 | 24.9 | 10.0 | 0.4 |
| Q-6 | 94.0 | 75.0 | 65.0 | 1.2 | 22.5 | 12.5 | 0.6 |
| q-7 | 105.0 | 60.0 | 60.0 | 1.0 | 19.0 | 15.0 | 1.3 |

Rw1 represents speed of revolution a minute of the roll (RL1),
Rw2 represents a speed of revolution a minute of the roll (RL2),
Dr1(A) is a load current value of the roll (RL1) at the time of rotation, and
Dr2(A) is a load current value of the roll (RL2).

Rw1 represents speed of revolution a minute of the (RL1), Rw2 represents a speed of revolution a minute of the roll (RL2), Dr1(A) is a load current value of the roll (RL1) at the time of rotation, and Dr2(A) is a load current value of the roll (RL2).

Trj1 (° C.) is a roll temperature at the front-half portion of the roll (RL1), Trk1 (° C.) is a roll temperature at the rear-half portion of the roll (RL1), and Tr2(° C.) is a roll temperature of the roll (RL2).

Hrt1 (° C.) is a surface temperature of a toner melt film formed on a surface of the roll (RL1) by melted toner material.

Trj2(° C.) is a roll temperature at the front-half portion of the roll (RL1) at the time when the roll temperature of the front-half portion of the roll (RL1) is changed after the toner melt layer has been formed on the roll (RL1).

Tfb(° C.), Tm(° C.) and Tg(° C.) show the flowing start temperature, softening point and glass transition point of the binder resin respectively.

In the present Example, based on the falling point of the toner material, it is set to a point in the vicinity of 700 from the point at which the two rolls are located closest to each other. The opening of the material supply feeder through which the toner constituent material is dropped is from 7 cm in the length along the roll (RL1) axis direction, which is the same length as the radius of the roll (RL1).

A square cover, each side having 10 cm, is placed above the inlet opening of the material supply feeder. The cover is preferably set so as to have a side that is not less than the side length of the opening, and based on the area ratio of squares having the side defined as one side, it is preferably not less than 1.2 times. The point is preferably set at a position that covers the contact point of the two rolls. This arrangement is made because the scattering and floating of the material is most frequently raised at this position.

Table 3 shows the characteristics of the binder resin to be used in this Example. As to the resin, polyester resin, which is mainly composed of an bisphenol A propyl oxide adduct, terephthalic acid, trimellitic acid and succinic acid, is used, and the resin is modified in its thermal characteristics depending on the blending ratio and polymerization conditions, and used.

PES-2 is made from a urethane-modified polyester resin in which diphenylmethane-4,4'-diisocyanate is used so as to exert a urethane extension. To a four-neck flask provided with a reflux condenser, a water separation device, a nitrogen gas inlet tube, a thermometer and a stirrer were loaded predetermined amounts of dicarboxylic acid and diol, and this was subjected to a dehydrated polycondensation at 240° C. with nitrogen being introduced to the flask to obtain a polyester resin. Then, after the inner temperature had been cooled to 140° C., xylene was added thereto to obtain a xylene solution of the polyester resin. To 100 parts by weight of this solid component was added a predetermined amount of diisocyanate so as to react for 4 hours, and after confirming that the melt viscosity had no longer changed with time, a vacuum de-solvent device was attached to the flask so that xylene was distilled and removed under a high-temperature vacuumed condition, thereby obtaining a urethane-modified polyester resin.

TABLE 3

| | Resin | | | | | | |
|---|---|---|---|---|---|---|---|
| | PES-1 | PES-2 | PES-3 | PES-4 | PES-5 | PES-6 | pes-7 |
| Mnf($\times 10^4$) | 0.32 | 0.32 | 0.59 | 0.52 | 0.32 | 0.57 | 0.23 |
| Mwf($\times 10^4$) | 6.40 | 10.20 | 5.91 | 4.40 | 2.10 | 5.60 | 1.40 |
| Mzf($\times 10^4$) | 97.50 | 302.50 | 40.50 | 31.00 | 26.50 | 31.50 | 7.40 |
| Wmf = Mwf/Mnf | 20.00 | 31.88 | 10.02 | 8.46 | 6.56 | 9.82 | 6.09 |
| Wzf = Mzf/Mnf | 304.69 | 945.31 | 68.64 | 59.62 | 82.81 | 55.26 | 32.17 |
| Tg | 58.00 | 61.00 | 55.50 | 57.30 | 57.30 | 55.00 | 54.00 |
| Tm | 115.00 | 118.00 | 105.00 | 110.80 | 107.50 | 109.00 | 100.00 |
| Tfb | 100.00 | 101.00 | 90.00 | 95.00 | 96.20 | 95.60 | 85.00 |

Mnf represents the number average molecular weight of the binder resin,
Mwf represents the weight average molecular weight of the binder resin,
Wmf represents a ratio Mwf/Mnf between the weight average molecular weight Mwf and the number average molecular weight Mnf,
Wzf represents a ratio Mzf/Mnf between the Z average molecular weight Mzf and the number average molecular weight Mnf of the binder resin.

Table 4 shows hydrophobic silica used in the present Example.

TABLE 4

| Hydrophobic silica | Material | BET value ($m^2/g$) |
|---|---|---|
| SG-1 | Silica treated by amino-modified silicone oil | 140 |
| SG-2 | Silica treated by dimethylsilicone oil | 150 |
| SG-3 | Silica treated by dimethylsilicone oil with a silanol group positioned on its end | 100 |
| SG-4 | Silica treated by methylphenyl silicone oil | 200 |
| sg-5 | Silica treated by dichlorodimethyl silane | 50 |

As to silica, silica fine powder (100 g) was dispersed in a solution prepared by dissolving 5 g of silicone oil in 1 litter of toluene, and this was subjected to a hydrophobic property-applying process through a spray drying process. As to SG-1, 2, after the process, this was washed with a benzene solvent. As to SG-4, this was removed by heat through a hot-air blow. As to SG-3, dimethyl silicone oil with a silanol group positioned at each of the ends, which was highly reactive, was used.

Table 5 shows metal oxide fine powder or metal acid salt fine powder used in the present Example.

TABLE 5

| Second external additive agent | Material | Average particle size (μm) | BET value ($m^2/g$) |
|---|---|---|---|
| G-1 | Barium titanate formed by hydrothermal synthetic method | 0.2 | 5.04 |
| G-2 | Strontium zirconate formed by the oxalic acid thermal decomposition method | 0.67 | 2.63 |
| G-3 | Titanium oxide | 0.05 | 30.5 |
| G-4 | Zirconium oxide | 0.2 | 6.5 |
| G-5 | Indium oxide | 0.1 | 10.5 |
| G-6 | Silica oxide subjected to a surface coating treatment by tin-oxide-antimony | 0.04 | 83.2 |

Table 6 shows a charge control agent used in the present Example.

TABLE 6

| Material No. | Composition | Material |
|---|---|---|
| CCA1 | Gold azo dye containing Cr | S34 (Orient Chemical K.K.) |
| CCA2 | Metallic salt of a derivative of salicylic acid | E-81 (Orient Chemical K.K.) |
| CCA3 | Metallic salt of a derivative of benzilic acid | LR-147 (Japan Carlit Co., Ltd.) |

Table 7 shows pigments used in the present Example.

TABLE 7

| Material No. | Composition |
|---|---|
| CM | Magenta pigment:Pigment Red 57:1 |
| CC | Cyan pigment:Pigment Blue 15:3 |
| CY | Yellow pigment:Pigment Yellow 12 |
| BK | Carbon black MA100A (Mitsubishi Chemical Corporation) |

Table 8 shows Fischer Tropsch wax, meadow-foam oil or jojoba oil derivative.

TABLE 8

| Material No. | Composition | Melting point (° C.) |
|---|---|---|
| W-1 | Fischer Tropsch wax (Sazol wax A1) | 108 |
| W-2 | Extremely hydrogenated meadow-foam oil | 70 |
| W-3 | Extremely hydrogenated jojoba oil | 75 |
| W-4 | Meadow-foam oil fatty acid pentaerythritol monoester | 100 |
| W-5 | Jojoba oil amide | 118 |
| W-6 | Isocyanate polymer of meadow-foam oil fatty acid polyhydric alcohol ester | 121 |

Table 9 shows fatty acid amides used in the present Example.

TABLE 9

| Material No. | Composition | Melting point (° C.) |
|---|---|---|
| W-7 | Stearic acid amide | 110 |
| W-8 | Oleic acid amide | 120 |
| W-8 | Erucic acid amide | 118 |

TABLE 9-continued

| Material No. | Composition | Melting point (° C.) |
|---|---|---|
| W-9 | Ethylenebiserucic acid amide | 127 |
| W-10 | Ethylenebis behenic acid amide | 128 |

Table 10 shows low molecular weight polyolefin containing fluorine used in the present Example.

TABLE 10

| Material No. | Composition | Particle size (μm) | Specific gravity (g/m$^3$) | Tangential line melting point temp. (° C.) | Peak temp. (° C.) | Temp. difference (° C.) |
|---|---|---|---|---|---|---|
| W-11 | Copolymer of polytetrafluoroethylene and polyethylene | 4 | 1.08 | 118 | 125.8 | 7.8 |
| W-12 | Jojoba oil with extreme addition of fluorine | 5.5 | 1.15 | 97.3 | 113 | 15.7 |
| W-13 | Copolymer of polytetrafluoroethylene and acrylate with a long-chain alkyl group of C16 | 6 | 1.2 | 127 | 135 | 8 |
| W-14 | Mixture of polytetrafluoroethylene and polyethylene | 5 | 1.08 | 120 | 127 | 7 |

Table 11 shows toner material compositions used in the present Example. The respective compositions are adjusted so that the toner weight average particle size is from 6 to 7 μm, the fluctuation coefficient of the volume average particle size is from 20 to 25%, and the fluctuation coefficient of the volume average particle size is from 25 to 30%.

As to the blend amount of each of pigments, charge control agents and Waxes, the blend ratio (parts by weight) based on 100 parts by weight of the binder resin is given in parentheses. The second externally additive agents represent the following metal oxide fine powder or metal acid salt fine powder. As to silica and the second externally additive agents, the blend amount (parts by weight) thereof based on 100 parts by weight of the binder resin is given in parentheses.

The externally adding process was carried out by using an FM20B (made by Mitsui Mining Co., Ltd.) under conditions of a stirring blade of Z0S0 type, a number of revolutions of 2000 min$^{-1}$, a processing time of 5 min and the amount of load of 1 kg.

Tables. 12, 13 and 14 show the molecular weight characteristics of toners that have been subjected to a kneading process of the present Example. Toner evaluation was made by using a TM toner of a magenta toner. The same results were obtained in the case of yellow, cyan and black toners. Mnv represents the number average molecular weight of a toner, Mwv represents the toner weight average molecular weight of a toner, Wmv represents a ratio Mwv/Mnv between the weight average molecular weight Mwv and the number average molecular weight Mnv of a toner, and Wzv represents a ratio Mzv/Mnv between the Z average molecular weight Mzv and the number average molecular weight Mnv.

ML represents a molecular weight maximum peak value on the low molecular weight side in molecular weight distribution, MH represents a molecular weight maximum peak value on the high molecular weight side, and MV represents a molecular weight minimum bottom value. Sm represents Hb/Ha, Sn represents (Hb-La)/(Ha-La), SK1 represents M10/M90, and SK2 represents (M10-M90)/M90.

TABLE 11

| Toner | Binder resin | Charge control agent | Pigment | Fixing assistant agent | Hydrophobic silica | Second external additive agent | Kneading condition |
|---|---|---|---|---|---|---|---|
| TM-1 | PES-1 | CCA2(3) | CM(5) | None | SG1(1) | | Q1 |
| TM-2 | PES-2 | CCA2(3) | CM(5) | None | SG2(0.8) | | Q2 |
| TM-3 | PES-3 | CCA2(4) | CM(5) | W-1 | SG3(0.8) | | Q3 |
| TM-4 | PES-4 | CCA2(4) | CM(5) | W-8 | SG4(0.8) | G1(1) | Q4 |
| TM-5 | PES-5 | CCA2(3) + CCA3(2) | CM(5) | W-9 | SG2(0.8) | G2(0.5) | Q5 |
| TM-6 | PES-6 | CCA2(4) | CM(5) | W-1 | SG3(0.8) | G3(1) | Q6 |
| tm-7 | pes-7 | CCA2(2) | CM(5) | | SG5(0.5) | | q7 |
| TY-1 | PES-1 | CCA3(5) | CY(5) | None | SG1(0.7) | | Q1 |
| TY-2 | PES-2 | CCA3(5) | CY(5) | None | SG1(0.7) | | Q2 |
| TY-3 | PES-3 | CCA2(3) | CY(5) | W-2 | SG2(1) | G6(0.7) | Q3 |
| TY-5 | PES-5 | CCA2(3) | CY(5) | W-7 | SG3(0.8) | G4(0.8) | Q5 |
| TY-6 | PES-6 | CCA2(3) + CCA3(2) | CY(5) | W-10 | SG4(0.8) | G5(0.7) | Q6 |
| ty-7 | pes-7 | CCA2(3) | CY(5) | | SG5(0.5) | | q7 |
| TC-1 | PES-1 | CCA2(3) | CM(5) | None | SG1(0.7) | | Q1 |
| TC-2 | PES-2 | CCA2(3) | CM(5) | None | SG1(0.7) | | Q2 |
| TC-3 | PES-3 | CCA2(3) | CM(5) | W-3 | SG2(1) | G1(0.8) | Q3 |
| TC-4 | PES-4 | CCA2(3) + CCA3(2) | CM(5) | W-6 | SG2(0.8) | G3(0.8) | Q4 |
| TC-6 | PES-6 | CCA2(3) | CM(5) | W-13 | SG3(0.8) | G6(0.7) | Q6 |
| tc-7 | pes-7 | CCA2(3) | CM(5) | | SG5(0.5) | | q7 |
| TB-1 | PES-1 | CCA1(2) | BK(5) | None | SG1(0.7) | | Q1 |
| TB-2 | PES-2 | CCA1(2) | BK(5) | None | SG2(1) | | Q2 |
| TB-3 | PES-3 | CCA1(2) | BK(5) | W-4 | SG2(0.8) | G1(0.8) | Q3 |
| TB-4 | PES-4 | CCA1(2) | BK(5) | W-5 | SG3(0.8) | G3(0.8) | Q4 |
| TB-5 | PES-5 | CCA1(2) | BK(5) | W-14 | SG4(0.8) | G6(0.7) | Q5 |
| tc-7 | pes-7 | CCA1(2) | BK(5) | | SG5(0.5) | | q7 |

TABLE 12

| | Toner | | | | | | |
|---|---|---|---|---|---|---|---|
| | TM-1 | TM-2 | TM-3 | TM-4 | TM-5 | TM-6 | tm-7 |
| Mnv($\times 10^4$) | 0.36 | 0.31 | 0.64 | 0.50 | 0.33 | 0.51 | 0.24 |
| Mwv($\times 10^4$) | 2.90 | 4.43 | 3.74 | 2.80 | 1.70 | 3.50 | 1.20 |
| Mzv($\times 10^4$) | 11.30 | 84.60 | 11.80 | 9.40 | 7.70 | 12.97 | 4.90 |
| Wmv = Mwv/Mnv | 8.06 | 14.29 | 5.84 | 5.60 | 5.15 | 6.86 | 5.00 |
| Wzv = Mzv/Mnv | 31.39 | 272.90 | 18.44 | 18.80 | 23.33 | 25.43 | 20.42 |

TABLE 13

| | Toner | | | | | | |
|---|---|---|---|---|---|---|---|
| | TM-1 | TM-2 | TM-3 | TM-4 | TM-5 | TM-6 | tm-7 |
| Mwf/Mwv | 2.21 | 2.30 | 1.58 | 1.57 | 1.24 | 1.60 | 1.17 |
| Mzf/Mzv | 8.63 | 3.58 | 3.43 | 3.30 | 3.44 | 2.43 | 1.51 |
| Wmf/Wmv | 2.48 | 2.23 | 1.71 | 1.51 | 1.27 | 1.43 | 1.22 |
| Wzf/Wzv | 9.71 | 3.46 | 3.72 | 3.17 | 3.55 | 2.17 | 1.58 |

TABLE 14

| | Toner | | | | | | |
|---|---|---|---|---|---|---|---|
| | TM-1 | TM-2 | TM-3 | TM-4 | TM-5 | TM-6 | tm-7 |
| ML | 0.70 | 0.75 | 1.00 | 0.88 | 0.56 | 0.84 | 0.46 |
| MH | 13.10 | 18.00 | 9.00 | 9.20 | 10.00 | 9.90 | 8.90 |
| MV | 8.80 | 8.50 | 5.50 | 5.00 | 7.00 | 6.50 | 5.80 |
| Sm | 0.40 | 0.37 | 0.73 | 0.48 | 0.20 | 0.51 | |
| Sn | 0.17 | 0.17 | 0.18 | 0.04 | | | |
| SK1 | 2.25 | 1.81 | 1.58 | 2.04 | 2.2 | 2.88 | |
| SK2 | 1.25 | 0.81 | 0.58 | 1.04 | 1.21 | 1.89 | |

FIGS. 9 to 20 show molecular weight distribution characteristics.

Figure 9A:
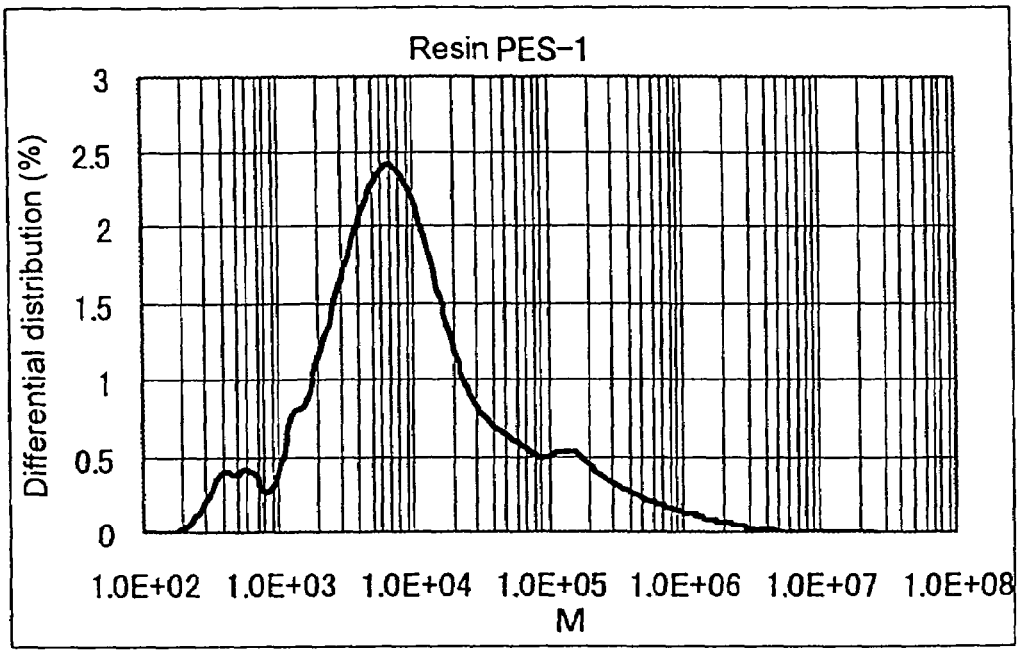
FIGS. 9*a* and 9*b* are graphs that respectively show molecular weight distribution characteristics of a binder resin and a toner in accordance with the present invention.
Figure 9B:
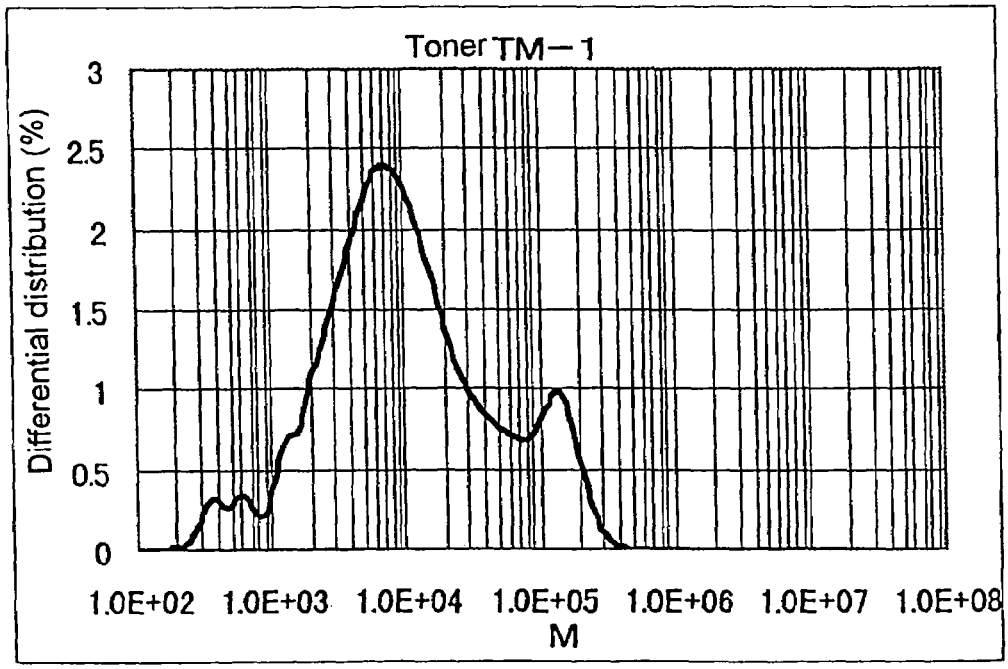
Figure 10A:
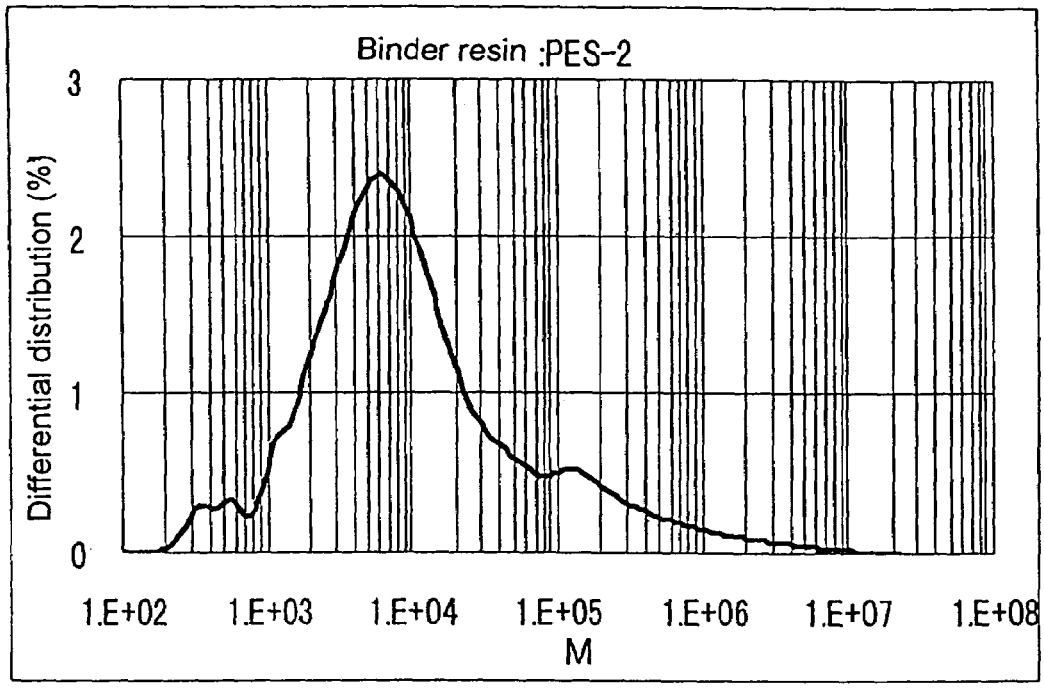
FIGS. 10*a* and 10*b* are graphs that respectively show molecular weight distribution characteristics of a binder resin and a toner in accordance with the present invention.
Figure 10B:
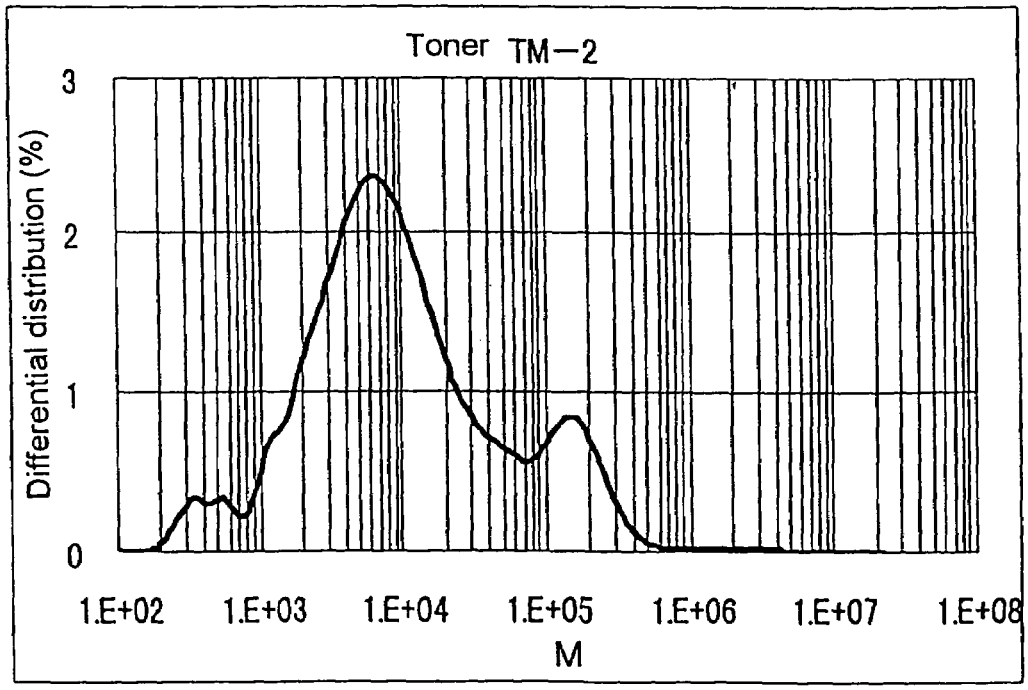
Figure 11A:
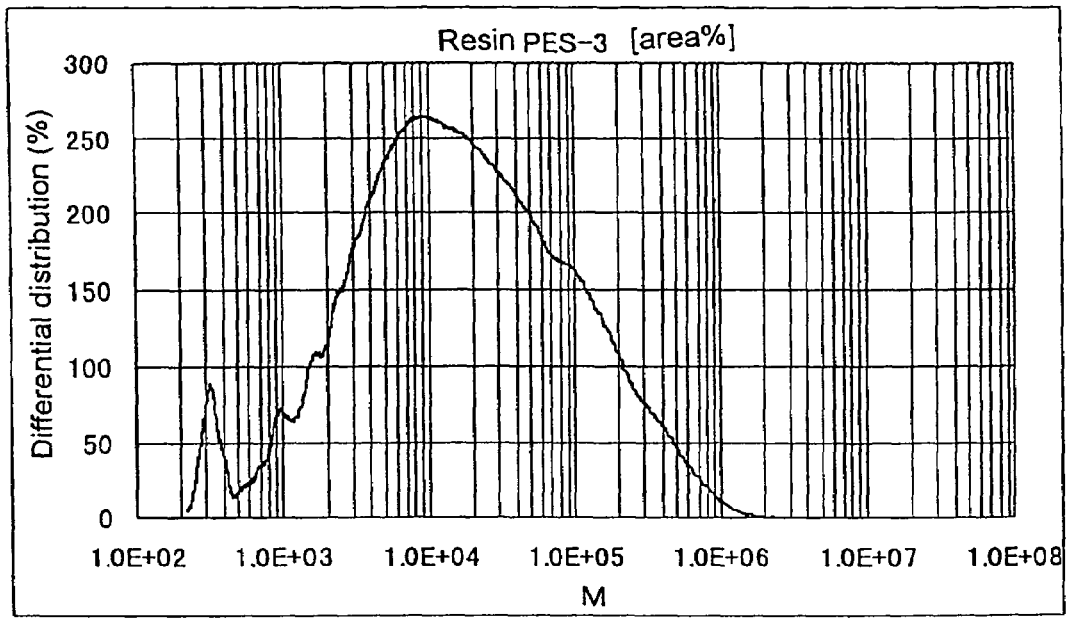
FIGS. 11*a* and 11*b* are graphs that respectively show molecular weight distribution characteristics of a binder resin and a toner in accordance with the present invention.
Figure 11B:
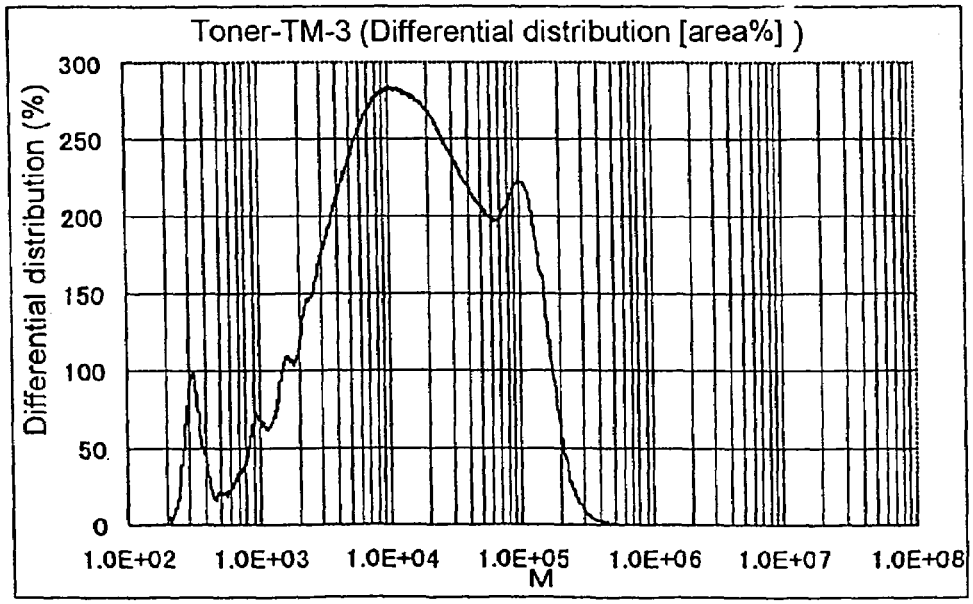
Figure 12A:
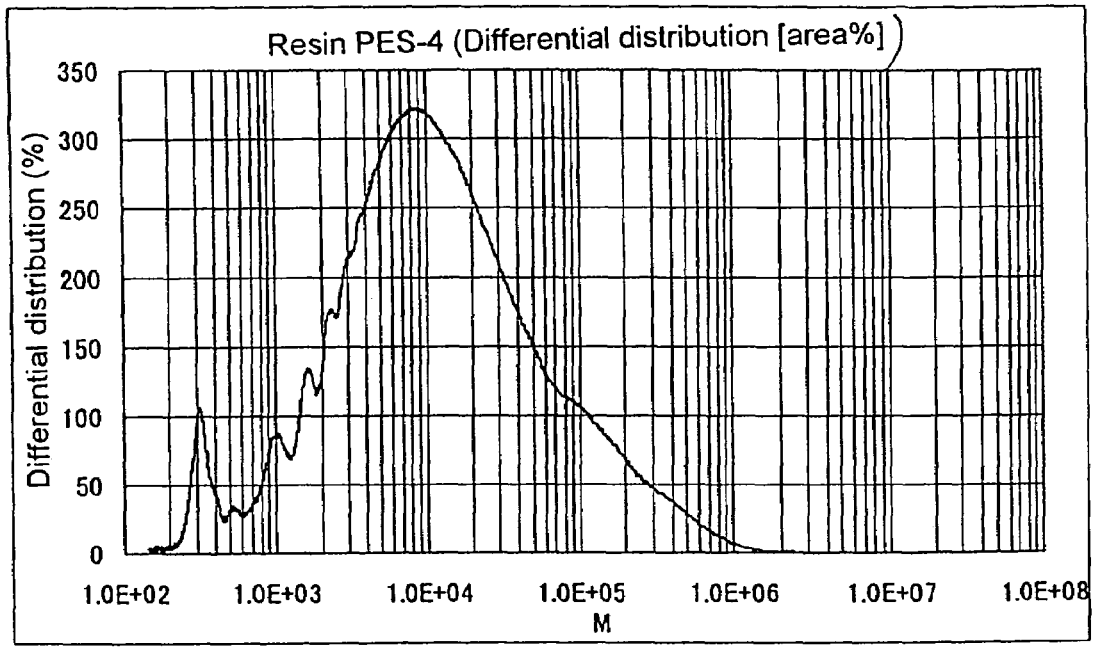
FIGS. 12*a* and 12*b* are graphs that respectively show molecular weight distribution characteristics of a binder resin and a toner in accordance with the present invention.
Figure 12B:
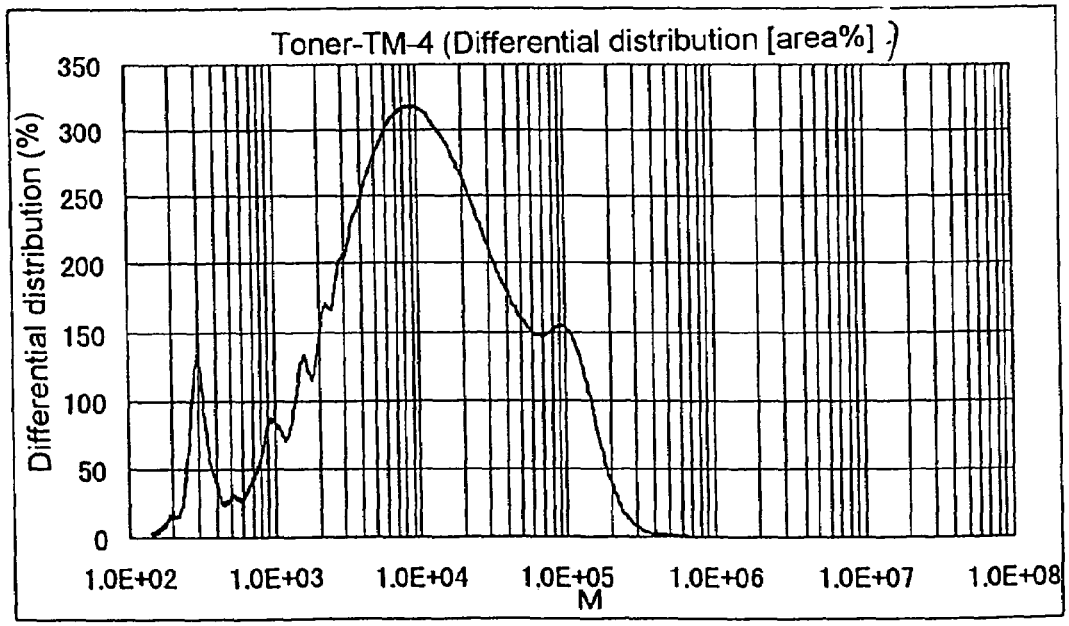
Figure 13A:
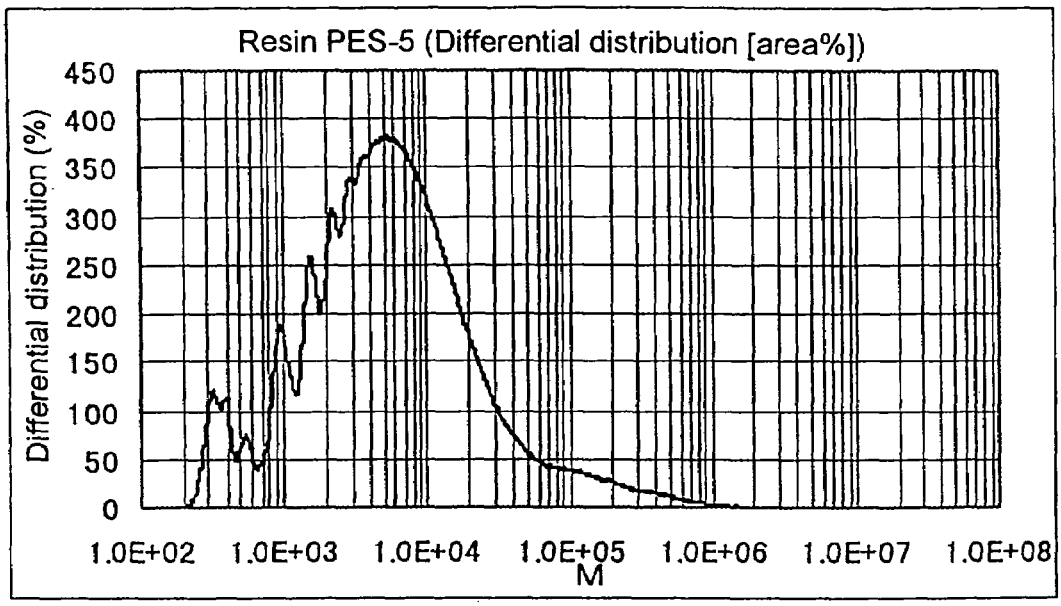
FIGS. 13*a* and 13*b* are graphs that respectively show molecular weight distribution characteristics of a binder resin and a toner in accordance with the present invention.
Figure 13B:
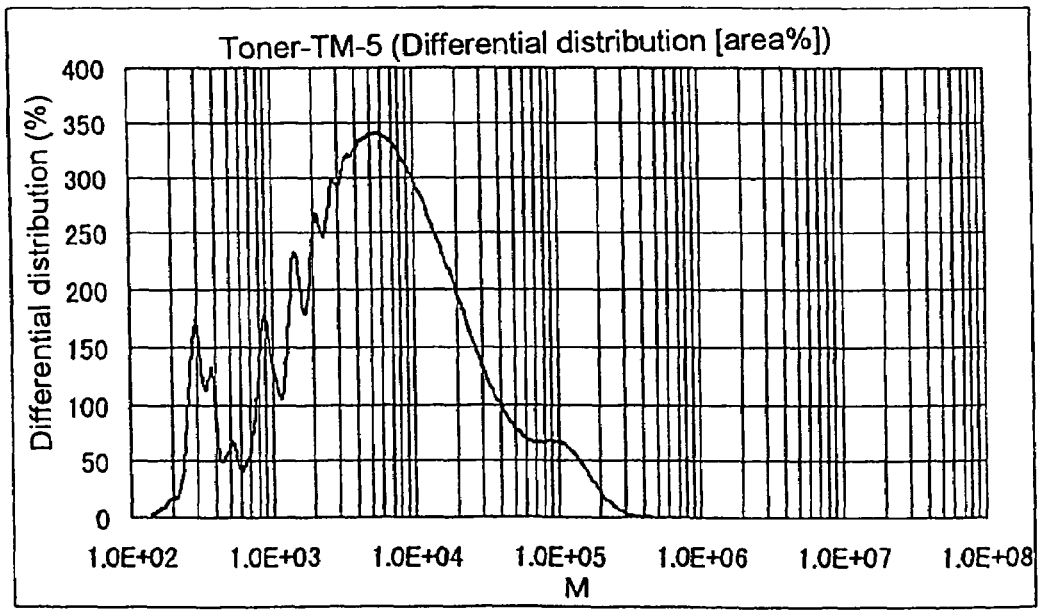
Figure 14A:
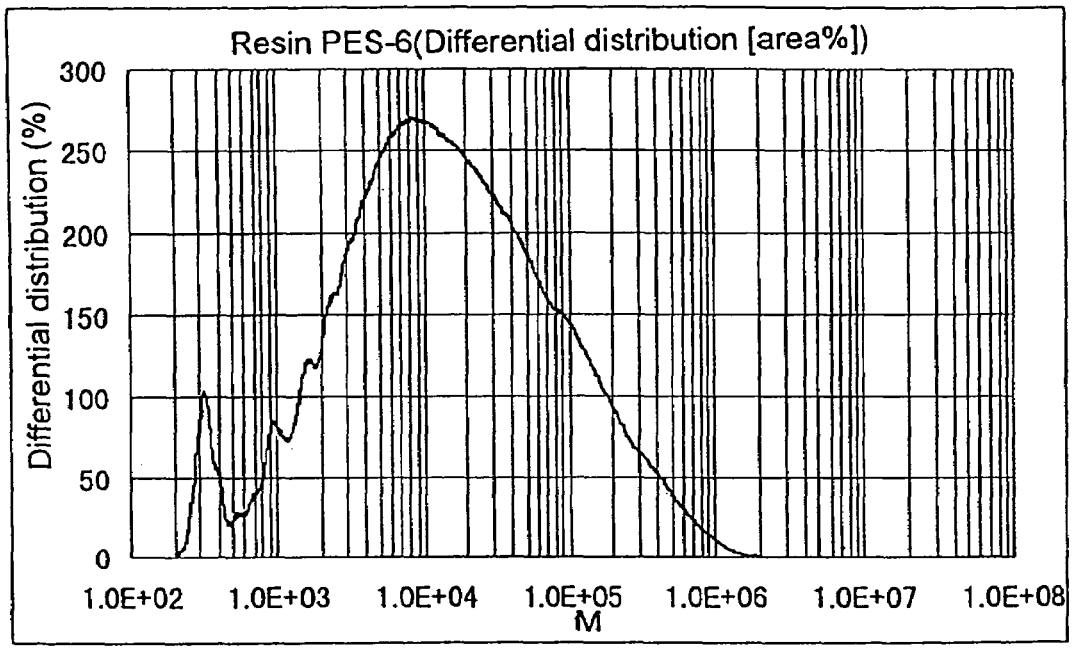
FIGS. 14*a* and 14*b* are graphs that respectively show molecular weight distribution characteristics of a binder resin and a toner in accordance with the present invention.
Figure 14B:
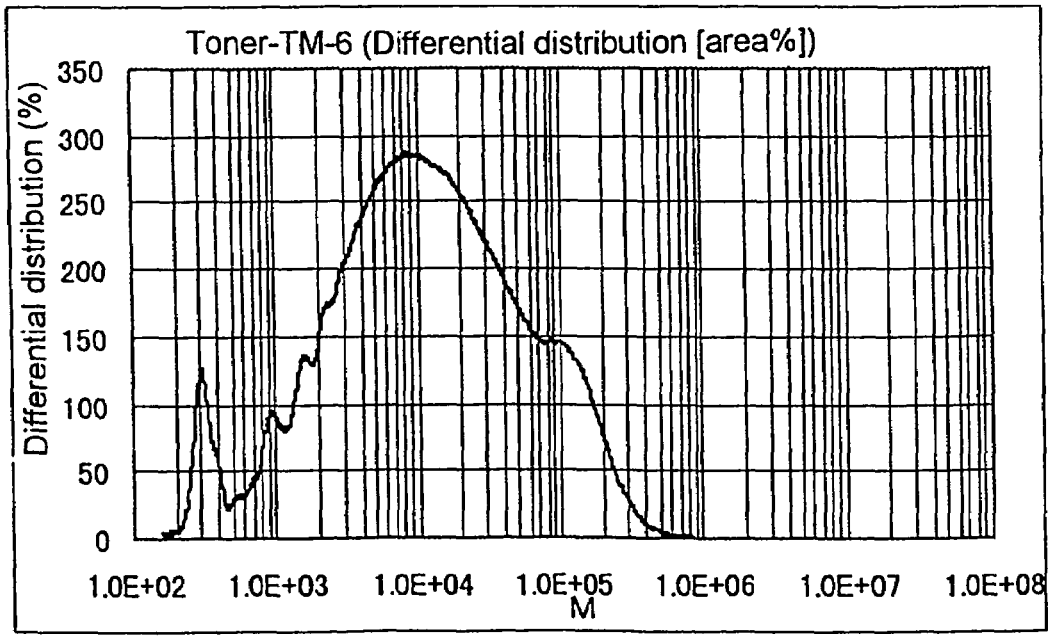
Figure 15A:
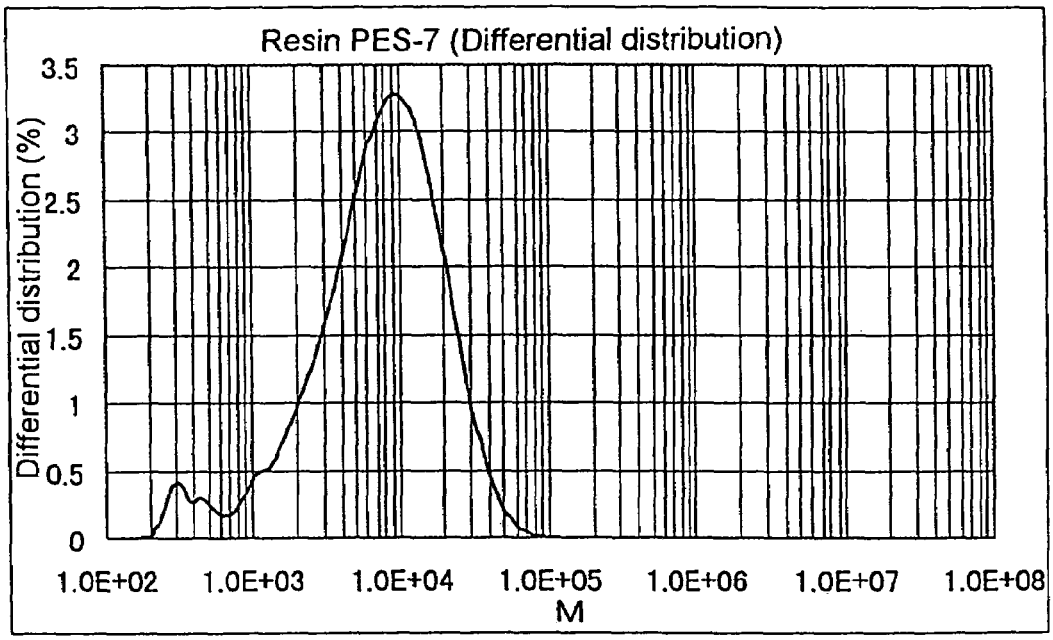
FIGS. 15*a* and 15*b* are graphs that respectively show molecular weight distribution characteristics of a binder resin and a toner in accordance with the present invention.
Figure 15B:
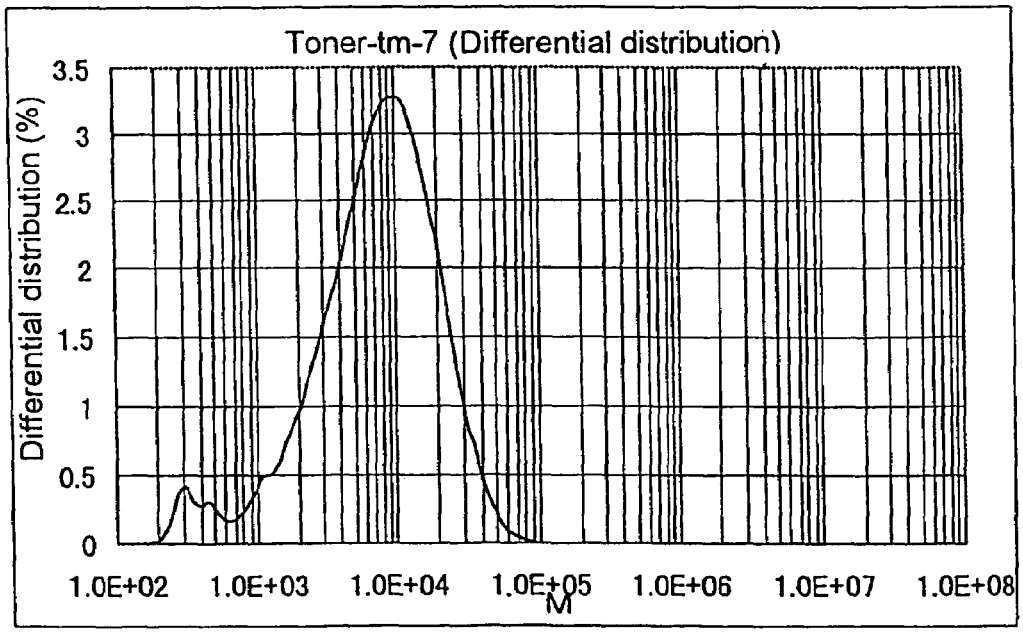

FIGS. 9*a*, 9*b* respectively show molecular weight distribution characteristics of binder resin PES-1 and toner TM-1, FIGS. 10*a*, 10*b* respectively show molecular weight distribution characteristics of binder resin PES-2 and toner TM-2, FIGS. 11*a*, 11*b* respectively show molecular weight distribution characteristics of binder resin PES-3 and toner TM-3, FIGS. 12*a*, 12*b* respectively show molecular weight distribution characteristics of binder resin PES-4 and toner TM-4, FIGS. 13*a*, 13*b* respectively show molecular weight distribution characteristics of binder resin PES-5 and toner TM-5, FIGS. 14*a*, 14*b* respectively show molecular weight distribution characteristics of binder resin PES-6 and toner TM-6, and FIGS. 15*a*, 15*b* respectively show molecular weight distribution characteristics of binder resin pes-7 and toner tm-7.

Binder resin PES-1 has a high molecular weight component of not less than $3\times10^4$ that accounts for not less than 5% in the area ratio based on the entire binder resin molecular weight distribution. Moreover, it also has a high molecular weight component of $3\times10^5$ to $9\times10^6$ that accounts for not less than 1% in the area ratio based on the entire binder resin molecular weight distribution. In the same manner, each of PES-2, 3, 4, 5, 6 also has the high molecular weight component of not less than $3\times10^4$ that accounts for not less than 5% in the area ratio based on the entire binder resin molecular weight distribution. Moreover, each of them has a high molecular weight component of $3\times10^5$ to $9\times10^6$ that accounts for not less than 1% in the area ratio based on the entire binder resin molecular weight distribution. However, resin pes-7 has a high molecular weight component of not less than $3\times10^4$ that only accounts for not more than 5% in the area ratio based on the entire binder resin molecular weight distribution, and does not have a high molecular weight component of $3\times10^5$ to $9\times10^6$.

It is understood that in the respective toners, the high molecular weight component is converted into a low molecular weight component by kneading, and it appears on the high molecule component side as a peak or a shoulder. In other words, the component interfering light-transmittance is eliminated by cutting, and it appears on the high molecular side as an abrupt slope; this is the reason why anti-offset property is maintained without reducing light-transmittance. In toner TM-1, the amount of a high molecular weight component of not less than $3\times10^5$ is not more than 5% in the area ratio based on entire toner molecular weight distribution, and it hardly contains a high molecular weight component of not less than $1\times10^6$. In the same manner, in each of toners TM-2, 3, 4, 5, 6, the amount of a high molecular weight component of not less than $3\times10^5$ is not more than 5% in the area ratio based on entire toner molecular weight distribution, and they do not contain a high molecular weight component of not less than $1\times10^6$.

Figure 16:
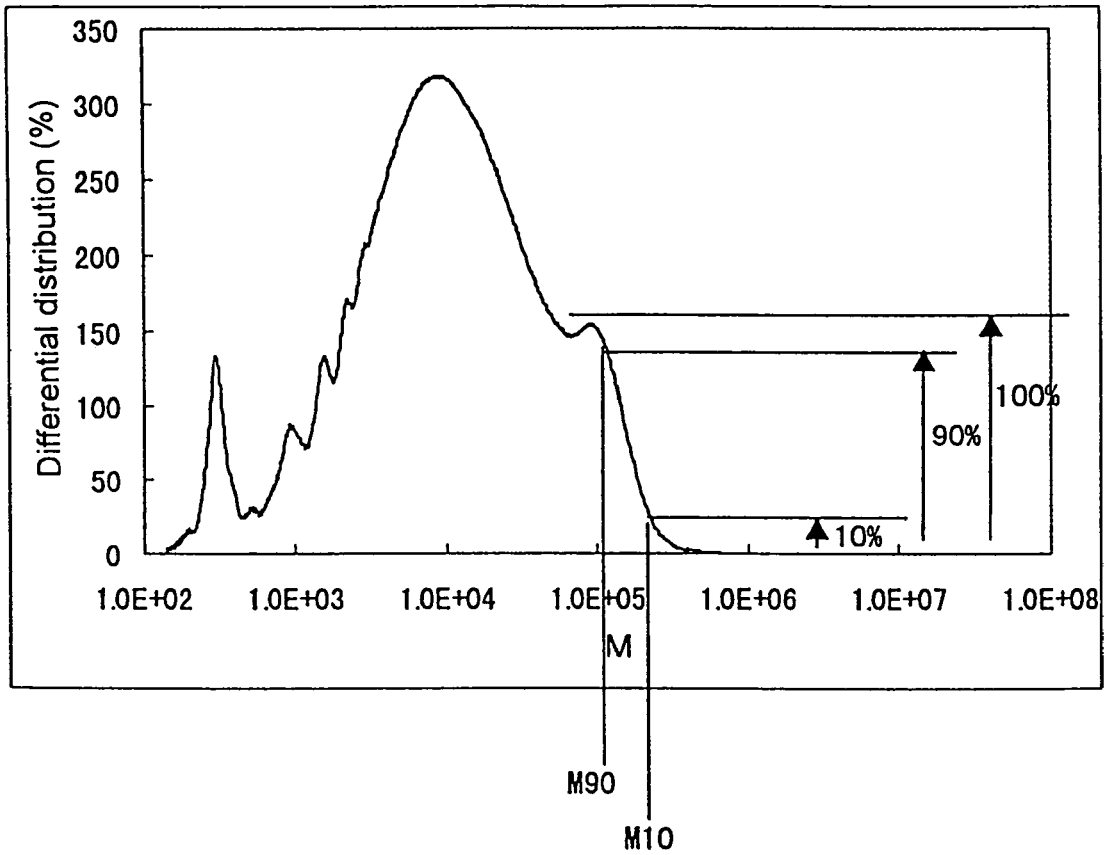
FIG. 16 is a graph that show molecular weight distribution characteristic of a toner in accordance with one example of the present invention.

Moreover, FIG. 16 shows molecular weight distribution characteristics. A thick line in the Figure shows molecular weight distribution characteristics of toner TM-4. It has an abrupt peak on the high molecular weight component side. This is because a high molecular weight component of binder resin PES-4 is converted into a low molecular weight component by kneading and it appears on the high molecular weight component side as an abrupt peak.

In the case when the peak height of the abrupt distribution on the high molecule side is defined as 100%, in a molecular weight curve located in an area greater than the molecular weight value corresponding to the maximum peak or the shoulder, that is, in a portion in this area in which the gradient of molecular weight distribution curve becomes negative, in other words, in a portion on the right side of the distribution curve, supposing that height of the maximum peak of molecular weight distribution or the shoulder is defined as 100%, the molecular weight corresponding to 90% of height of the maximum peak of molecular weight distribution or the shoulder is represented by M90, and the molecular weight corresponding to 10% of height of the maximum peak of molecular weight distribution or the shoulder is represented by M1. Here, the values M10/M90, (M10-M90)/M90 (gradients of molecular weight distribution curve) make it possible to quantify the state of which the ultra-high molecular weight component is converted into a low molecular weight component. The smaller values represent that the gradient of molecular weight distribution curve is abrupt so that the component intervening with light-transmittance is eliminated by cutting to provide a high light transmittance. Moreover, the peak appearing on the high molecule side devotes to improvement of anti-offset property.

Example 1

FIG. 1 is a cross-sectional view that shows structure of an electrophotographic apparatus that is used in the present Example. In the apparatus of the present Example, a copying machine FP7750 (made by Matsushita Electric Industrial Co., Ltd.) is modified into a reverse developing use machine to which a waste toner recycling mechanism is attached.

Reference numeral 301 is an organic photosensitive member that is constituted by an aluminum conductive support member on which a charge generation layer is formed by vapor-depositing oxotitanium phthalocyanine powder thereon, with a polycarbonate resin (Z-200, made by Mitsubishi Gas Chemical Co., Inc.) and a charge carrier layer containing a mixture of butadiene and hydrazone being successively stacked thereon.

Reference numeral 302 is a corona charger that negatively charges a photosensitive member, 303 is a grid electrode for controlling a charge electric potential of a photosensitive member, and 304 is signal light. Reference numeral 305 is a developing sleeve, 306 is a doctor blade, 307 is a magnet roll for holding carrier, 308 is the carrier, and 309 is a toner. The carrier is prepared as follows: a methyl silicone resin, a phenyl silicone resin and butyl acrylate are blended at a ratio of 2:6:2 and this is applied onto a surface of Mn—Mg ferrite particles. The average particle size is from 40 to 60 μm, and the volume resistivity is set at $10^{12}$ Ωcm. As to the toner, TB-1, 2, 3, shown in Table 5, were used.

Reference numeral 310 is voltage generating device, 311 is waste toner remaining after transferring processes, 312 is a cleaning box, 313 is a transporting tube for returning the waste toner 311 in the cleaning box 312 to the developing process. Here, the toner remaining after a transferring process is scraped by the cleaning blade 314, and the waste toner 311, stored in the cleaning box 312 temporarily, is returned to the developing process through the transporting tube 313.

Reference numeral 314 is a transfer roller for transferring a toner image from a photosensitive member onto paper, and its surface is allowed to contact with a surface of a photosensitive member 301. A transfer roller 314 is an elastic roller which is formed by placing a conductive elastic member on the circumference of a shaft made of a conductive metal. The pressing force to a photosensitive member 301 is from 0 to $1.96\times10^5$ N/m$^2$, more preferably, $4.9\times10^3$ to $9.8\times10^4$ N/m$^2$, per transfer roller 314 (approximately, 216 mm). This value was measured by the product of the spring coefficient of a spring for pressing a transfer roller 314 onto a photosensitive member 301 and the amount of compression thereof.

The width of contact to a photosensitive member 301 is set to approximately 0.5 mm to 5 mm. The rubber hardness of a transfer roller 314 is not more than 80 degrees, more preferably, 30 to 70 degrees, in the Asker C measuring method (measurements using not a roller shape but a block piece). The value smaller than 30 degrees causes reduction in the transferring efficiency, resulting in an increase in the amount of waste toner. The value greater than 70 tends to cause void images during the transferring process. The above-mentioned range is essential so as to sufficiently exert the effects of the toner of the present Example in which the internal additive agents are evenly dispersed.

The elastic roller 314 is made from a foam urethane elastomer which has a resistivity set to $10^7$ Ωcm (electrodes are attached to the shaft and a surface and voltage of 500 V is applied thereto) by internally adding lithium salt such as $Li_2O$, and which is placed on the circumference of a shaft having a diameter of 6 mm. The resistivity is preferably from $10^5$ to $10^9$ Ωcm. The value smaller than $10^5$ causes degradation in transferring efficiency and increase in the amount of waste toner. The value greater than $10^9$ Ωcm tends to cause void images during the transferring process. The above-mentioned range is essential so as to sufficiently exert the effects of the toner of the present Example in which the internal additive agents are evenly dispersed.

The outer diameter of the entire transfer roller 213 is 16.4 mm, and the hardness thereof is 40 degrees in Asker C. A transfer roller 314 is made into contact with a photosensitive member 301 by pressing the shaft of a transfer roller 314 by a metal spring. The pressing force is set to $9.8\times10^4$ N/m$^2$. As to the elastic material for the roller, besides the foam urethane elastomer, other materials such as CR rubber, NBR, Si rubber and fluorine rubber, may be used. As to the conductivity-applying agent for applying a conductive property, besides the above-mentioned lithium salt, other conductive materials such as carbon black may be used.

Reference numeral 315 is an insertion guide, made of a conductive member, for introducing transfer paper to a transfer roller 314, and 316 is a transport guide that is formed by coating a surface of a conductive member with an insulating material. The insertion guide 315 and the transport guide 316 are directly grounded, or grounded through resistance. Reference numeral 317 is transfer paper, and 318 is voltage generation power supply for applying voltage to a transfer roller 314.

Table 15 shows the results of image tests.

TABLE 15

| Toner sample | Filming on photo-sensitive member | Image density (ID) Initial/After 100,000 copies | Fogging | Fogging after storage under high humidity | ID under low humidity Initial/ After 1,000 copies |
|---|---|---|---|---|---|
| TB-1 | not generated | 1.48/1.40 | ○ | ○ | 1.3/1.35 |
| TB-2 | not generated | 1.42/1.39 | ○ | ○ | 1.40/1.35 |
| TB-3 | not generated | 1.45/1.42 | ○ | ○ | 1.36/1.32 |
| TB-4 | not generated | 1.42/1.38 | ○ | ○ | 1.38/1.34 |
| TB-5 | not generated | 1.40/1.37 | ○ | ○ | 1.32/1.30 |
| tc-7 | generated | 1.30/1.05 | X | X | 1.28/1.00 |

As to image evaluation, image density and background fogging were evaluated at the initial stage of image formation and after endurance tests of 100,000 copies. Background fogging was visually observed, and when no problem arose in practical use, this was estimated as "passed image" (○).

Thereafter, this was left under high humidity and image tests of 1,000 copies were carried out to check increase of fogging. If the toner density control becomes insufficient and over-toner occurs, fogging increases to a great degree. Therefore, observation was carried out to check this phenomenon. Moreover, in another experiment, this was left under high temperature and high humidity for one night, and image tests of 5,000 copies were carried out on the following day; thus, image density after 5,000 copies was evaluated.

None of lateral line disturbances, toner scattering, insufficient transferring, stains on the rear face and void character images occurred, uniform solid black images were obtained, and images with a high density of not less than 1.3 were obtained. No background fogging occurred on non-image portions. Filming was not observed on a surface of a photosensitive member, and copied images with high density and low background fogging that were as good as the initial image were obtained. Even under high humidity, no fogging generated, and even under high temperature and low humidity, no reduction in the density occurred.

Table 16 shows the results of evaluations carried out on the high-temperature anti-offset property in a low-speed machine (processing speed 140 mm/s) and fixing property based on fixing rates in a high-speed machine (450 mm/s). No problem arises in practical use when the fixing rate is not less than 80% and when, based on high-temperature anti-offset property, no offset occurs up to 180° C. In the storing test, observation was carried out on the degree of aggregation of toner that had been left at 50° C. for 24 hours; and ○ indicates no problem in practical use without aggregation, while x indicates that problems arise in practical use.

TABLE 16

| Toner sample | High-temperature offset | Fixing rate | Storing property |
|---|---|---|---|
| TB-1 | not generated up to 240° C. | 92% | ○ |
| TB-2 | not generated up to 240° C. | 94% | ○ |
| TB-3 | not generated up to 240° C. | 93% | ○ |
| TB-4 | not generated up to 240° C. | 93% | ○ |
| TB-5 | not generated up to 240° C. | 94% | ○ |
| tc-7 | occurred in all the temperature area | 95% | X |

The processing speed relates to a copy processing capability of a machine per time, and represents a peripheral speed of a photosensitive member. The transporting speed of transfer paper is determined by the peripheral speed of a photosensitive member.

Transfer paper of 80 g/m$^2$ (Igepa) was used, and the fixing rate was measured as follows: patches having image density of 1.0±0.2 were aligned, and each row was rubbed by a weight of 500 g (ø 36 mm) with Bencot (trade name, made by Asahi Kasei K.K.) wound around it, ten times reciprocally; then, the image densities before and after the rubbing process were measured by using a Macbeth reflection densitometer, and the rate of change was adopted.

As to the high-temperature anti-offset property at a low speed and the fixing rate at high a speed, good characteristics were exerted; thus, it became possible to use a single toner in both of a high-speed machine and a low-speed machine.

Example 2

Figure 2:
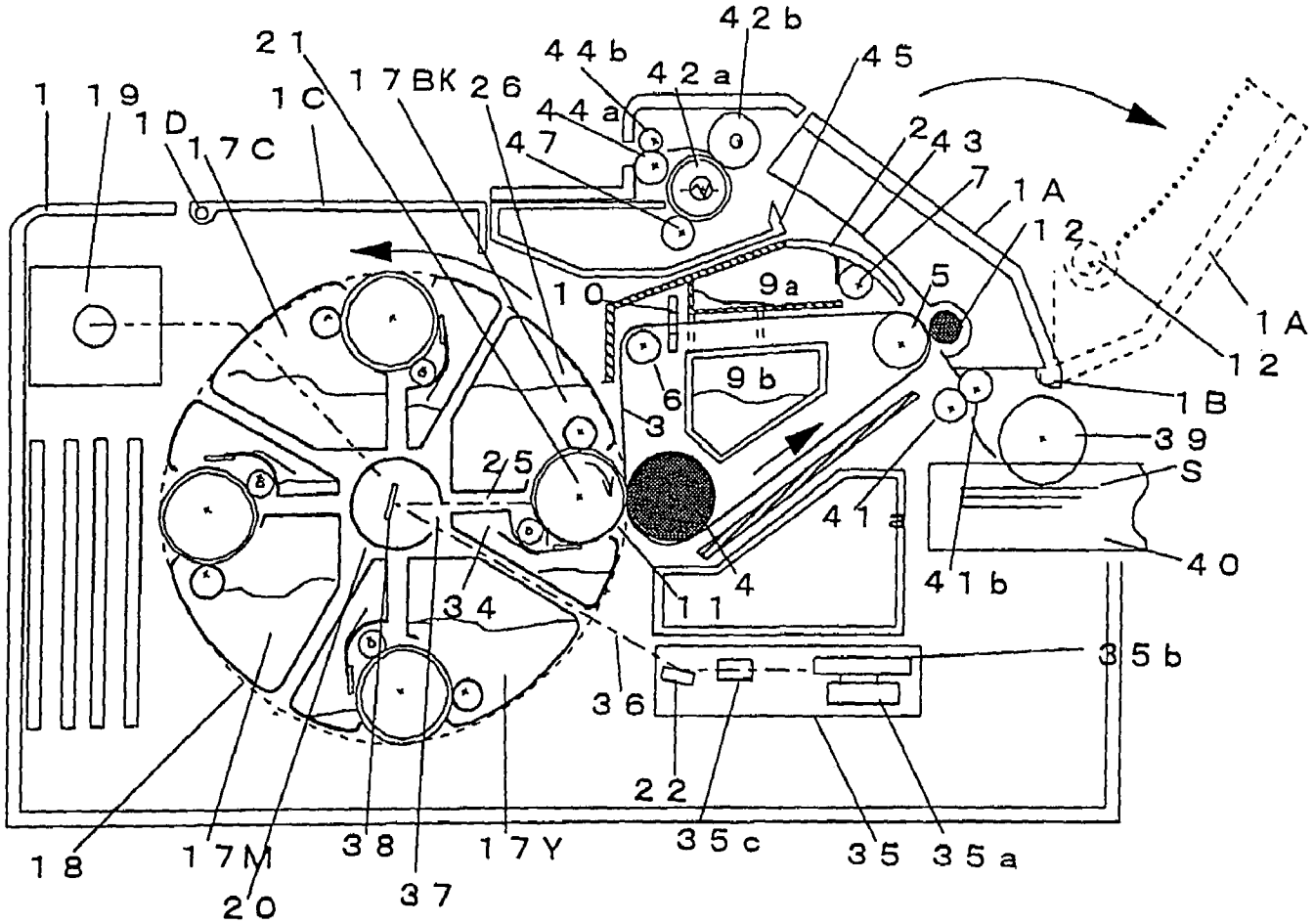
FIG. 2 is a cross-sectional view that shows structure of an electrophotographic apparatus used in an example of the present invention.

FIG. 2 is a cross-sectional view that shows structure of an electrophotographic apparatus for use in full-color image formation that is used in the present Example. In FIG. 2, reference numeral 1 is an external box of a color electrophotographic printer, and its front face corresponds to the right end face in the Figure. Reference number 1A is a printer front face plate, and this front face plate 1A is freely lowered to open, centered on a hinge axis 1B on the lower side as indicated by a dotted line, and also freely raised to close as indicated by a solid line, based on the printer external box 1. At the time of an attaching or removing process of an intermediate transfer belt unit 2 to or from the printer and an inspection and maintenance operation to the inside of the printer, for example, in the event of a paper jam, the front face plate 1A is lowered to open so that the inside of the printer is widely opened so as to carry out the operation. The attaching and removing processes of the intermediate transfer belt unit 2 are carried out in a vertical direction based on the bus-line direction of the rotary axis of a photosensitive member.

Figure 3:
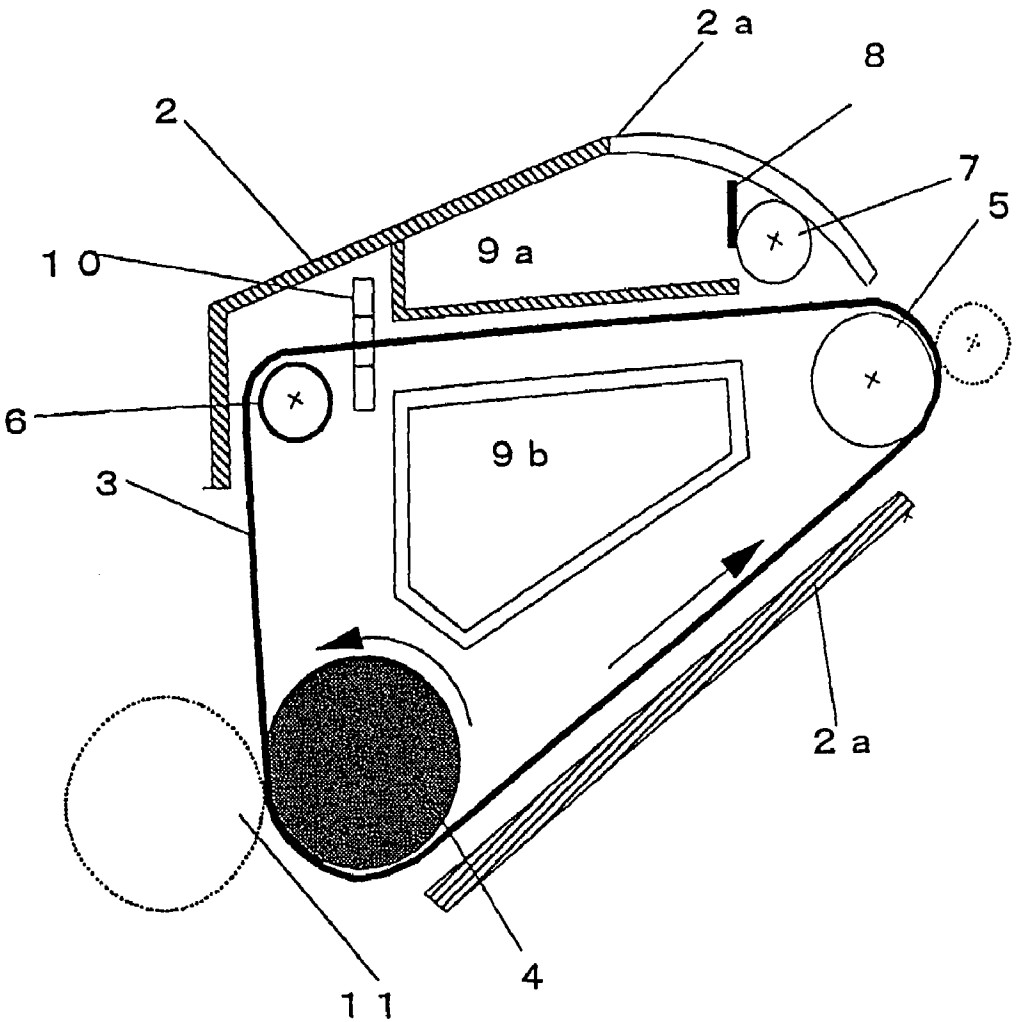
FIG. 3 is a cross-sectional view that shows structure of an intermediate transfer belt unit used in an example of the present invention.
Figure 4:
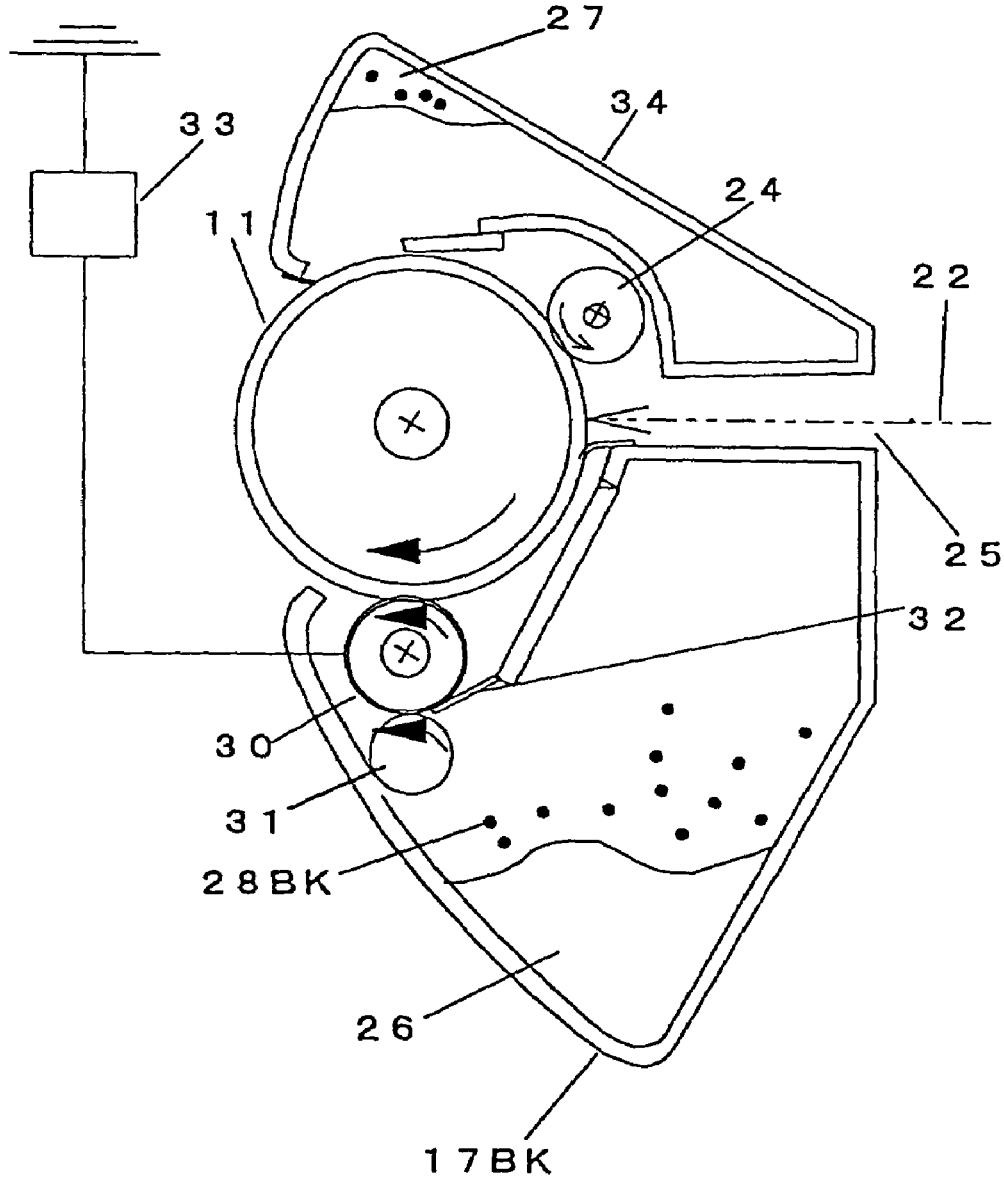
FIG. 4 is a cross-sectional view that shows structure of a developing unit used in an example of the present invention.

FIG. 3 shows the structure of the intermediate transfer belt unit 2. The intermediate transfer belt unit 2 provides the following devices and members housed in a unit housing 2*a*: an intermediate transfer belt 3, a first transfer roller 4 made of a conductive member, a second transfer roller 5 made of an aluminum roller, a tension roller 6 for adjusting the tension of the intermediate transfer belt 3, a belt cleaner roller 7 for cleaning a residual toner image on the intermediate transfer belt 3, a scraper 8 for scraping toner collected on the cleaner roller 7, waste toner storing sections 9*a* and 9*b* for storing the collected toner, and a position detector 10 for detecting the position of the intermediate transfer belt 3. As illustrated in FIG. 2, the intermediate transfer belt unit 2 is freely attached and detached to and from a predetermined housing section inside the printer external box 1 by lowering to open the front face plate 1A of the printer as indicated by a dotted line.

The intermediate transfer belt 3 is formed by kneading a conductive filler in an insulating resin and extruding through an extruder as a film. In the present Example, based on the insulating resin, a material made by adding 5 parts by weight of conductive carbon (for example, Ketchen Black) to 95 parts by weight of a polycarbonate resin (for example, Yupiron Z300, made by Mitsubishi Gas Chemical Co., Inc.) so as to form a film. Moreover, this is coated with a fluoro-resin on its surface. The thickness of the film is set to approximately 350 μm and the resistivity is approximately $10^7$ to $10^9$ Ωcm. Here, the material made by kneading a conductive filler in a polycarbonate resin and forming this into a film is used as the intermediate transfer belt 3. This arrangement is made so as to effectively prevent slackness of the intermediate transfer belt 3 after a long-term use and accumulation of charge. The reason that a surface is coated with a fluoro-resin is because this makes it possible to effectively prevent toner filming on a surface of the intermediate transfer belt after a long-term use.

The intermediate transfer belt 3, which is made of a film that uses semi-conductive urethane as a base material and that has an endless shape with a thickness of 100 μm, is passed over the first transfer roller 4, the second transfer roller 5 and the tension roller 6, and arranged so as to shift in the direction of arrow. Each of these rollers is formed by molding urethane foam that has been subjected to a low-resistance process so as to have a resistivity of $10^6$ to $10^8$ Ωcm and placing this on the circumference thereof. Here, the circumferential length of the intermediate transfer belt 3 is set to 360 mm that is determined by adding a length (62 mm) that is slightly longer than a half of the circumferential length of the photosensitive drum (diameter: 30 mm), which will be described later, to the length (298 mm) of A4 paper in the length direction that is the largest paper size.

When the intermediate transfer belt unit 2 is attached to the printer main body, the first transfer roller 4 is pressed onto a photosensitive member 11 (shown in FIG. 3) with a force of approximately $9.8\times10^4$ N/m$^2$ with the intermediate transfer belt 3 interpolated in between, and the second transfer roller 5 is pressed onto the third transfer roller 12 (shown in FIG. 3) having the same arrangement as the first transfer roller 4 through the intermediate transfer belt 3. The third transfer roller 12 is arranged so as to be driven to rotate by the intermediate transfer belt 3.

The cleaner roller 7 is a roller in the belt cleaner section used for cleaning the intermediate transfer belt 3. This has an arrangement in which AC voltage is applied to a metallic roller so as to electrostatically absorb toner. Here, the cleaner roller 7 may be provided as a rubber blade or a conductive far brush to which voltage is applied.

In FIG. 2, in the center of the printer, a group of image-forming units 18, which include four sets of sector-shaped image-forming units 17Bk, 17Y, 17M and 17C used for respective colors of black, cyan, magenta and yellow, are placed, and these are arranged in ring shape as shown in the Figure. Each of the image-forming units 17Bk, 17Y, 17M and 17C is freely attached and detached to and from a predetermined position in the group of image-forming units 18 by opening a printer upper face plate 1C centered on a hinge axis 1D. By properly attaching the image-forming units 17Bk, 17Y, 17M and 17C into the printer, the image-forming unit sides and the printer side are coupled in their mechanical driving systems and electric circuit systems through coupling members (not shown) so as to be integrated into one system mechanically as well as electrically.

The image-forming units 17Bk, 17C, 17M and 17Y, which are arranged in the ring shape, are supported by supporting members (not shown) so that they are driven as a whole by a shifting motor 19 that is a shifting means; thus, they are arranged on the periphery of a shaft 20 that has a cylinder shape and is fixed and not rotated, so as to be rotated and shifted around the shaft 20. The respective image-forming units are rotated and shifted so that they are successively positioned at an image-forming position 21 opposing the second transfer roller 4 supporting the intermediate transfer belt 3. The image-forming position 21 also serves an exposing position by the signal light 22.

Except for developers stored therein, the respective image-forming units 17Bk, 17C, 17M and 17Y are constituted by the same members; therefore, for convenience of explanation, an explanation will be given of the image-forming unit 17Bk, and based on the units of the other colors, an explanation thereof is omitted.

Reference numeral 35 is a laser beam scanner section placed on the lower side of the external box 1 of the printer, and constituted by a semiconductor laser, not shown, a scanner motor 35*a*, a polygon mirror 35*b*, a lens system 35*c*, etc. The pixel laser signal light 22, which is representative of a time-series electric image signal of image information released from the laser beam scanner section 35, is allowed to pass through a light-path window 36 formed between the image-forming units 17Bk and 17Y, made incident on a fixed mirror 38 inside the shaft 20 through a window 37 opened in one portion of the shaft 20, reflected therefrom to progress substantially horizontally to enter the image-forming unit 17Bk through an exposing window 25 of the image-forming unit 17Bk positioned at the image-forming position 21, and made incident on the exposing section on the left side face of a photosensitive member 11 through a path between the developer storing section 26 and the cleaner 34 that are placed vertically inside the image-forming unit, so as to carry out scanning and exposing processes in the bus-line direction.

In this case, the light path from the light-path window 36 to the mirror 38 utilizes a gap between the adjacent image-forming units 17Bk and 17Y; therefore, hardly any wasteful spaces exist in the group of image-forming units 18. Moreover, since the mirror 38 is placed in the center of the group of image-forming units 18, a single, fixed mirror is utilized so that this arrangement is simple, and enables an easy positioning process.

Reference numeral 12 is the third transfer roller that is placed above a paper feed roller 39 inside the printer front face plate 1A, and a paper transport path is formed at a nip section at which the intermediate transfer belt 3 and the third transfer roller 12 are pressed to each other so that paper is sent thereto by the paper feed roller 39 placed below the printer front face plate 1A.

Reference numeral 40 is a paper feed cassette placed on the lower side of the printer front face plate 1A in a manner so as to stick outward, and a plurality of sheets of paper S are set thereon simultaneously. Reference numerals 41*a* and 41*b* are paper transport timing rollers, 42*a* and 42*b* are a pair of fixing rollers placed on an upper portion inside the printer, 43 is a paper guide plate placed between the third transfer roller 12 and the fixing rollers 42*a* and 42*b*, 44*a* and 44*b* are a pair of paper discharge rollers placed on the paper discharging side of the pair of fixing rollers 42*a*, 42*b*, and 47 is a cleaning roller for the fixing roller 42*a*.

A fixing device is constituted by a hollow roller, made of aluminum or stainless, having a heating means, a heating roller constituted by an elastic layer and a fluoro-resin tube, and a pressure roller. The outermost layer, that is, the fluoro-resin tube, is preferably made of a tube having a thickness of 1 to 100 μm, which is at least one member selected from the group consisting of polytetrafluoroethylene, a copolymer between tetrafluoroethylene and perfluoroalkylvinylether and a copolymer between tetrafluoroethylene and hexafluoroethylene. The elastic layer is preferably made from silicone rubber, fluoro-rubber, fluorosilicone rubber, or ethylene propylene rubber. The hardness of the elastic layer is from w to hi degrees in conformity with JIS standard, and is pressed by the pressure roller with a pressure of $4.9\times10^4$ to $1.96\times10^6 N/m^2$. In the present Example, this is made of a fluoro-resin tube of polytetrafluoroethylene having a thickness of 50 μm and silicone rubber having a rubber hardness of 70 degrees, and pressed with a pressure of $1.47\times10^4$ $N/m^2$. Fixing oil such as silicone oil is not used.

Each of the image-forming units 17Bk, 17C, 17M, 17Y and the intermediate transfer belt unit 2 provides a waste toner storing section.

The following description will discuss the operation.

As illustrated in FIG. 2, based on the group of image-forming units 18, the black image-forming unit 17Bk is located at the image-forming position 21. At this time, a photosensitive member 11 is allowed to face and contact the first transfer roller 4 through the intermediate transfer belt 3.

During the image-forming process, signal light for black is inputted to the image-forming unit 17Bk by the laser beam scanner section 35 so that an image-forming process is carried out by using black toner. At this time, the speed of image formation of the image-forming unit 17Bk (equal to the peripheral speed of a photosensitive member, 60 mm/s) is set to be identical to the moving speed of the intermediate transfer belt 3 so that simultaneously with the image formation, a black toner image is transferred onto the intermediate transfer belt 3 by the function of the first transfer roller 4. In this case, DC voltage of +1 kV is applied to the first transfer roller. Immediately after all the black toner image has been transferred thereon, the image-forming units 17Bk, 17C, 17M and 17Y are driven to rotate in the direction of arrow in the Figure by the shifting motor 19 as a whole as the group of image-forming units 18, and stopped at a position where the image-forming unit 17C has reached the image-forming position 21 after having been rotated by 90 degrees. During this process, the portions such as the toner hopper 26 and the cleaner 34 other than a photosensitive member of the image-forming unit are located inner sides from the rotation circular arc of the leading end of a photosensitive member 11, the intermediate transfer belt 3 never comes into contact with the image-forming units.

After the arrival of the image-forming unit 17C at the image-forming position 21, next, in the same manner as before, signal light 22 representative of a cyan signal is inputted to the image-forming unit 17C by the laser beam scanner section 35 so that a toner image of cyan is formed and transferred. Up to this time, the intermediate transfer belt 3 has made one rotation so that the cyan signal light is controlled in its writing timing so as to allow the next cyan toner image to positionally coincide with the black toner previously transferred. During this time, the third transfer roller 12 and the cleaner roller 7 are maintained slightly apart from the intermediate transfer belt 3 so that they do not disturb the toner image on the transfer belt.

The same operations as described above are carried out on magenta and yellow so that a color image, which consists of toner images of four colors that have been superimposed in a manner so as to positionally coincide with one after another, is formed on the intermediate transfer belt 3. After the last yellow toner image has been transferred, the toner images of four colors are transferred on paper sent thereto from the paper feed cassette 40 in properly synchronized timing, in one batch, by the function of the third transfer roller 12. At this time, the second transfer roller 5 is grounded, while DC current voltage of +1.5 kV is applied to the third transfer roller 12. The toner image transferred onto the paper is fixed by the pair of fixing rollers 42*a*, 42*b*. The paper is then discharged out of the apparatus through the pair of discharging rollers 44*a*, 44*b*. Residual toner remaining on the intermediate transfer belt 3 after the transferring process is cleaned by the function of the cleaner roller 7 so as to be ready for the next image formation.

Next, an explanation will be given of an operation at the time of a mono-color mode. At the time of the mono-color mode, first, the image-forming unit of the corresponding color is shifted to the image-forming position 21. Next, an image-forming process and a transferring process onto the intermediate transfer belt 3 for the corresponding color are carried out in the same manner as described above, and in this case, the transferred toner image is successively transferred onto paper sent thereto from the paper feed cassette 40 by the third transfer roller 12, and this is fixed, as it is.

Here, in the present apparatus, based on the structure of the image-forming unit, another image-forming unit using a conventional developing method may be used as well.

Table 17 shows the results of tests in which images were printed out by using the electrophotographic apparatus of FIG. 2.

TABLE 17

| Toner | Filming on photosensitive member | Image density (ID) Initial/After tests | Fogging | Fogging after storage under high humidity | ID under high temp. and low humidity Initial/After 5,000 copies | Void image |
|---|---|---|---|---|---|---|
| TM-1 | not generated | 1.38/1.44 | ○ | ○ | 1.30/1.40 | not generated |
| TM-2 | not generated | 1.37/1.47 | ○ | ○ | 1.32/1.37 | not generated |
| TM-3 | not generated | 1.44/1.40 | ○ | ○ | 1.38/1.40 | not generated |
| TM-4 | not generated | 1.41/1.49 | ○ | ○ | 1.35/1.34 | not generated |
| TM-5 | not generated | 1.42/1.48 | ○ | ○ | 1.36/1.38 | not generated |
| TM-6 | not generated | 1.42/1.50 | ○ | ○ | 1.32/1.35 | not generated |
| tm-7 | generated | 1.30/1.10 | X | X | 1.22/1.02 | generated |
| TY-1 | not generated | 1.31/1.40 | ○ | ○ | 1.30/1.34 | not generated |
| TY-2 | not generated | 1.32/1.45 | ○ | ○ | 1.30/1.34 | not generated |
| TY-3 | not generated | 1.34/1.40 | ○ | ○ | 1.31/1.39 | not generated |
| TY-5 | not generated | 1.32/1.40 | ○ | ○ | 1.30/1.34 | not generated |
| TY-6 | not generated | 1.30/1.38 | ○ | ○ | 1.26/1.34 | not generated |
| ty-7 | generated | 1.35/1.10 | X | X | 1.20/1.00 | generated |
| TC-1 | not generated | 1.40/1.42 | ○ | ○ | 1.34/1.39 | not generated |
| TC-2 | not generated | 1.38/1.44 | ○ | ○ | 1.32/1.38 | not generated |
| TC-3 | not generated | 1.38/1.42 | ○ | ○ | 1.34/1.37 | not generated |
| TC-4 | not generated | 1.40/1.44 | ○ | ○ | 1.32/1.36 | not generated |
| TC-6 | not generated | 1.35/1.40 | ○ | ○ | 1.32/1.38 | not generated |
| tc-7 | generated | 1.32/1.20 | X | X | 1.20/1.04 | generated |
| TB-1 | not generated | 1.36/1.48 | ○ | ○ | 1.32/1.38 | not generated |
| TB-2 | not generated | 1.44/1.49 | ○ | ○ | 1.38/1.42 | not generated |
| TB-3 | not generated | 1.45/1.50 | ○ | ○ | 1.39/1.45 | not generated |
| TB-4 | not generated | 1.44/1.48 | ○ | ○ | 1.40/1.42 | not generated |
| TB-5 | not generated | 1.42/1.46 | ○ | ○ | 1.35/1.35 | not generated |
| tc-7 | generated | 1.28/1.20 | X | X | 1.20/1.05 | generated |

Images were printed out by the above-mentioned electrophotographic apparatus using the toner manufactured as described above. As a result, none of lateral line disturbances, toner scattering and void character images occurred, uniform solid black images were obtained, images with high resolution and high image quality were obtained with image lines of 16/mm being properly reproduced, and images with a high density of not less than 1.3 were obtained. No background fogging occurred on non-image portions. Moreover, even in the long-term endurance tests of 10,000 copies, the fluidity and image density were less susceptible to a change and exerted stable characteristics. In the transferring process, void images hardly occurred, raising no problem in practical use, and a transferring efficiency of not less than 90% was obtained. Furthermore, filming due to toner hardly occurred on a photosensitive member or the intermediate transfer belt, raising no problem in practical use.

Next, Table 18 shows the results of evaluations made on the transmittance and the high-temperature anti-offset property in the case when a solid image of not less than 0.4 g/cm$^2$ was fixed at 170° C. by a fixing device without using oil coating. The processing speed was set to 100 mm/s, and based on the transmittance, a spectrophotometric detector U-3200 (made by Hitachi Seisakusho K.K.) was used to measure the transmittance of light of 700 nm. If the OHP transmittance is not less than 80% and when the high-temperature offset generation temperature is not less than 190° C., no problem arises in practical use.

TABLE 18

| Toner | OHP transmittance (%) | High-temperature off-set generation temp. (° C.) | Test for storing property |
|---|---|---|---|
| TM-1 | 87 | 220 | ○ |
| TM-2 | 87.8 | 220 | ○ |
| TM-3 | 90.2 | 230 | ○ |
| TM-4 | 91.5 | 230 | ○ |
| TM-5 | 90.6 | 210 | ○ |
| TM-6 | 90.8 | 210 | ○ |
| tm-7 | 90.5 | occurred in all the temperature range | X |
| TY-1 | 90.8 | 230 | ○ |
| TY-2 | 91.9 | 230 | ○ |
| TY-3 | 92 | 220 | ○ |
| TY-5 | 89.2 | 230 | ○ |
| TY-6 | 90.5 | 230 | ○ |
| ty-7 | 92.5 | occurred in all the temperature range | X |
| TC-1 | 89.2 | 220 | ○ |
| TC-2 | 90.8 | 230 | ○ |
| TC-3 | 91.3 | 220 | ○ |
| TC-4 | 91.2 | 230 | ○ |
| TC-6 | 90.8 | 220 | ○ |
| tc-7 | 92.4 | occurred in all the temperature range | X |

The OHP transmittance showed not less than 80%, the high-temperature offset generation temperature was not less than 190° C., and the anti-offset temperature width was 40 to 60 K, indicating a superior fixing property even in the case of a fixing roller without using any oil. Moreover, in storage stability test at 50° C. for 24 hours, aggregation was hardly observed.

The invention claimed is:

1. A toner, which is prepared by kneading a toner composition containing at least:

a binder resin comprising a molecular weight maximum peak in a range of molecular weights from $2\times10^3$ to $3\times10^4$ in molecular weight distribution of GPC chromatogram, and a component having a molecular weight of not less than $3\times10^4$, as a component located in high molecular weight range, in an amount of not less than 5% based on the entire binder resin; and a colorant;

wherein said toner comprises a molecular weight maximum peak in a range of molecular weights from $2\times10^3$ to $3\times10^4$ in molecular weight distribution of GPC chromatogram, and a molecular weight maximum peak or shoulder in a range from $3\times10^4$ to $1\times10^6$.

2. The toner according to claim 1, which comprises a ratio Hb/Ha of 0.15 to 0.90 wherein Ha represents height of said molecular weight maximum peak located on a range of $2\times10^3$ to $3\times10^4$ in molecular weight distribution of GPC chromatogram of said toner, and Hb represents height of said molecular weight maximum peak or shoulder located on a range of $3\times10^4$ to $1\times10^6$.

3. The toner according to claim 1, which comprises a ratio (Hb-La)/(Ha-La) of 0.04 to 0.6 wherein Ha represents height of said molecular weight maximum peak located on a range of $2\times10^3$ to $3\times10^4$ in molecular weight distribution of GPC chromatogram of said toner, Hb represents height of said molecular weight maximum peak or the shoulder located on a range of $3\times10^4$ to $1\times10^6$, and La represents height of said molecular weight minimum bottom.

4. The toner according to claim 1, which comprises a ratio M10/M90 of not more than 6 wherein M90 represents the molecular weight corresponding to 90% of height of said molecular weight maximum peak or shoulder, and M10 represents the molecular weight corresponding to 10% of height of said molecular weight maximum peak or shoulder, in a molecular weight curve located on a range greater than a molecular weight value corresponding to said maximum peak or shoulder located on a range of molecular weights of $3\times10^4$ to $1\times10^6$ in molecular weight distribution of GPC chromatogram of said toner, supposing that height of said maximum peak or shoulder of molecular weight distribution is 1.

5. The toner according to claim 1, which comprises a ratio (M10-M90)/M90 of not more than 5 wherein M90 represents the molecular weight corresponding to 90% of height of said molecular weight maximum peak or shoulder, and M10 represents the molecular weight corresponding to 10% of height of said molecular weight maximum peak or shoulder, in a molecular weight curve located on a range greater than a molecular weight value corresponding to said maximum peak or shoulder located on a range of molecular weights of $3\times10^4$ to $1\times10^6$ in molecular weight distribution of GPC chromatogram of said toner, supposing that height of said maximum peak or shoulder of molecular weight distribution is 1.

6. The toner according to claim 1, wherein a component having a molecular weight in a range of $8\times10^4$ to $1\times10^7$ is contained as said component located in high molecular weight range of the binder resin, in an amount of not less than 3% based on the entire binder resin, and a component having a molecular weight of not less than $1\times10^7$ is not contained.

7. The toner according to claim 1, wherein a component having a molecular weight in a range of $3\times10^5$ to $9\times10^6$ is contained as said component located in high molecular weight range of the binder resin, in an amount of not less than 1% based on the entire binder resin, and a component having a molecular weight of not less than $9\times10^6$ is not contained.

8. The toner according to claim 1, wherein a high molecular weight component of not less than $3\times10^5$ is contained as a component located in high molecular weight range of said toner, in an amount of not more than 10% based on the entire toner.

9. The toner according to claim 1, wherein a high molecular weight component of not less than $1\times10^6$ is contained as a component located in high molecular weight range of said toner, in an amount of not more than 1% based on the entire toner, or is not contained.

10. A toner, which is prepared by kneading a toner composition containing at least a polyester resin which has a weight average molecular weight Mwf of 10,000 to 400,000, a Wmf of 3 to 100 wherein the Wmf represents a ratio Mwf/Mnf of the weight average molecular weight Mwf and the number average molecular weight Mnf, a Wzf of 10 to 2000 wherein the Wzf represents a ratio Mzf/Mnf of the Z average molecular weight Mzf and the number average molecular weight Mnf, and a colorant through thermal or mechanical function, wherein said toner has a weight average molecular weight Mwv of 8,000 to 300,000, a Wmv of 2 to 100 wherein Wmv represents a ratio Mwv/Mnv of the weight average molecular weight Mwv and a number average molecular weight Mnv, a Wzv of 8 to 1200 wherein Wzv represents a ratio Mzv/Mnv of the Z average molecular weight Mzv and the number average molecular weight Mnv.

11. The toner according to claim 1, further having a Mwf/Mwv of 1.2 to 10, a Wmf/Wmv of 1.2 to 10, and a Wzf/Wzv of 2.2 to 30.

* * * * *

UNITED STATES PATENT AND TRADEMARK OFFICE

CERTIFICATE OF CORRECTION

PATENT NO. : 7,208,254 B2
APPLICATION NO. : 11/352269
DATED : April 24, 2007
INVENTOR(S) : Yasuhito Yuasa et al.

It is certified that error appears in the above-identified patent and that said Letters Patent is hereby corrected as shown below:

In column 62, claim 11, line 12, please change “claim 1” to --claim 10--.

Signed and Sealed this

Twenty-third Day of October, 2007

JON W. DUDAS
*Director of the United States Patent and Trademark Office*